US009916723B2

(12) United States Patent
Arnone et al.

(10) Patent No.: US 9,916,723 B2
(45) Date of Patent: Mar. 13, 2018

(54) APPLICATION CREDIT EARNING INTERLEAVED WAGERING SYSTEM

(71) Applicant: Gamblit Gaming, LLC, Glendale, CA (US)

(72) Inventors: Miles Arnone, Sherborn, MA (US); Eric Meyerhofer, Pasadena, CA (US); Frank Cire, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 260 days.

(21) Appl. No.: 14/746,731

(22) Filed: Jun. 22, 2015

(65) Prior Publication Data

US 2015/0371496 A1 Dec. 24, 2015

Related U.S. Application Data

(60) Provisional application No. 62/019,882, filed on Jul. 1, 2014, provisional application No. 62/015,275, filed on Jun. 20, 2014.

(51) Int. Cl.
*A63F 9/24* (2006.01)
*G07F 17/32* (2006.01)

(52) U.S. Cl.
CPC ..... *G07F 17/3232* (2013.01); *G07F 17/329* (2013.01); *G07F 17/3225* (2013.01)

(58) Field of Classification Search
CPC ..... G07F 17/3244; G07F 17/3232
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |
| 6,227,974 | B1 | 5/2001 | Eilat |
| 6,267,669 | B1 | 7/2001 | Luciano |

(Continued)

*Primary Examiner* — Steve Rowland
(74) *Attorney, Agent, or Firm* — Caitlyn Ross

(57) ABSTRACT

An application credit earning interleaved wagering system is disclosed, including an interactive controller configured to: communicate application telemetry; receive wager outcome display instructions; display a wager outcome; receive and display eligible awards; communicate an AC award request comprising an AC award from the eligible awards; and receive AC award instructions comprising the AC award; a wager controller constructed to: receive wager request; communicate wager outcome; and the application controller operatively connecting the interactive controller and the wager controller, the application controller also operatively connected to a patron management server and an AC management device, and constructed to: receive the application telemetry; determine whether to trigger a wager request; communicate the wager request; receive the wager outcome; communicate wager outcome display instructions; communicate the application telemetry; receive an AC value amount; communicate the AC value display instructions; receive AC award data comprising the AC award; communicate the AC award instructions.

20 Claims, 24 Drawing Sheets

(56) References Cited

U.S. PATENT DOCUMENTS 6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,322,885 B1 * 1/2008 Luciano, Jr. ..... G07F 17/32 273/138.1
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,475,266 B2 7/2013 Arnone
8,480,470 B2 7/2013 Napolitano et al.
8,622,809 B1 1/2014 Arora et al.
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0175471 A1 11/2002 Faith
2003/0050111 A1 * 3/2003 Saffari ..... G06Q 30/0207 463/25
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2004/0254010 A1 * 12/2004 Fine ..... G07F 17/32 463/25
2004/0266522 A1 * 12/2004 Byng ..... G07F 17/32 463/26
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 * 2/2007 Taylor ..... G07F 17/3244 463/16
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117613 A1 * 5/2007 Hoover ..... G07F 17/32 463/25
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0232386 A1 * 10/2007 Yoshimura ..... G07F 17/32 463/25
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich

(56) References Cited

U.S. PATENT DOCUMENTS

2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0064967 A1* 3/2012 Preisach ..... G06Q 30/02 463/25
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Arnone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.

* cited by examiner

APPLICATION CREDIT EARNING INTERLEAVED WAGERING SYSTEM

CROSS REFERENCE TO RELATED APPLICATIONS

This application claims the benefit of U.S. Provisional Patent Application No. 62/015,275, filed Jun. 20, 2014 and U.S. Provisional Patent Application No. 62/019,882, filed Jul. 1, 2014, the disclosures of each of which are incorporated by reference herein in their entirety.

FIELD OF THE INVENTION

Embodiments of the present invention are generally related to communications within data processing systems. More particularly, the present invention relates to the communication and processing of wagering data.

BACKGROUND

The gaming industry has traditionally developed electronic gaming machines that present simple gambling games to a user. The communication and processing needs for these simple gambling games are easily met using conventional processing systems.

For example, U.S. Pat. No. 6,905,405 to McClintic describes a conventional gaming device provided with a central processor (CPU) operably coupled to input logic circuitry and output logic circuitry. The input logic circuitry is employed to operably couple CPU to input devices such as, for example, a touch screen segment or physical button, a coin acceptor, a bill acceptor, a player tracking card reader or a credit/debit card reader. The output logic circuitry is employed to operably couple the CPU with output devices such as, for example, a hopper, a video monitor, meter displays, and a printer. The CPU is also operably coupled to controlling software memory, which includes assigned memory locations storing game software and system software. Such controlling software memory dictates when selected graphics or messages are displayed to a player, as well as when play sequences begin and end and management of wager input and award output. The CPU is also operably coupled to a second memory, which is employed to store data indicative of game statistics, number of plays, number of wins, etc. Controlling software memory, a second memory, or other, ancillary memory store data indicative of winning results, such as data representative of one or more symbol combinations, including winning combinations. Second memory may also be used, for example, to store a bit map of the symbol pattern depicted as a matrix display on video monitor. In operation of the gaming device the CPU carries out instructions of the system software to implement an initial display pattern on the video monitor and to enable the input devices. After a wager is received a player activates an initiator element such as a handle, the physical button or the touch screen to initiate a play sequence. At this point, the game software, in conjunction with a random number generator, generates a random symbol configuration at for a random final outcome comprised of a pattern of symbols for depiction on video monitor. System software then animates the video monitor by simulating the movement of visible representations of symbol carriers including symbols thereon so that the player perceives symbol carrier rotational "movement" of each symbol carrier as well as, optionally, rotational movement of the entire group of symbol carriers about a common axis. Once the visible representations of the symbol carriers have stopped, all of the generated, displayed symbols comprising a winning combination or combinations in the matrix display are identified or flagged. The displayed results (pattern of symbols depicted on the video monitor, which may include symbols received from a remote location, is compared with data stored in game software representing winning combinations to determine if any displayed combination on an active pay line is a winning combination. Any identified winning combination or combinations of symbols are then associated with winnings to be distributed to the player according to a paytable of the game software associated with the various possible winning combinations. The various pay line configurations and required combinations of the various indicia for a winning combination within each pay line reside within the game software and are retrieved for comparison to the randomly generated pattern of indicia depicted on the video monitor.

Operation of another conventional computer gaming system is described in U.S. Pat. No. 6,409,602 issued to Wiltshire et al. A game program is executed on server/host computer. It is then determined whether an image is to be displayed on a screen of a client/terminal computer. If so, an image is sent from the server/host computer to client/terminal computer. The image may include any type of graphical information including a bitmap, a JPEG file, a TIFF file or even an encoded audio/video stream such as a compressed video MPEG stream. The image is generated by game computer program and passed to server/host interface program. In turn, the image is transferred over communication pathways to client/terminal computer via the network services provided by server operating system. The image is received by a client/terminal program executing on the client/terminal computer via the network services provided by client operating system. The client/terminal program then causes the image to be displayed on a screen of the client/terminal computer. It is then determined whether an input command has been entered by the patron using the client/terminal computer. The input command may be a keystroke, movement or clicking of the mouse, a voice activated command or even the clicking of a "virtual button" on a touch screen. The client/terminal program causes the input command to be transmitted back to server/host computer via communication pathways, again using network services provided by the client operating system on one end and server operating system on the other. The command is thus received by the server/host interface program, that, in turn, passes the command back to the game program. The game program processes the input command and updates the state of the game accordingly.

However, more complicated gambling games need communication and processing systems that are better suited for implementing these more complicated gambling games. Various aspects of embodiments of the present invention meet such a need.

SUMMARY OF THE INVENTION

Systems in accordance with embodiments of the invention provide a communication and data processing system constructed for an application credit earning interleaved wagering system.

An embodiment includes an interactive controller configured to: communicate, to an application controller, application telemetry associated with a user of an interactive application provided by the interactive controller; receive, from the application controller, wager outcome display instructions; display a wager outcome based on the wager outcome display instructions; receive, from the application controller, application credit (AC) value display instructions; display eligible awards based on the AC value display instructions; communicate, to a patron management server, an AC award request comprising an AC award from the eligible awards; and receive, from the application controller, AC award instructions comprising the AC award; a wager controller constructed to: receive, from the application controller, wager request instructions; determine the wager outcome based on the wager request instructions; communicate, to the application controller, wager outcome data comprising the wager outcome; and the application controller operatively connecting the interactive controller and the wager controller, the application controller also operatively connected to a patron management server and an AC management device, and constructed to: receive, from the interactive controller, the application telemetry; scan the application telemetry to determine whether to trigger a wager request; generate the wager request instructions; instruct the wager controller by communicating the wager request instructions to the wager controller; receive, from the wager controller, the wager outcome data; scan the wager outcome data to determine the wager outcome; generate the wager outcome display instructions based on the wager outcome; instruct the interactive controller by communicating the wager outcome display instructions to the interactive controller; communicate, to the AC management device, the application telemetry, wherein the AC management device awards AC based on the application telemetry; receive, from the patron management server, an AC value amount associated with the user; scan the AC value amount to determine a display of eligible awards that may be acquired in exchange for AC; generate the AC value display instructions using the AC value amount; instruct the interactive controller by communicating the AC value display instructions to the interactive controller; receive, from the patron management server, AC award data comprising the AC award; scan the AC award data to determine the AC award; generate the AC award instructions based on the AC award data; and instruct the interactive controller by communicating the AC award instructions to the interactive controller.

In a further embodiment, the interactive controller and the application controller are constructed from the same device, and the application controller is operatively connected to the wager controller using a communication link.

In a further embodiment, the wager controller and the application controller are constructed from the same device, and the application controller is operatively connected to the interactive controller using a communication link.

In a further embodiment, the interactive controller is further constructed to receive, from the user, an indication to use AC in exchange for an AC award.

In a further embodiment, the AC award is an entry in a lottery.

In a further embodiment, the AC award is a predetermined number of executions of a wagering mechanic.

In a further embodiment, the AC award is an entry in a tournament.

In a further embodiment, the AC award is an application resource for use in the interactive application.

An embodiment includes a wager controller of the application credit earning interleaved wagering system constructed to: receive, from an application controller, wager request instructions; determine a wager outcome based on the wager request instructions; communicate, to the application controller, wager outcome data comprising the wager outcome; and the application controller of the application credit earning interleaved wagering system operatively connecting an interactive controller and the wager controller, the application controller also operatively connected to a patron management server and an AC management device, and constructed to: receive, from the interactive controller, application telemetry associated with a user of an interactive application provided by the interactive controller; scan the application telemetry to determine whether to trigger a wager request; generate the wager request instructions; instruct the wager controller by communicating the wager request instructions to the wager controller; receive, from the wager controller, the wager outcome data; scan the wager outcome data to determine the wager outcome; generate wager outcome display instructions based on the wager outcome; instruct the interactive controller by communicating the wager outcome display instructions to the interactive controller; communicate, to the AC management device, the application telemetry, wherein the AC management device awards AC based on the application telemetry; receive, from the patron management server, an AC value amount associated with the user; scan the AC value amount to determine a display of eligible awards that may be acquired in exchange for AC; generate AC value display instructions using the AC value amount; instruct the interactive controller by communicating the AC value display instructions to the interactive controller; receive, from the patron management server, AC award data comprising the AC award; scan the AC award data to determine the AC award; generate AC award instructions based on the AC award data; and instruct the interactive controller by communicating the AC award instructions to the interactive controller.

An embodiment includes an interactive controller of the application credit earning interleaved wagering system configured to: communicate, to an application controller, application telemetry associated with a user of an interactive application provided by the interactive controller; receive, from the application controller, wager outcome display instructions; display a wager outcome based on the wager outcome display instructions; receive, from the application controller, application credit (AC) value display instructions; display eligible awards based on the AC value display instructions; communicate, to a patron management server, an AC award request comprising an AC award from the eligible awards; and receive, from the application controller, AC award instructions comprising the AC award; and the application controller of the application credit earning interleaved wagering system operatively connecting the interactive controller to a wager controller, the application controller also operatively connected to a patron management server and an AC management device, and constructed to: receive, from the interactive controller, the application telemetry; scan the application telemetry to determine whether to trigger a wager request; generate wager request instructions; instruct the wager controller by communicating the wager request instructions to the wager controller; receive, from the wager controller, wager outcome data; scan the wager outcome data to determine the wager outcome; generate the wager outcome display instructions based on the wager outcome; instruct the interactive controller by communicating the wager outcome display instructions to the interactive controller; communicate, to the AC management device, the application telemetry, wherein the AC management device awards AC based on the application telemetry; receive, from the patron management server, an AC value amount associated with the user; scan the AC value amount to determine a display of eligible awards that may be acquired in exchange for AC; generate the AC value display instructions using the AC value amount; instruct the interactive controller by communicating the AC value display instructions to the interactive controller; receive, from the patron management server, AC award data comprising the AC award; scan the AC award data to determine the AC award; generate the AC award instructions based on the AC award data; and instruct the interactive controller by communicating the AC award instructions to the interactive controller.

DETAILED DESCRIPTION

Figure 1A:
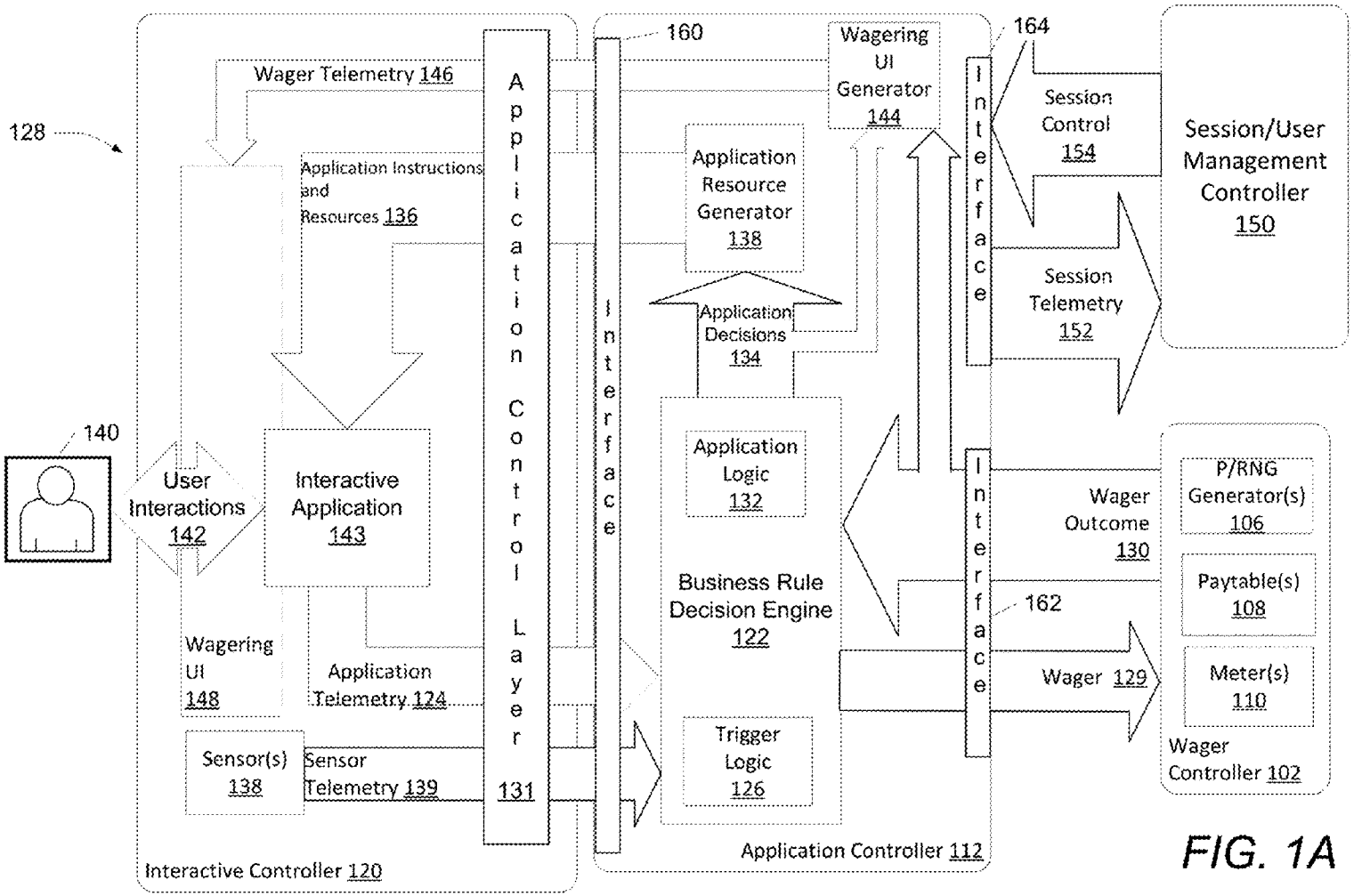
FIG. 1A is a diagram of a structure of an application credit earning interleaved wagering system in accordance with various embodiments of the invention.

An application credit earning interleaved wagering system interleaves wagering with non-wagering activities. In some embodiments of an application credit earning interleaved wagering system an interactive application executed by an interactive controller provides non-wagering components of the application credit earning interleaved wagering system. The interactive controller is operatively connected to an application controller that manages and configures the interactive application of the interactive controller and determines when wagers should be interleaved with the operations of the interactive application. The application controller is further operatively connected to a wager controller that provides one or more wagering propositions for one or more wagers.

In some embodiments, the interactive controller also includes a wagering user interface that is used to display data about a wagering process, including but not limited a wager outcome of a wager made in accordance with a wagering proposition. The content of the wagering user interface is controlled by the application controller and includes content provided by the wager controller.

In several embodiments, a user or user interactions are represented in an application credit earning interleaved wagering system by the electronic representation of interactions between the user and the interactive application, typically received via a user interface of the interactive application, and a user profile of the application credit earning interleaved wagering system associated with the user.

Many different types of interactive applications may be utilized with the application credit earning interleaved wagering system. In some embodiments, the interactive application reacts to the physical activity of the user. In these embodiments, the user interacts with the interactive application through one or more sensors that monitor the user's physical activities. Such sensors may include, but are not limited to, physiological sensors that monitor the physiology of the user, environmental sensors that monitor the physical environment of the user, accelerometers that monitor changes in motion of the user, and location sensors that monitor the location of the user such as global positioning sensors.

In some embodiments, the interactive application is a skill-based interactive game that is played by the user.

In some embodiments, the interactive application is a tool used by the user to achieve some useful goal.

In operation, a user interacts with the interactive application using various types of elements of the interactive application in an interactive application environment. Elements are interactive application resources utilized by the user within the interactive application environment to provide an interactive experience for the user. Wagers of credits are made in accordance with a wagering proposition as triggered by the user's use of one or more of the elements of the interactive application. Wager outcomes of wagers of credits made in accordance with the wagering proposition can cause consumption, loss or accrual of credits.

In accordance with some embodiments, wager outcomes of wagering events can influence elements in the interactive application such as, but not limited to, providing one or more new elements, restoring one or more consumed elements, causing the loss of one or more elements, and restoration or placement of one or more fixed elements.

In various embodiments, the wagers may be made using one or more credits (Cr).

In some embodiments, Cr can be one or more credits that are purchased using, and redeemed in, a real world currency having a real world value.

In many embodiments, Cr can be one or more credits in a virtual currency. Virtual currency is an alternate currency that can be acquired, purchased or transferred by or to a user, but does not necessarily directly correlate to a real world currency. In many such embodiments, Cr in a virtual currency are allowed to be purchased using a real world currency but are prevented from being redeemed in a real world currency having a real world value.

In several embodiments, during interaction with the interactive application using the elements, a user can optionally consume and/or accrue application environment credit (AC) within the interactive application as a result of the user's use of the interactive application. AC can be in the form of, but is not limited to, application environment credits, experience points, and points generally.

In various embodiments, when the interactive application is a skill-based interactive game, AC is awarded to a player of the skill-based interactive game on the basis of the player's skillful play of the skill-based interactive game. In such embodiments, AC may be analogous to the score in a typical video game. The skill-based interactive game can have one or more scoring criteria, embedded within an application controller and/or an interactive controller that provides the skill-based interactive game, that reflect user performance against one or more goals of the skill-based interactive game.

In many embodiments, AC can be used to purchase in-application items, including but not limited to, application elements that have particular properties, power ups for existing items, and other item enhancements.

In some embodiments, AC may be used to earn entrance into a sweepstakes drawing, to earn entrance in a tournament with prizes, to score in the tournament, and/or to participate and/or score in any other game event.

In several embodiments, AC can be stored on a user-tracking card or in a network-based user tracking system where the AC is attributed to a specific user.

In many embodiments, a wagering proposition includes a wager of AC for a wager outcome of a randomly generated payout of interactive application AC, elements, and/or objects in accordance with a wagering proposition.

In a number of embodiments, a wager of an amount of Cr results in a wager outcome of a payout of AC, elements, and/or objects that have a Cr value if cashed out.

In some embodiments, in a case that an interactive application is a skill-based interactive game, interactive application objects include in-application objects that may be used by a player of the skill-based interactive game to enhance the player's gameplay of the skill-based interactive game. Such objects include, but are not limited to, power-ups, enhanced in-application items, and the like. In some embodiments, the interactive application objects include objects that are detrimental to the player's play of the skill-based interactive game such as, but not limited to, obstructions in the game space, a temporary player handicap, an enhanced opponent, and the like.

In some embodiments, elements in an interactive application include, but are not limited to, enabling elements (EE) that are interactive application environment resources utilized during the user's use of the interactive application and whose utilization by the user while using the interactive application triggers execution of a wager in accordance with a wagering proposition. In another embodiment, elements in an interactive application include, but are not limited to, a reserve enabling element (REE), that is an element that converts into one or more enabling elements upon occurrence of a release event during an interactive user session. In yet another embodiment, elements in an interactive application include, but are not limited to, an actionable element (AE) that is an element that is acted upon during use of the interactive application to trigger a wager in accordance with a wagering proposition and may or may not be restorable during normal play of the interactive application. In yet another embodiment, elements in an interactive application include, but are not limited to, a common enabling element (CEE) that is an element that may be shared by two or more users and causes a wagering event and associated wager to be triggered in accordance with the wagering proposition when used by one of the users during use of the interactive application. In some embodiments, in progressing through interactive application use, a user can utilize elements during interactions with a controlled entity (CE). A CE is a character, entity, inanimate object, device or other object under control of a user.

In accordance with some embodiments of an application credit earning interleaved wagering system, the triggering of the wagering event and/or wager can be dependent upon an interactive application environment variable such as, but not limited to, a required object (RO), a required environmental condition (REC), or a controlled entity characteristic (CEC). A RO is a specific interactive application object in an interactive application acted upon for an AE to be completed. A non-limiting example of an RO is a specific key needed to open a door. An REC is an interactive application state present within an interactive application for an AE to be completed. A non-limiting example of an REC is daylight whose presence enables a character to walk through woods. A CEC is a status of the CE within an interactive application for an AE to be completed. A non-limiting example of a CEC is requirement that a CE have full health points before entering battle. Although various interactive application resources such as, but not limited to, the types of interactive application elements as discussed herein may be used to trigger a wager in accordance with a wagering proposition, one skilled in the art will recognize that any interactive application resource can be utilized in an application credit earning interleaved wagering system to trigger of a wager as appropriate to the specification of a specific application in accordance with various embodiments of the invention.

In several embodiments, an application credit earning interleaved wagering system can utilize an application controller to monitor use of the interactive application executed by an interactive controller for detecting a trigger of a wagering event. The trigger for the wagering event can be detected by the application controller from the utilization of the interactive application in accordance with at least one wagering event occurrence rule. The trigger of the wagering event can be communicated to a wager controller. In response to notification of the trigger, the wager controller executes a wager in accordance with a wagering proposition. In addition, use of an interactive application in an application credit earning interleaved wagering system can be modified by the application controller based upon the wager outcome.

In several embodiments, a wagering event occurrence can be determined from one or more application environment variables within an interactive application that are used to trigger a wager and/or associated wager in accordance with a wagering proposition. Application environment variables can include, but are not limited to, passage of a period of time during application credit earning interleaved wagering system interactive application use, a result from an application credit earning interleaved wagering system interactive application user session (such as, but not limited to, achieving a goal or a particular score), a user action that is a consumption of an element, or a user action that achieves a combination of elements to be associated with a user profile.

In numerous embodiments, an interactive application instruction is an instruction to an interactive controller and/or an interactive application to modify an interactive application state or modify one or more interactive application resources. In some embodiments, the interactive application instructions may be based upon one or more of a wager outcome and application environment variables. An interactive application instruction can modify any aspect of an interactive application, such as, but not limited to, an addition of a period of time available for a current interactive application user session for the interactive application of application credit earning interleaved wagering system, an addition of a period of time available for a future application credit earning interleaved wagering system interactive application user session or any other modification to the interactive application elements that can be utilized during interactive application use. In some embodiments, an interactive application instruction can modify a type of element whose consumption triggers a wagering event occurrence. In many embodiments, an interactive application instruction can modify a type of element whose consumption is not required in a wagering event occurrence.

In a number of embodiments, a user interface can be utilized that depicts a status of the interactive application in the application credit earning interleaved wagering system. A user interface can depict any aspect of an interactive application including, but not limited to, an illustration of application credit earning interleaved wagering system interactive application use advancement as a user uses the application credit earning interleaved wagering system.

In some embodiments, an application credit earning interleaved wagering system including an application controller operatively connected to a wager controller and operatively connected to an interactive controller may provide for interleaving entertainment content from an interactive application. The application credit earning interleaved wagering system provides for random wager outcomes in accordance with the wagering proposition that are independent of user skill while providing an interactive experience to the user that may be shaped by the user's skill.

In several embodiments, an application controller of an application credit earning interleaved wagering system may provide for a communications interface for asynchronous communications between a wager controller and an interactive application provided by an interactive controller, by operatively connecting the interactive controller, and thus the interactive controller's interactive application, with the wager controller. In some embodiments, asynchronous communications provided for by an application credit earning interleaved wagering system may reduce an amount of idle waiting time by an interactive controller of the application credit earning interleaved wagering system, thus increasing an amount of processing resources that the interactive controller may provide to an interactive application or other processes of the interactive controller. In many embodiments, asynchronous communications provided for by an application credit earning interleaved wagering system reduces an amount of idle waiting time by a wager controller, thus increasing an amount of processing resources that the wager controller may provide to execution of wagers to determine wager outcomes, and other processes provided by the wager controller. In some embodiments, a wager controller of an application credit earning interleaved wagering system may be operatively connected to a plurality of interactive controllers through one or more application controllers and the asynchronous communications provided for by the one or more application controllers allows the wager controller to operate more efficiently and provide wager outcomes to a larger number of interactive controllers than would be achievable without the one or more application controllers of the application credit earning interleaved wagering system.

In some embodiments, an application credit earning interleaved wagering system including an application controller operatively connected to a wager controller and operatively connected to an interactive controller may provide for simplified communication protocols for communications of the interactive controller as the interactive controller may communicate user interactions with an interactive application provided by the interactive controller to the application controller without regard to a nature of a wagering proposition to be interleaved with processes of the interactive application.

In various embodiments, an application credit earning interleaved wagering system including an application controller operatively connected to a wager controller and operatively connected to an interactive controller may provide for simplified communication protocols for communications of the wager controller as the wager controller may receive wager requests and communicate wager outcomes without regard to a nature of an interactive application provided by the interactive controller.

Multifaceted Application Resource Wagering Interleaved Systems

FIG. 1A is a diagram of a structure of an application credit earning interleaved wagering system in accordance with various embodiments of the invention. The application credit earning interleaved wagering system 128 includes an interactive controller 120, an application controller 112, and a wager controller 102. The interactive controller 120 is operatively connected to, and communicates with, the application controller 112. The application controller 112 is also operatively connected to, and communicates with, the wager controller 102.

In several embodiments, the wager controller 102 is a controller for providing one or more wagering propositions provided by the application credit earning interleaved wagering system 128 and executes wagers in accordance with the wagering propositions. Types of value of a wager can be one or more of several different types. Types of value of a wager can include, but are not limited to, a wager of an amount of Cr corresponding to a real currency or a virtual currency, a wager of an amount of AC earned by the player through use of an interactive application, a wager of an amount of elements of an interactive application, and a wager of an amount of objects used in an interactive application. A wager outcome determined for a wager in accordance with a wagering proposition can increase or decrease an amount of the type of value used in the wager, such as, but not limited to, increasing an amount of Cr for a wager of Cr. In various embodiments, a wager outcome determined for a wager in accordance with a wagering proposition can increase or decrease an amount of a type of value that is different than a type of value of the wager, such as, but not limited to, increasing an amount of an object of an interactive application for a wager of Cr.

In many embodiments, the wager controller 120 includes one or more pseudo random or random number generators (P/RNG) 106 for generating random results, one or more paytables 108 for determining a wager outcome from the random results, and one or more credit or value meters 110 for storing amounts of wagered and won credits.

The one or more P/RNG generators 106 execute processes that can generate random or pseudo random results. The one or more paytables 108 are tables that can be used in conjunction with the random or pseudo random results to determine a wager outcome including an amount of Cr, AC, elements or objects won as a function of application credit earning interleaved wagering system use. There can be one or more paytables 108 in the wager controller 102. The paytables 108 are used to implement one or more wagering propositions in conjunction with a random output of the random or pseudo random results.

In some embodiments, selection of a paytable to use to execute a wager can be based on factors including, but not limited to, interactive application progress a user has achieved through use of the interactive application, user identification, and eligibility of the user for bonus rounds.

In various embodiments, the interactive controller 120 provides an interactive application 143 and provides human input devices (HIDs) and output devices for interacting with the user 140. The interactive controller 120 provides for user interactions 142 with the interactive application 143 by receiving input from a user through the HIDs and providing outputs such as video, audio and/or other sensory output to the user using the output devices.

The interactive controller 120 is operatively connected to, and communicates with, the application controller 112. The interactive controller communicates application telemetry data 124 to the application controller 112 and receives application instructions and resources 136 from the application controller 112. Via the communication of application instructions and resources 136, the application controller 112 can communicate certain interactive application resources including control parameters to the interactive application 143 to affect the interactive application's execution by the interactive controller 120. In various embodiments, these interactive application control parameters can be based on a wager outcome of a wager that was triggered by an element in the interactive application being utilized or acted upon by the user.

In some embodiments, execution of the interactive application by the interactive controller 120 communicates user interactions with the interactive application to the application controller 112. The application telemetry data 124 includes, but is not limited to, the user's utilization of the elements in the interactive application.

In some embodiments, the interactive application 143 is a skill-based interactive game. In such embodiments, execution of the skill-based interactive game by the interactive controller 120 is based on the user's skillful play of the skill-based interactive game. The interactive controller 120 can also communicate user choices made in the skill-based interactive game to the application controller 112 included in the application telemetry data 124 such as, but not limited to, the user's utilization of the elements of the skill-based interactive game during the user's skillful play of the skill-based interactive game. In such an embodiment, the application controller is interfaced to the interactive controller 120 in order to allow the coupling of the skill-based interactive game to wagers made in accordance with a wagering proposition.

In some embodiments, the interactive controller 120 includes one or more sensors 138 that sense various aspects of the physical environment of the interactive controller 120. Examples of sensors include, but are not limited to: global positioning sensors (GPSs) for sensing communications from a GPS system to determine a position or location of the interactive controller; temperature sensors; accelerometers; pressure sensors; and the like. Sensor telemetry data 128 is communicated by the interactive controller to the application controller 112. The application controller 112 receives the sensor telemetry data 128 and uses the sensor telemetry data to make wager decisions.

In many embodiments, the interactive controller includes a wagering user interface 148 used to display wagering data to the user.

In various embodiments, an application control layer 131 resident in the interactive controller 120 provides an interface between the interactive controller 120 and the application controller 112. The application control layer 131 implements an interactive controller to application controller communication protocol employing a device-to-device communication protocol In some embodiments, the application controller 112 includes an interactive controller interface 160 to an interactive controller. The interactive controller interface 160 provides for the communication of data between the interactive controller and the application controller, including but not limited to wager telemetry data 146, application instructions and resources 136, application telemetry data 124, and sensor telemetry data 128.

In many embodiments, application controller 112 provides an interface between the interactive application 143 provided by the interactive controller 120 and a wagering proposition provided by the wager controller 102.

In various embodiments, the application controller 112 includes a wager controller interface 162 to a wager controller. The wager controller interface 162 provides for communication of data between the application controller 112 and the wager controller, including but not limited to wager outcome data 130 and wager execution instructions 129.

In some embodiments, the application controller 112 includes a user management and session controller interface 164 to a user management and session controller. The user management and session controller interface 164 provides for communication of data between the application controller 112 and the user management and session controller, including but not limited to user session control data 154 and user session telemetry data 152.

The application controller 112 includes a rule-based decision engine 122 that receives telemetry data, such as application telemetry data 124 and sensor telemetry data 128, from the interactive controller 120. The rule-based decision engine 122 uses the telemetry data, along with trigger logic 126 to generate wager execution instructions 129 that are used by the application controller 112 to instruct the wager controller 120 to execute a wager. The wager execution data is communicated by the application controller 112 to the wager controller 102. The wager controller 102 receives the wager execution instructions 129 and executes a wager in accordance with the wager execution instructions.

In some embodiments, the application telemetry data 124 includes, but is not limited to, application environment variables that indicate the state of the interactive application 143 being used by a user 140, interactive controller data indicating the state of the interactive controller, and user actions and interactions 142 between the user and the interactive application 143 provided by the interactive controller 120. The wager execution instructions 129 may include, but are not limited to, an amount and type of the wager, a trigger of the wager, and a selection of a paytable 108 to be used when executing the wager.

In some embodiments, the rule-based decision engine 122 also receives wager outcome data 130 from the wager controller 102. The decision engine 122 uses the wager outcome data 130, in conjunction with the telemetry data and application logic 132 to generate application decisions 134 communicated to an application resource generator 138. The application resource generator 138 receives the application decisions and uses the application decisions to generate application instructions and application resources 136 to be communicated to the interactive application 143.

In some embodiments, the wager outcome data 130 includes game state data about execution of a gambling game that underlies a wagering proposition, including but not limited to a final state, intermediate state and/or beginning state of the gambling game. For example, in a gambling game that is a slot math-based game, the final state of the gambling game may be reel positions, in a gambling game that is a roulette wheel-based game, the final state may be a pocket where a ball may have come to rest, in a gambling game that is a card-based game, the beginning, intermediate and final states may represent a play of cards, etc.

In many embodiments, the application controller 112 includes a pseudo random or random result generator used to generate random results that are communicated to the application resource generator 138. The application resource generator 138 uses the random results to generate application instructions and application resources 136 used by the application controller 112 to instruct the interactive controller 120.

In various embodiments, the rule-based decision engine 122 also determines an amount of AC to award to the user 140 based at least in part on the user's use of the interactive application of the application credit earning interleaved wagering system as determined from the application telemetry data 124. In some embodiments, wager outcome data 130 may also be used to determine the amount of AC that should be awarded to the user.

In numerous embodiments, the interactive application is a skill-based interactive game and the AC is awarded to the user for the user's skillful play of the skill-based interactive game.

In some embodiments, the application decisions 134 and wager outcome data 130 are communicated to a wagering user interface generator 144. The wagering user interface generator 144 receives the application decisions 134 and wager outcome data 130 and generates wager telemetry instructions 146 used by the application controller 112 to instruct the interactive controller to generate a wagering user interface 148 describing the state of wagering and credit accumulation and loss for the application credit earning interleaved wagering system. In some embodiments, the wager telemetry data 146 may include, but is not limited to, amounts of AC and elements earned, lost or accumulated by the user through use of the interactive application as determined from the application decisions, and Cr amounts won, lost or accumulated as determined from the wager outcome data 130 and the one or more meters 110.

In some embodiments, the wager outcome data 130 also includes data about one or more game states of a gambling game executed in accordance with a wagering proposition by the wager controller 102. In various such embodiments, the wagering user interface generator 144 generates a gambling game process display and/or gambling game state display using the one or more game states of the gambling game. The gambling game process display and/or gambling game state display is included in the wager telemetry data 146 that is communicated to the interactive controller 120. The gambling game process display and/or a gambling game state display is displayed by the wagering user interface 148 to the user 140. In other such embodiments, the one or more game states of the gambling game are communicated to the interactive controller 120 and the interactive controller 120 is instructed to generate the gambling game process display and/or gambling game state display of the wagering user interface 148 using the one or more game states of the gambling game for display to the user 140.

The application controller 112 can further operatively connect to the wager controller 102 to determine an amount of credit or elements available and other wagering metrics of a wagering proposition. Thus, the application controller 112 may potentially affect an amount of Cr in play for participation in the wagering events of a gambling game provided by the wager controller 102 in some embodiments. The application controller 112 may additionally include various audit logs and activity meters. In some embodiments, the application controller 112 can also couple to a centralized server for exchanging various data related to the user and the activities of the user during game play of an application credit earning interleaved wagering system.

In many embodiments, one or more users can be engaged in using the interactive application executed by the interactive controller 120. In various embodiments, an application credit earning interleaved wagering system can include an interactive application that provides a skill-based interactive game that includes head-to-head play between a single user and a computing device, between two or more users against one another, or multiple users playing against a computer device and/or each other. In some embodiments, the interactive application can be a skill-based interactive game where the user is not skillfully playing against the computer or any other user such as skill-based interactive games where the user is effectively skillfully playing against himself or herself.

In some embodiments, the operation of the application controller 112 does not affect the provision of a wagering proposition by the wager controller 102 except for user choice parameters that are allowable in accordance with the wagering proposition. Examples of user choice parameters include, but are not limited to: wager terms such as but not limited to a wager amount; speed of game play (for example, by pressing a button or pulling a handle of a slot machine); and/or agreement to wager into a bonus round.

In various embodiments, wager outcome data 130 communicated from the wager controller 102 can also be used to convey a status operation of the wager controller 102.

In a number of embodiments, communication of the wager execution instructions 129 between the wager controller 102 and the application controller 112 can further be used to communicate various wagering control factors that the wager controller 102 uses as input. Examples of wagering control factors include, but are not limited to, an amount of Cr, AC, elements, or objects consumed per wagering event, and/or the user's election to enter a jackpot round.

In some embodiments, the application controller 112 utilizes the wagering user interface 148 to communicate certain interactive application data to the user, including but not limited to, club points, user status, control of the selection of choices, and messages which a user can find useful in order to adjust the interactive application experience or understand the wagering status of the user in accordance with the wagering proposition in the wager controller 102.

In some embodiments, the application controller 112 utilizes the wagering user interface 148 to communicate aspects of a wagering proposition to the user including, but not limited to, odds of certain wager outcomes, amount of Cr, AC, elements, or objects in play, and amounts of Cr, AC, elements, or objects available.

In a number of embodiments, the wager controller 102 can accept wager proposition factors including, but not limited to, modifications in the amount of Cr, AC, elements, or objects wagered on each individual wagering event, a number of wagering events per minute the wager controller 102 can resolve, entrance into a bonus round, and other factors. An example of a varying wager amount that the user can choose can include, but is not limited to, using a more difficult interactive application level associated with an amount of a wager. These factors can increase or decrease an amount wagered per individual wagering proposition in the same manner that a standard slot machine player can decide to wager more or less credits for each pull of the handle. In several embodiments, the wager controller 102 can communicate a number of factors back and forth to the application controller 112, via an interface, such that an increase/decrease in a wagered amount can be related to the change in user profile of the user in the interactive application. In this manner, a user can control a wager amount per wagering event in accordance with the wagering proposition with the change mapping to a parameter or component that is applicable to the interactive application experience.

In some embodiments, a user management and session controller 150 is used to authorize an application credit earning interleaved wagering system user session. The user management and session controller receives game user session data 152, that may include, but is not limited to, user, interactive controller, application controller and wager controller data from the application controller 112. The user management and session controller 150 uses the user, interactive controller, application controller and wager controller data to regulate an application credit earning interleaved wagering system user session. In some embodiments, the user management and session controller 150 may also assert control of an application credit earning interleaved wagering system game user session 154. Such control may include, but is not limited to, ending an application credit earning interleaved wagering system game user session, initiating wagering in an application credit earning interleaved wagering system game user session, ending wagering in an application credit earning interleaved wagering system game user session but not ending a user's play of the interactive application portion of the application credit earning interleaved wagering system, and changing from real credit wagering in an application credit earning interleaved wagering system to virtual credit wagering, or vice versa.

In many embodiments, the user management and session controller 150 manages user profiles for a plurality of users. The user management and session controller 150 stores and manages data about users in order to provide authentication and authorization of users of the application credit earning interleaved wagering system 128. In some embodiments, the user management and session controller 150 also manages geolocation information to ensure that the application credit earning interleaved wagering system i128 is only used by users in jurisdictions were gaming is approved. In various embodiments, the user management and session controller 150 stores application credits that are associated with the user's use of the interactive application of the application credit earning interleaved wagering system 128.

In various embodiments, the application controller operates as an interface between the interactive controller and the wager controller. By virtue of this construction, the wager controller is isolated from the interactive controller allowing the interactive controller to operate in an unregulated environment will allowing the wager controller to operate in a regulated environment.

In some embodiments, a single wager controller may provide services to two or more interactive controllers and/or two or more application controllers, thus allowing an application credit earning interleaved wagering system to operate over a large range of scaling.

In various embodiments, multiple types of interactive controllers using different operating systems may be interfaced to a single type of application controller and/or wager controller without requiring customization of the application controller and/or the wager controller.

In many embodiments, an interactive controller may be provided as a user device under control of a user while maintaining the wager controller in an environment under the control of a regulated operator of wagering equipment.

In several embodiments, data communicated between the controllers may be encrypted to increase security of the application credit earning interleaved wagering system.

In some embodiments, the application controller isolates trigger logic and application logic as unregulated logic from a regulated wager controller, thus allowing errors in the application logic and/or trigger logic to be corrected, new application logic and/or trigger logic to be used, or modifications to be made to the application logic and/or trigger logic without a need for regulatory approval.

In various embodiments, an interactive application may require extensive processing resources from an interactive controller leaving few processing resources for the functions performed by an application controller and/or a wager controller. By virtue of the architecture described herein, processing loads may be distributed across multiple devices such that operations of the interactive controller may be dedicated to the interactive application and the processes of the application controller and/or wager controller are not burdened by the requirements of the interactive application.

In many embodiments, an application credit earning interleaved wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like.

In some embodiments, one or more components of an application credit earning interleaved wagering system are distributed in close proximity to each other and communicate using a local area network and/or a communication bus. In several embodiments, an interactive controller and an application controller of an application credit earning interleaved wagering system are in a common location and communicate with an external wager controller. In some embodiments, an application controller and a wager controller of an application credit earning interleaved wagering system are in a common location and communicate with an external interactive controller. In many embodiments, an interactive controller, an application controller, and a wager controller of an application credit earning interleaved wagering system are located in a common location. In some embodiments, a user management and session controller is located in a common location with an application controller and/or a wager controller.

In various embodiments, These multiple devices can be constructed from or configured using a single server or a plurality of servers such that an application credit earning interleaved wagering system is executed as a system in a virtualized space such as, but not limited to, where a wager controller and an application controller are large scale centralized servers in the cloud operatively connected to widely distributed interactive controllers via a wide area network such as the Internet or a local area network. In such embodiments, the components of an application credit earning interleaved wagering system may communicate using a networking protocol or other type of device-to-device communications protocol.

In many embodiments, a centralized wager controller is operatively connected to, and communicates with, one or more application controllers using a communication link. The centralized wager controller can generate wager outcomes for wagers in accordance with one or more wagering propositions. The centralized wager controller can execute a number of simultaneous or pseudo-simultaneous wagers in order to generate wager outcomes for a variety of wagering propositions that one or more distributed application credit earning interleaved wagering systems can use.

In several embodiments, a centralized application controller is operatively connected to one or more interactive controllers and one or more wager controllers using a communication link. The centralized application controller can perform the functionality of an application controller across various application credit earning interleaved wagering systems.

In a variety of embodiments, management of user profile data can be performed by a user management and session controller operatively connected to, and communicating with, one or more application controllers, wager controllers and interactive controllers using a communication link. A user management and session controller can manage data related to a user profile. The managed data in the user profile may include, but is not limited to, data concerning controlled entities (characters) in interactive application use, user performance metrics for a type or class of interactive application, interactive application elements acquired by a user; Cr and AC associated with a particular user, and tournament reservations.

Although a user management and session controller is discussed as being separate from an application controller server, a centralized application controller server may also perform the functions of a user management and session controller in some embodiments.

In numerous embodiments, an interactive application server provides a host for managing head-to-head play operating over a network of interactive controllers connected to the interactive application server using a communication link. The interactive application server provides an environment where users can compete directly with one another and interact with other users.

Processing devices connected using a communication link to construct application credit earning interleaved wagering systems in accordance with many embodiments of the invention can communicate with each other to provide services utilized by an application credit earning interleaved wagering system. In several embodiments, a wager controller can communicate with an application controller using a communication link. In some embodiments, the wager controller can communicate with an application controller to communicate any type of data as appropriate for a specific application. Examples of the data that may be communicated include, but are not limited to, data used to configure the various simultaneous or pseudo simultaneous wager controllers executing in parallel within the wager controller to accomplish application credit earning interleaved wagering system functionalities; data used to determine metrics of wager controller performance such as wagers run and/or wager outcomes for tracking system performance; data used to perform audits and/or provide operator reports; and data used to request the results of a wager outcome for use in one or more function(s) operating within the application controller such as, but not limited to, automatic drawings for prizes that are a function of interactive controller performance.

In several embodiments, an application controller can communicate with an interactive application server using a communication link when the interactive application server is also communicating with one or more interactive controllers using a communication link. An application controller can communicate with an interactive application server to communicate any type of data as appropriate for a specific application. The data that may be communicated between an application controller and an interactive application server includes, but is not limited to, the data for management of an interactive application server by an application controller server during an application credit earning interleaved wagering system tournament. In an example embodiment, an application controller may not be aware of the relationship of the application controller to the rest of a tournament since the actual tournament play may be managed by the interactive application server. Therefore, management of an application credit earning interleaved wagering system can include, but is not limited to tasks including, but not limited to, conducting tournaments according to system programming that can be coordinated by an operator of the application credit earning interleaved wagering system; allowing entry of a particular user into a tournament; communicating the number of users in a tournament; and the status of the tournament (such as, but not limited to the amount of surviving users, the status of each surviving user within the game, and time remaining on the tournament); communicating the performance of users within the tournament; communicating the scores of the various users in the tournament; and providing a synchronizing link to connect the application controllers in a tournament with their respective interactive controllers.

In several embodiments, an application controller can communicate with a user management and session controller using a communication link. An application controller can communicate with a user management and session controller to communicate any type of data as appropriate for a specific application. Examples of data communicated between an application controller and a user management and session controller include, but are not limited to, data for configuring tournaments according to system programming conducted by an operator of an application credit earning interleaved wagering system; data for exchange of data used to link a user's user profile to an ability to participate in various forms of application credit earning interleaved wagering system use (such as but not limited to the difficulty of play set by the application controller server for an interactive application that is a skill-based interactive game); data for determining a user's ability to participate in a tournament as a function of a user's characteristics (such as but not limited to a user's prowess or other metrics used for tournament screening); data for configuring application controller and interactive controller performance to suit preferences of a user on a particular application credit earning interleaved wagering system; and data for determining a user's use and wagering performance for the purposes of marketing intelligence; and data for logging secondary drawing awards, tournament prizes, Cr and/or AC into the user profile.

In many embodiments, an application credit earning interleaved wagering system can be distributed across one or more processing devices, with the actual location of where various process are executed being located either on an end device (user management and session controller, wager controller, application controller, interactive controller), on servers (user management and session controller, wager controller, application controller, or interactive application server), or a combination of both end devices and servers. In a number of embodiments, certain functions of a wager controller, application controller, and/or interactive application server can operate on a local wager controller, local application controller and/or local interactive controller used to construct an application credit earning interleaved wagering system being provided locally on a device. In some embodiments, a controller or server can be part of a server system including multiple servers, where applications can be run on one or more physical devices. Similarly, in particular embodiments, multiple servers can be combined on a single physical device.

In many embodiments, an application credit earning interleaved wagering system can be distributed across one or more processing devices that are in close proximity to each other, such as a common enclosure. In such an embodiment, the one or more processing devices can be operatively connected using communication links that incorporate an interdevice communication protocol over a serial or parallel physical link.

Figure 1B:
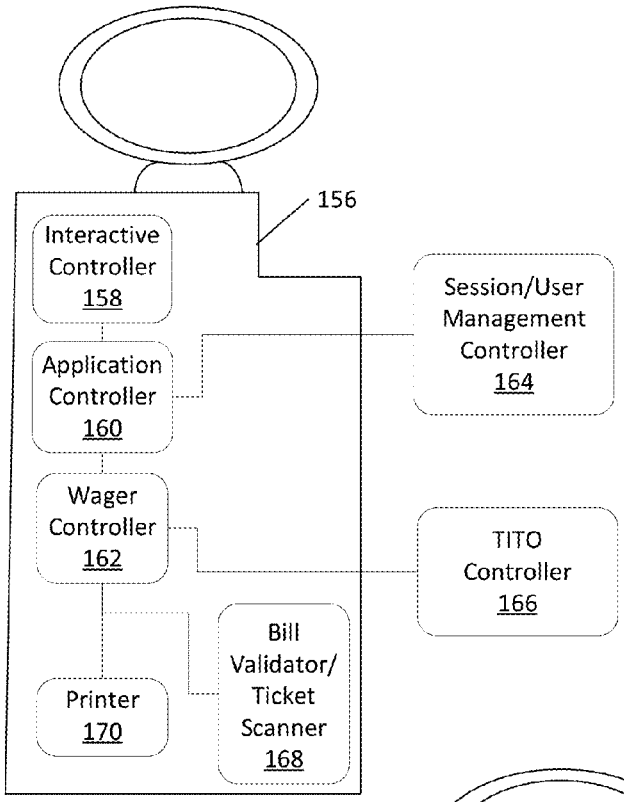
FIG. 1B is a diagram of a land-based configuration of an application credit earning interleaved wagering system in accordance with various embodiments of the invention.
Figure 1C:
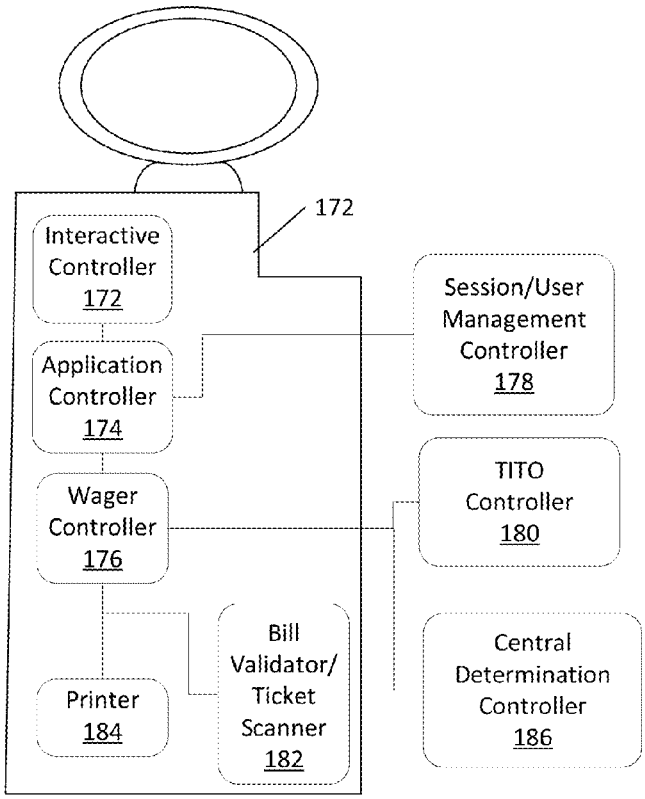
FIG. 1C is another diagram of a land-based configuration of an application credit earning interleaved wagering system in accordance with various embodiments of the invention.

FIG. 1B is a diagram of a land-based configuration of an application credit earning interleaved wagering system in accordance with various embodiments of the invention. Land-based configurations are suitable for deployment in a gaming establishment. A land-based configuration of an application credit earning interleaved wagering system 156 includes an interactive controller 158, an application controller 160 and a wager controller 162 housed in a common enclosure. The application controller 160 is operatively connected to an external session/user management controller 164. The wager controller 162 is operatively connected to a ticket-in-ticket-out (TITO) controller 166 or other type of credit controller. The wager controller 162 communicates with the TITO controller 166 to obtain amounts of credits used for wagering. In operation, the wager controller 162 uses a bill validator/ticket scanner 168 to scan a TITO ticket having indicia of credit account data of a credit account of the TITO controller 166. The wager controller 162 communicates the credit account data to the TITO controller 166. The TITO controller 166 uses the credit account data to determine an amount of credits to transfer to the wager controller 162. The TITO controller 166 communicates the amount of credits to the wager controller 162. The wager controller 162 credits the one or more credit meters with the amount of credits so that the credits can be used when a user makes wagers using the application credit earning interleaved wagering system 156. In addition, the wager controller 162 can use the TITO controller 166 along with a ticket printer 170 to generate a TITO ticket for a user. In operation, the wager controller 162 communicates an amount of credits for a credit account on the TITO controller 166. The TITO controller 166 receives the amount of credits and creates the credit account and credits the credit account with the amount of credits. The TITO controller 166 generates credit account data for the credit account and communicates the credit account data to the wager controller 162. The wager controller 162 uses the ticket printer 170 to print indicia of the credit account data onto a TITO ticket.

FIG. 1B is a diagram of another land-based configuration of an application credit earning interleaved wagering system in accordance with various embodiments of the invention. A land-based configuration of an application credit earning interleaved wagering system 172 includes an interactive controller 172, an application controller 174 and a wager controller 176 housed in a common enclosure. The application controller 174 is operatively connected to an external session/user management controller 178. The wager controller 176 is operatively connected to a ticket-in-ticket-out (TITO) controller 180 or other type of credit controller. The wager controller 176 communicates with the TITO controller 180 to obtain amounts of credits used for wagering. In operation, the wager controller 176 uses a bill validator/ticket scanner 182 to scan a TITO ticket having indicia of credit account data of a credit account of the TITO controller 180. The wager controller 176 communicates the credit account data to the TITO controller 180. The TITO controller 180 uses the credit account data to determine an amount of credits to transfer to the wager controller 176. The TITO controller 180 communicates the amount of credits to the wager controller 176. The wager controller 176 receives the amount of credits and credits the one or more credit meters with the amount of credits so that the credits can be used when a user makes wagers using the application credit earning interleaved wagering system 172. In addition, the wager controller 176 can use the TITO controller 180 along with a ticket printer 184 to generate a TITO ticket for a user. In operation, the wager controller 176 communicates an amount of credits for a credit account on the TITO controller 180. The TITO controller 180 receives the amount of credits and creates the credit account and credits the credit account with the amount of credits. The TITO controller 180 generates credit account data for the credit account and communicates the credit account data to the wager controller 176. The wager controller 176 uses the ticket printer 184 to print indicia of the credit account data onto a TITO ticket.

The wager controller 176 is operatively connected to a central determination controller 186. In operation, when the wager controller 176 needs to determine a wager outcome, the wager controller communicates a request to the central determination controller 186 for the wager outcome. The central determination controller 186 receives the wager outcome request and generates a wager outcome in response to the wager request. The central determination controller 186 communicates the wager outcome to the wager controller 176. The wager controller 176 receives the wager outcome and utilizes the wager outcome as described herein. In some embodiments, the wager outcome is drawn from a pool of pre-determined wager outcomes. In some embodiments, the wager outcome is a pseudo random result or random result that is utilized by the wager controller along with paytables to determine a wager outcome as described herein.

Figure 1D:
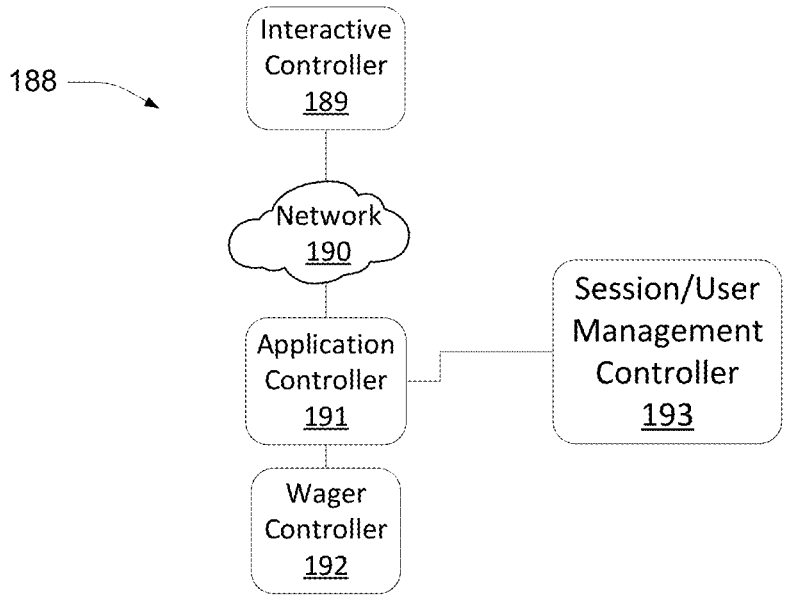
FIG. 1D is a diagram of an interactive configuration of an application credit earning interleaved wagering system in accordance with various embodiments of the invention.

FIG. 1D is a diagram of an interactive configuration of an application credit earning interleaved wagering system in accordance with various embodiments of the invention. An interactive configuration of an application credit earning interleaved wagering system is useful for deployment over a wide area network such as an internet. An interactive configuration of an application credit earning interleaved wagering system 188 includes an interactive controller 189 operatively connected by a network 190 to an application controller 191, and a wager controller 192. The application controller 191 is operatively connected to a session/user management controller 193.

Figure 1E:
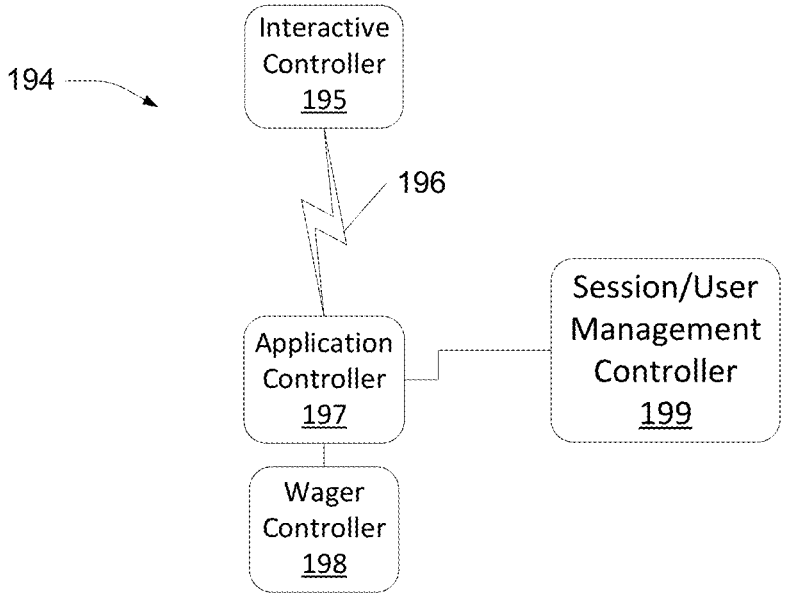
FIG. 1E is a diagram of a mobile configuration of an application credit earning interleaved wagering system in accordance with various embodiments of the invention.

FIG. 1E is a diagram of a mobile configuration of an application credit earning interleaved wagering system in accordance with various embodiments of the invention. A mobile configuration of an application credit earning interleaved wagering system is useful for deployment over wireless communication network, such as a wireless local area network or a wireless telecommunications network. An interactive configuration of an application credit earning interleaved wagering system 194 includes an interactive controller 195 operatively connected by a wireless network 196 to an application controller 197, and a wager controller 198. The application controller 197 is also operatively connected to a session/user management controller 199.

FIGS. 2A, 2B, 2C, and 2D are illustrations of interactive controllers of an application credit earning interleaved wagering system in accordance with various embodiments of the invention. An interactive controller, such as interactive controller 120 of FIG. 1A, may be constructed from or configured using one or more processing devices configured to perform the operations of the interactive controller. An interactive controller in an application credit earning interleaved wagering system may be constructed from or configured using any processing device having sufficient processing and communication capabilities that may be configured to perform the processes of an interactive controller in accordance with various embodiments of the invention. In some embodiments, the construction or configuration of the interactive controller may be achieved through the use of an application control layer, such as application control layer 131 of FIG. 1A, and/or through the use of an interactive application, such as interactive application 143 of FIG. 1A.

Figure 2A:
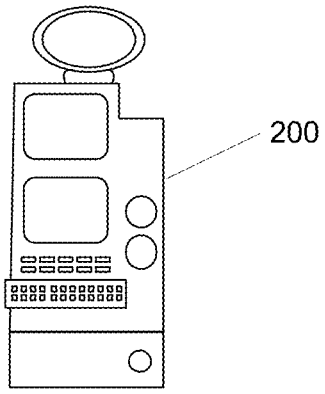
FIGS. 2A, 2B, 2C, and 2D are illustrations of interactive controllers of an application credit earning interleaved wagering system in accordance with various embodiments of the invention.

In some embodiments, an interactive controller may be constructed from or configured using an electronic gaming machine 200 as shown in FIG. 2A. The electronic gaming machine 200 may be physically located in various types of gaming establishments.

Figure 2B:
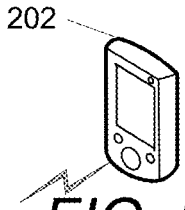

In many embodiments, an interactive controller may be constructed from or configured using a portable device 202 as shown in FIG. 2B. The portable device 202 is a device that may wirelessly connect to a network. Examples of portable devices include, but are not limited to, a tablet computer, a personal digital assistant, and a smartphone.

Figure 2C:
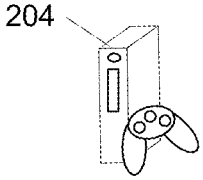

In some embodiments, an interactive controller may be constructed from or configured using a gaming console 204 as shown in FIG. 2C.

Figure 2D:
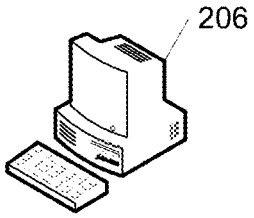

In various embodiments, an interactive controller may be constructed from or configured using a personal computer 206 as shown in FIG. 2D.

In some embodiments, a device, such as the devices of FIGS. 2A, 2B, 2C, and 2D, may be used to construct a complete application credit earning interleaved wagering system and may be operatively connected using a communication link to a session and/or user management controller, such as session and/or user management controller 150 of FIG. 1A.

Figure 3A:
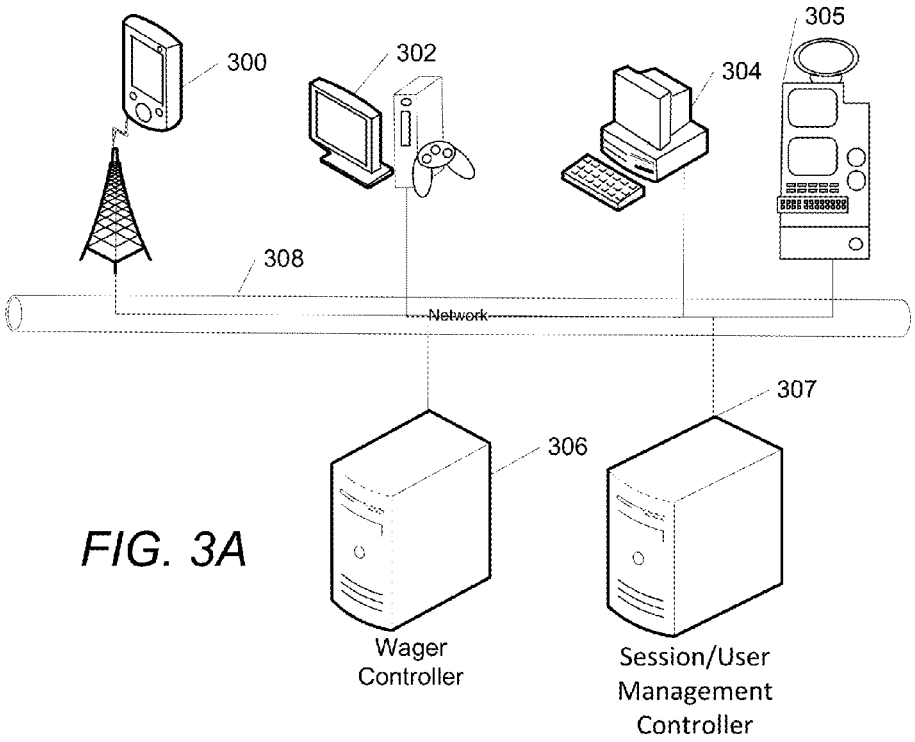
FIGS. 3A, 3B and 3C are diagrams of distributed application credit earning interleaved wagering systems in accordance with various embodiments of the invention.
Figure 3B:
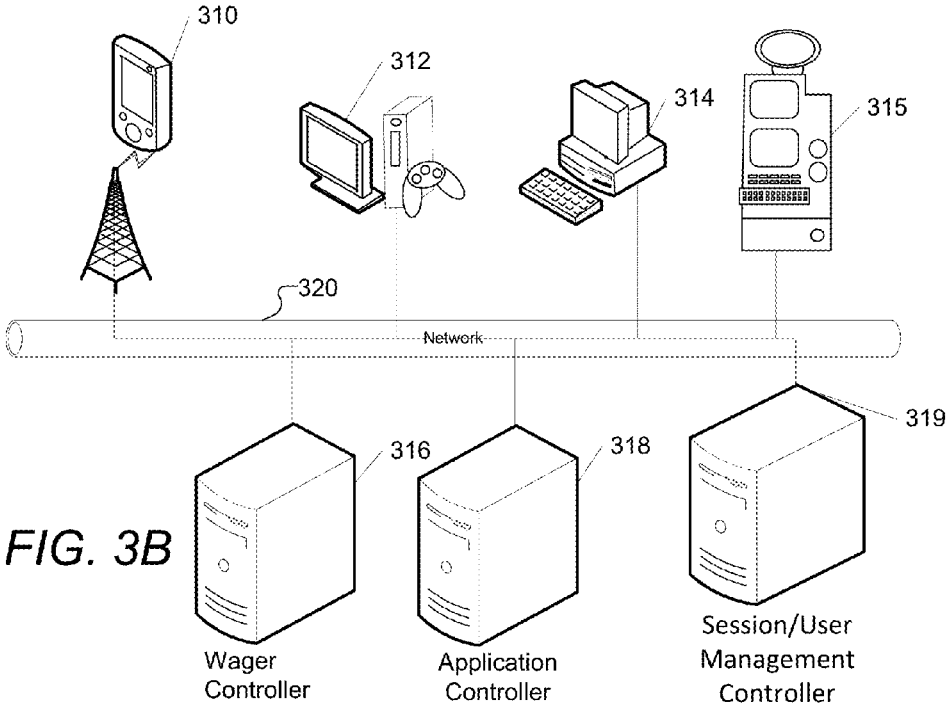
Figure 3C:
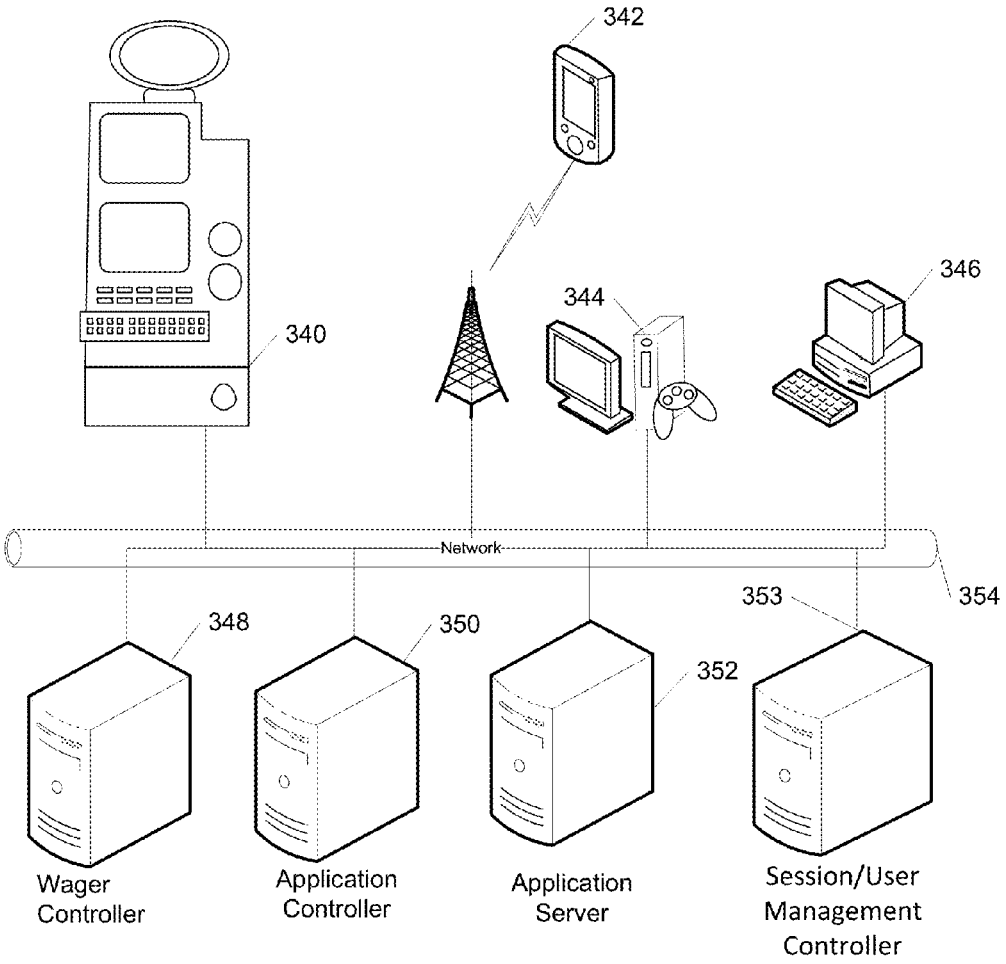

Some application credit earning interleaved wagering systems in accordance with many embodiments of the invention can be distributed across a plurality of devices in various configurations. FIGS. 3A, 3B and 3C are diagrams of distributed application credit earning interleaved wagering systems in accordance with various embodiments of the invention. Turning now to FIG. 3A, one or more interactive controllers of a distributed application credit earning interleaved wagering system, such as but not limited to, a mobile or wireless device 300, a gaming console 302, a personal computer 304, and an electronic gaming machine 305, are operatively connected with a wager controller 306 of a distributed application credit earning interleaved wagering system using a communication link 308. Communication link 308 is a communications link that allows processing systems to communicate with each other and to share data. Examples of the communication link 308 can include, but are not limited to: a wired or wireless interdevice communication link, a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, one or more processes of an interactive controller and an application controller as described herein are executed on the individual interactive controllers 300, 302, 304 and 305 while one or more processes of a wager controller as described herein can be executed by the wager controller 306.

In many embodiments, a distributed application credit earning interleaved wagering system and may be operatively connected using a communication link to a session and/or user management controller 307, that performs the processes of a session and/or user management controller as described herein.

A distributed application credit earning interleaved wagering system in accordance with another embodiment of the invention is illustrated in FIG. 3B. As illustrated, one or more interactive controllers of a distributed application credit earning interleaved wagering system, such as but not limited to, a mobile or wireless device 310, a gaming console 312, a personal computer 314, and an electronic gaming machine 315, are operatively connected with a wager controller server 316 and an application controller 318 over a communication link 320. Communication link 320 is a communication link that allows processing systems to communicate and share data. Examples of the communication link 320 can include, but are not limited to: a wired or wireless interdevice communication link, a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, the processes of an interactive controller as described herein are executed on the individual interactive controllers 310, 312, 314 and 315. One or more processes of a wager controller as described herein are executed by the wager controller 316, and one or more processes of an application controller as described herein are executed by the application controller 318.

In many embodiments, a distributed application credit earning interleaved wagering system and may be operatively connected using a communication link to a session and/or user management controller 319, that performs the processes of a session and/or user management controller as described herein.

A distributed application credit earning interleaved wagering systems in accordance with still another embodiment of the invention is illustrated in FIG. 3C. As illustrated, one or more interactive controllers of a distributed application credit earning interleaved wagering system, such as but not limited to, a mobile device 342, a gaming console 344, a personal computer 346, and an electronic gaming machine 340 are operatively connected with a wager controller 348 and an application controller 350, and an interactive application server 352 using a communication link 354. Communication link 354 is a communications link that allows processing systems to communicate and to share data. Examples of the communication link 354 can include, but are not limited to: a wired or wireless interdevice communication link, a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, one or more processes of a display and user interface of an interactive controller as described herein are executed on the individual interactive controllers 340, 342, 344 and 346. One or more processes of a wager controller as described herein can be executed by the wager controller server 348. One or more processes of an application controller as described herein can be executed by the application controller server 350 and one or more processes of an interactive controller excluding the display and user interfaces can be executed by the interactive application server 352.

In many embodiments, a distributed application credit earning interleaved wagering system and may be operatively connected using a communication link to a session and/or user management controller 353, that performs the processes of a session and/or user management controller as described herein.

In various embodiments, a user management and session controller may be operatively connected to components of an application credit earning interleaved wagering system using a communication link. In other embodiments, a number of other peripheral systems, such as a user management system, a gaming establishment management system, a regulatory system, and/or hosting servers are also operatively connected with the application credit earning interleaved wagering systems using a communication link. Also, other servers can reside outside the bounds of a network within a firewall of the operator to provide additional services for network connected application credit earning interleaved wagering systems.

Although various distributed application credit earning interleaved wagering systems are described herein, application credit earning interleaved wagering systems can be distributed in any configuration as appropriate to the specification of a specific application in accordance with embodiments of the invention. In some embodiments, components of a distributed application credit earning interleaved wagering system, such as an application controller, wager controller, interactive controller, or other servers that perform services for an application controller, wager controller and/or interactive controller, can be distributed in different configurations for a specific distributed application credit earning interleaved wagering system application.

Figure 4A:
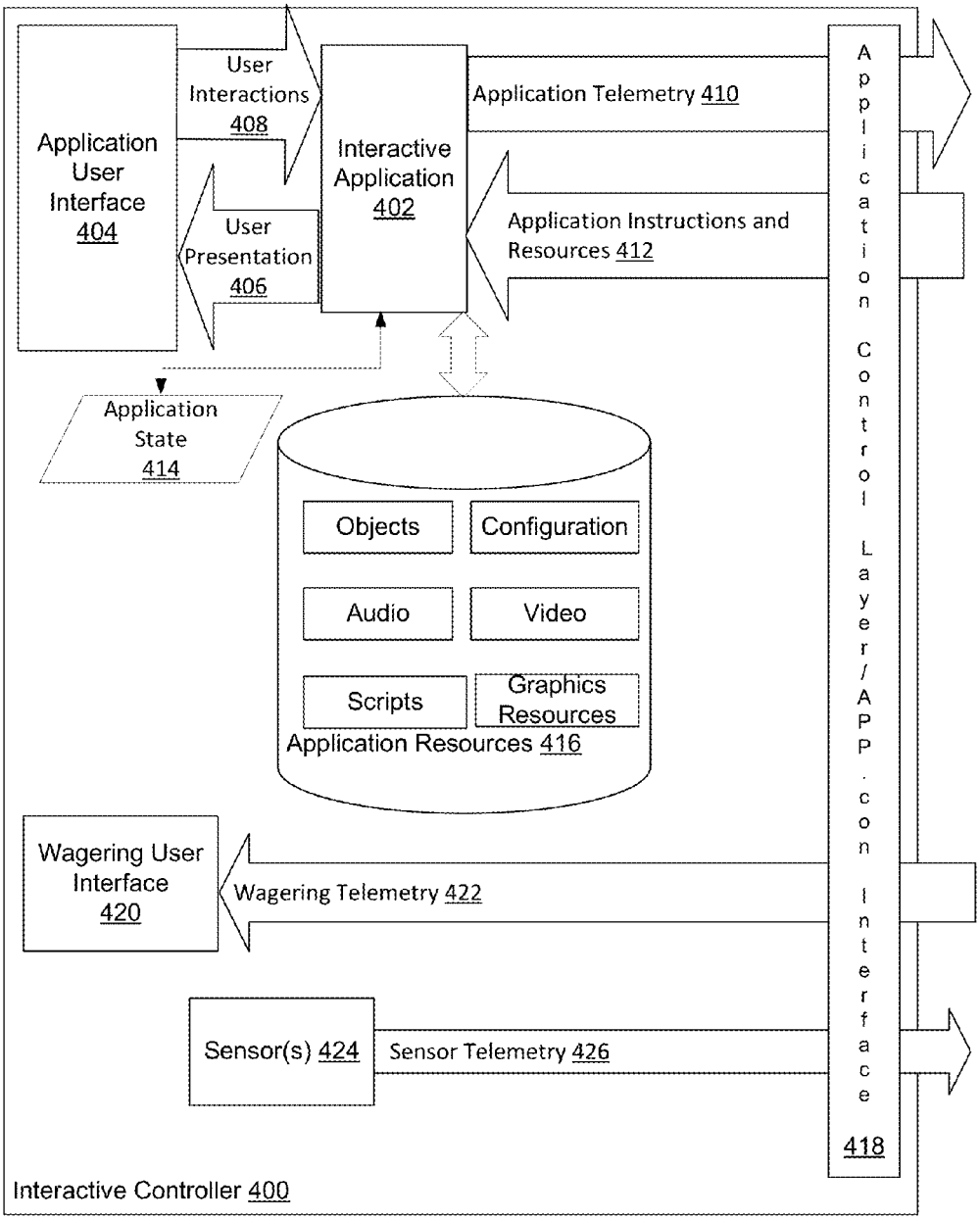
FIGS. 4A and 4B are diagrams of a structure of an interactive controller of an application credit earning interleaved wagering system in accordance with various embodiments of the invention.
Figure 4B:
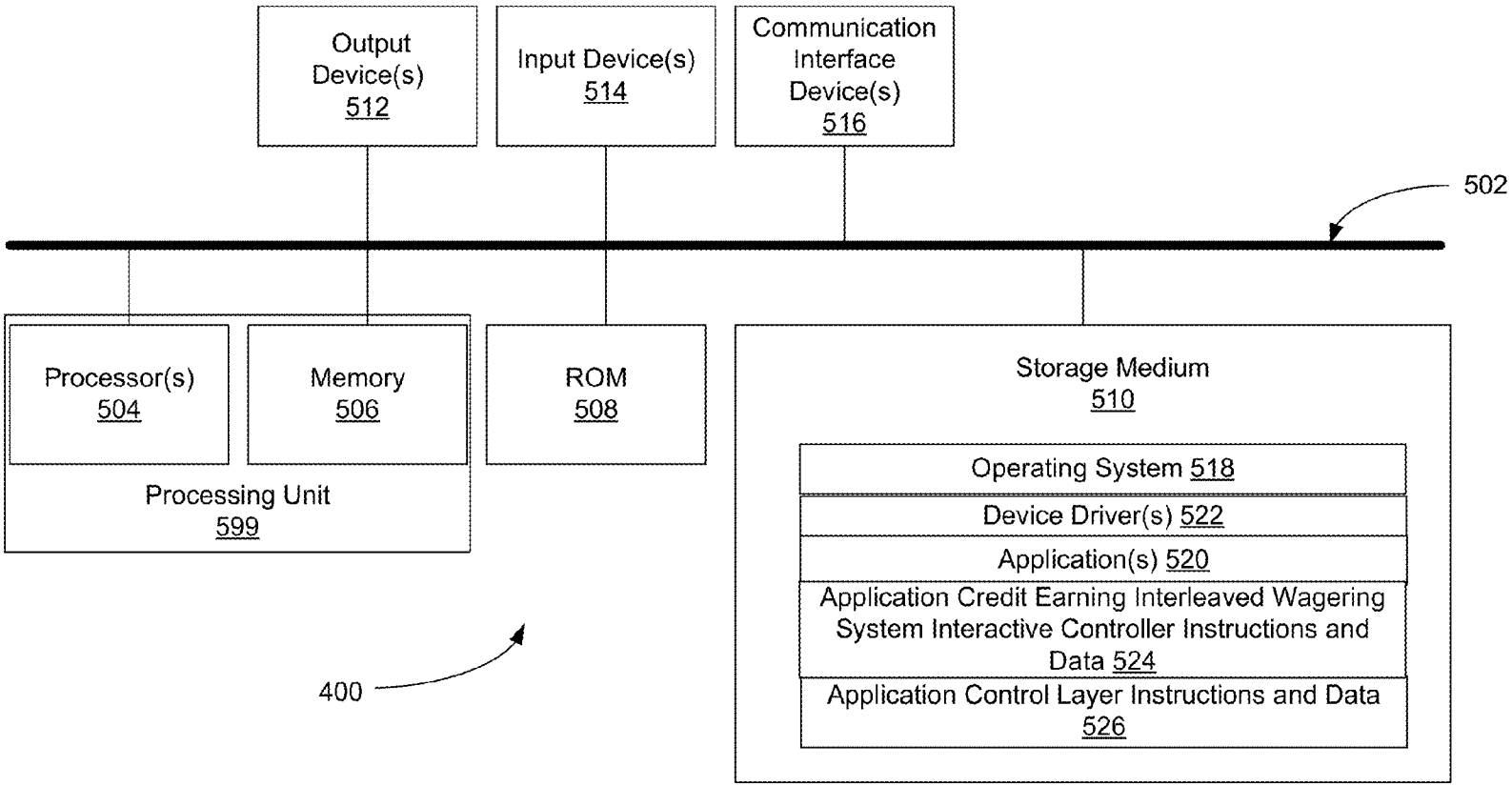

FIGS. 4A and 4B are diagrams of a structure of an interactive controller of an application credit earning interleaved wagering system in accordance with various embodiments of the invention. An interactive controller may be constructed from or configured using one or more processing devices configured to perform the operations of the interactive controller. In many embodiments, an interactive controller can be constructed from or configured using various types of processing devices including, but not limited to, a mobile device such as a smartphone or the like, a personal digital assistant, a wireless device such as a tablet computer or the like, an electronic gaming machine, a personal computer, a gaming console, a set-top box, a computing device, a controller, or the like.

Referring now to FIG. 4A, an interactive controller 400, suitable for use as interactive controller 120 of FIG. 1A, provides an execution environment for an interactive application 402 of an application credit earning interleaved wagering system. In several embodiments, an interactive controller 400 of an application credit earning interleaved wagering system provides an interactive application 402 that generates an application user interface 404 for interaction with by a user. The interactive application 402 generates a user presentation 406 that is presented to the user through the application user interface 404. The user presentation 406 may include audio features, visual features or tactile features, or any combination of these features. The application user interface 404 further includes one or more human input devices (HIDs) interfaces that communicate with one or more HIDs (e.g., the input devices 514 of FIG. 4*b*) that the user can use to interact with the application credit earning interleaved wagering system. The user's interactions 408 are included by the interactive application 402 in application telemetry data 410 that is communicated by interactive controller 400 to various other components of an application credit earning interleaved wagering system as described herein. The interactive application 402 receives application instructions and resources 412 communicated from various other components of an application credit earning interleaved wagering system as described herein.

In some embodiments, various components of the interactive application 402 can read data from an application state 414 in order to provide one or more features of the interactive application. In various embodiments, components of the interactive application 402 can include, but are not limited to, a physics engine, a rules engine, and/or a graphics engine. The physics engine is used to simulate physical interactions between virtual objects in the interactive application 402. The rules engine implements the rules of the interactive application and a P/RNG that may be used for influencing or determining certain variables and/or outcomes to provide a randomizing influence on the operations of the interactive application. The graphics engine is used to generate a visual representation of the interactive application state to the user. Furthermore, the components may also include an audio engine to generate audio outputs for the user interface.

During operation, the interactive application reads and writes application resources 416 stored on a data store of the interactive controller host. The application resources 416 may include objects having graphics and/or control logic used to provide application environment objects of the interactive application. In various embodiments, the resources may also include, but are not limited to, video files that are used to generate a portion of the user presentation 406; audio files used to generate music, sound effects, etc. within the interactive application; configuration files used to configure the features of the interactive application; scripts or other types of control code used to provide various features of the interactive application; and graphics resources such as textures, objects, etc. that are used by a graphics engine to render objects displayed in an interactive application.

In operation, components of the interactive application 402 read portions of the application state 414 and generate the user presentation 406 for the user that is presented to the user using the user interface 404. The user perceives the user presentation and provides user interactions 408 using the HIDs. The corresponding user interactions are received as user actions or inputs by various components of the interactive application 402. The interactive application 402 translates the user actions into interactions with the virtual objects of the application environment stored in the application state 414. Components of the interactive application use the user interactions with the virtual objects of the interactive application and the interactive application state 414 to update the application state 414 and update the user presentation 406 presented to the user. The process loops continuously while the user interacts with the interactive application of the application credit earning interleaved wagering system.

The interactive controller 400 provides one or more interfaces 418 between the interactive controller 400 and other components of an application credit earning interleaved wagering system, such as, but not limited to, an application controller. The interactive controller 400 and the other application credit earning interleaved wagering system components communicate with each other using the interfaces. The interface may be used to pass various types of data, and to communicate and receive messages, status data, commands and the like. In certain embodiments, the interactive controller 400 and an application controller communicate application instructions and environment resources 412 and application telemetry data 410. In some embodiments, the communications include requests by the application controller that the interactive controller 400 update the application state 414 using data provided by the application controller.

In many embodiments, a communication by an application controller includes a request that the interactive controller 400 update one or more resources 416 using data provided by the application controller. In a number of embodiments, the interactive controller 400 provides all or a portion of the application state to the application controller. In some embodiments, the interactive controller 400 may also provide data about one or more of the application resources 416 to the application controller. In some embodiments, the communication includes user interactions that the interactive controller 400 communicates to the application controller. The user interactions may be low level user interactions with the user interface 404, such as manipulation of a HID, or may be high level interactions with game objects as determined by the interactive application. The user interactions may also include resultant actions such as modifications to the application state 414 or game resources 416 resulting from the user's interactions taken in the application credit earning interleaved wagering system interactive application. In some embodiments, user interactions include, but are not limited to, actions taken by entities such as non-player characters (NPC) of the interactive application that act on behalf of or under the control of the user.

In some embodiments, the interactive controller 400 includes a wagering user interface 420 used to communicate application credit earning interleaved wagering system telemetry data 422 to and from the user. The application credit earning interleaved wagering system telemetry data 422 from the application credit earning interleaved wagering system include, but are not limited to, data used by the user to configure Cr, AC and element wagers, and data about the gambling game Cr, AC and element wagers such as, but not limited to, Cr, AC and element balances and Cr, AC and element amounts wagered.

In some embodiments, the interactive controller includes one or more sensors 424. Such sensors may include, but are not limited to, physiological sensors that monitor the physiology of the user, environmental sensors that monitor the physical environment of the interactive controller, accelerometers that monitor changes in motion of the interactive controller, and location sensors that monitor the location of the interactive controller such as global positioning sensors (GPSs). The interactive controller 400 communicates sensor telemetry data 426 to one or more components of the application credit earning interleaved wagering system.

Referring now to FIG. 4B, interactive controller 400 includes a bus 502 that provides an interface for one or more processors 504, random access memory (RAM) 506, read only memory (ROM) 508, machine-readable storage medium 510, one or more user output devices 512, one or more user input devices 514, and one or more communication interface devices 516.

The one or more processors 504 may take many forms, such as, but not limited to: a central processing unit (CPU); a multi-processor unit (MPU); an ARM processor; a controller; a programmable logic device; or the like.

In the example embodiment, the one or more processors 504 and the random access memory (RAM) 506 form an interactive controller processing unit 599. In some embodiments, the interactive controller processing unit includes one or more processors operatively connected to one or more of a RAM, ROM, and machine-readable storage medium; the one or more processors of the interactive controller processing unit receive instructions stored by the one or more of a RAM, ROM, and machine-readable storage medium via a bus; and the one or more processors execute the received instructions. In some embodiments, the interactive controller processing unit is an ASIC (Application-Specific Integrated Circuit). In some embodiments, the interactive controller processing unit is a SoC (System-on-Chip).

Examples of output devices 512 include, but are not limited to, display screens; light panels; and/or lighted displays. In accordance with particular embodiments, the one or more processors 504 are operatively connected to audio output devices such as, but not limited to: speakers; and/or sound amplifiers. In accordance with many of these embodiments, the one or more processors 504 are operatively connected to tactile output devices like vibrators, and/or manipulators.

Examples of user input devices 514 include, but are not limited to: tactile devices including but not limited to, keyboards, keypads, foot pads, touch screens, and/or trackballs; non-contact devices such as audio input devices; motion sensors and motion capture devices that the interactive controller can use to receive inputs from a user when the user interacts with the interactive controller; physiological sensors that monitor the physiology of the user; environmental sensors that monitor the physical environment of the interactive controller; accelerometers that monitor changes in motion of the interactive controller; and location sensors that monitor the location of the interactive controller such as global positioning sensors.

The one or more communication interface devices 516 provide one or more wired or wireless interfaces for communicating data and commands between the interactive controller 400 and other devices that may be included in an application credit earning interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface, a cellular or satellite telephone network interface; and the like.

The machine-readable storage medium 510 stores machine-executable instructions for various components of the interactive controller, such as but not limited to: an operating system 518; one or more device drivers 522; one or more application programs 520 including but not limited to an interactive application; and application credit earning interleaved wagering system interactive controller instructions and data 524 for use by the one or more processors 504 to provide the features of an interactive controller as described herein. In some embodiments, the machine-executable instructions further include application control layer/application control interface instructions and data 526 for use by the one or more processors 504 to provide the features of an application control layer/application control interface as described herein.

In various embodiments, the machine-readable storage medium 510 is one of a (or a combination of two or more of) a hard drive, a flash drive, a DVD, a CD, a flash storage, a solid state drive, a ROM, an EEPROM, and the like.

In operation, the machine-executable instructions are loaded into memory 506 from the machine-readable storage medium 510, the ROM 508 or any other storage location. The respective machine-executable instructions are accessed by the one or more processors 504 via the bus 502, and then executed by the one or more processors 504. Data used by the one or more processors 504 are also stored in memory 506, and the one or more processors 504 access such data during execution of the machine-executable instructions. Execution of the machine-executable instructions causes the one or more processors 504 to control the interactive controller 400 to provide the features of an application credit earning interleaved wagering system interactive controller as described herein Although the interactive controller is described herein as being constructed from or configured using one or more processors and instructions stored and executed by hardware components, the interactive controller can be constructed from or configured using only hardware components in accordance with other embodiments. In addition, although the storage medium 510 is described as being operatively connected to the one or more processors through a bus, those skilled in the art of interactive controllers will understand that the storage medium can include removable media such as, but not limited to, a USB memory device, an optical CD ROM, magnetic media such as tape and disks. In some embodiments, the storage medium 510 can be accessed by the one or more processors 504 through one of the communication interface devices 516 or using a communication link. Furthermore, any of the user input devices or user output devices can be operatively connected to the one or more processors 504 via one of the communication interface devices 516 or using a communication link.

In some embodiments, the interactive controller 400 can be distributed across a plurality of different devices. In many such embodiments, an interactive controller of an application credit earning interleaved wagering system includes an interactive application server operatively connected to an interactive client using a communication link. The interactive application server and interactive application client cooperate to provide the features of an interactive controller as described herein.

In various embodiments, the interactive controller 400 may be used to construct other components of an application credit earning interleaved wagering system as described herein.

In some embodiments, components of an interactive controller and an application controller of a multifaceted application resource wagering interleaved system may be constructed from or configured using a single device using processes that communicate using an interprocess communication protocol. In other such embodiments, the components of an interactive controller and an application controller of a multifaceted application resource wagering interleaved system may communicate by passing messages, parameters or the like.

Figure 5A:
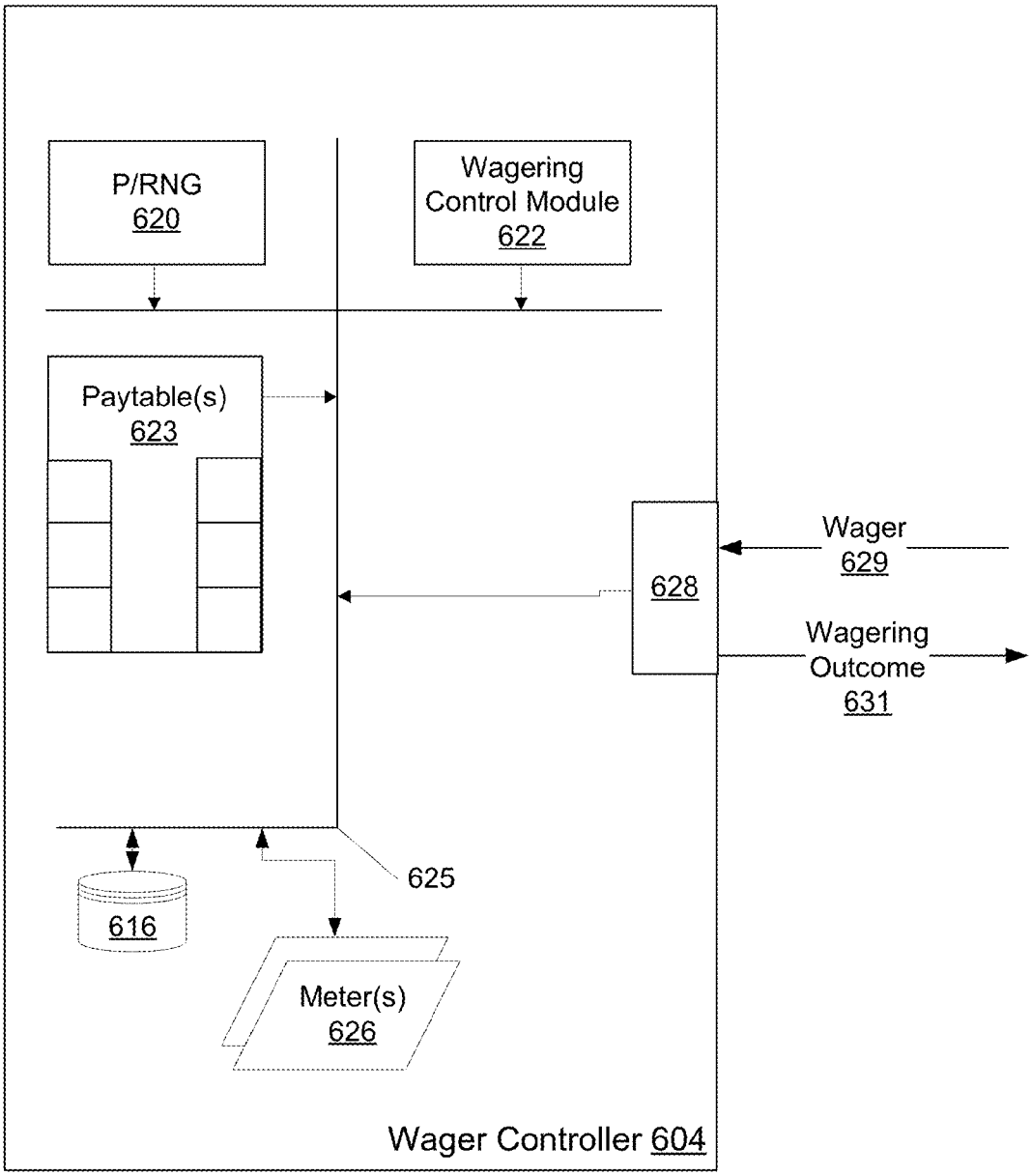
FIGS. 5A and 5B are diagrams of a structure of a wager controller of an application credit earning interleaved wagering system in accordance with various embodiments of the invention.
Figure 5B:
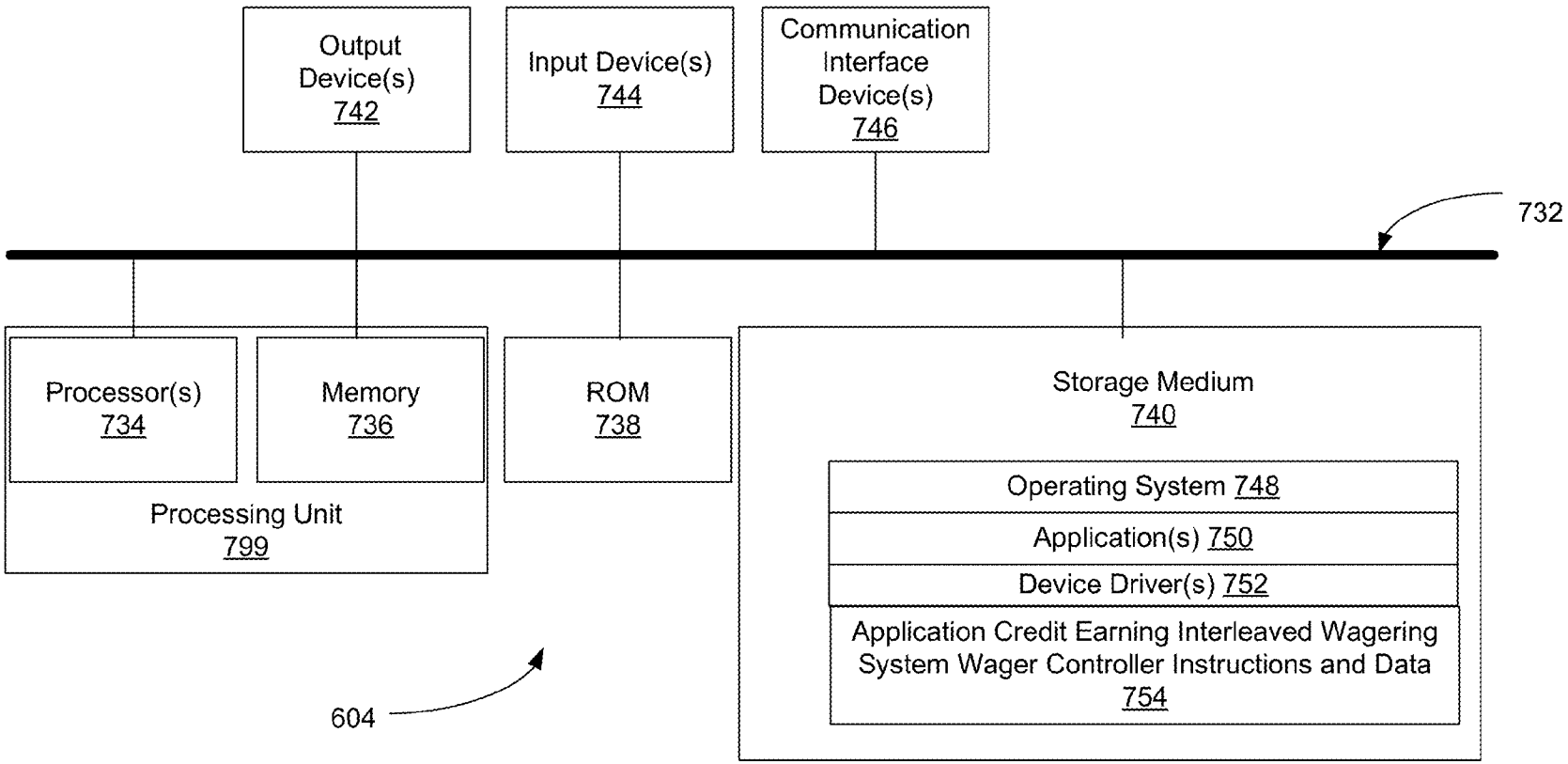

FIGS. 5A and 5B are diagrams of a structure of a wager controller of an application credit earning interleaved wagering system in accordance with various embodiments of the invention. A wager controller may be constructed from or configured using one or more processing devices configured to perform the operations of the wager controller. In many embodiments, a wager controller can be constructed from or configured using various types of processing devices including, but not limited to, a mobile device such as a smartphone or the like, a personal digital assistant, a wireless device such as a tablet computer or the like, an electronic gaming machine, a personal computer, a gaming console, a set-top box, a computing device, a controller, or the like.

Referring now to FIG. 5A, in various embodiments, a wager controller 604, suitable for use as wager controller 102 of FIG. 1A, includes a pseudorandom or random number generator (P/RNG) 620 to produce random results or pseudo random results; one or more paytables 623 which includes a plurality of factors indexed by the random result to be multiplied with an amount of Cr, AC, elements, or objects committed in a wager; and a wagering control module 622 whose processes may include, but are not limited to, generating random results, looking up factors in the paytables, multiplying the factors by an amount of Cr, AC, elements, or objects wagered, and administering one or more Cr, AC, element, or object meters 626. The various wager controller components can interface with each other via an internal bus 625 and/or other appropriate communication mechanism.

An interface 628 allows the wager controller 604 to operatively connect to an external device, such as one or more application controllers as described herein. The interface 628 provides for receiving of wager execution instructions 629 from the external device that is used to specify wager parameters and/or trigger execution of a wager by the wager controller 604. The interface 628 may also provide for communicating wager outcome data 631 to an external device. In numerous embodiments, the interface between the wager controller 604 and other systems/devices may be a wide area network (WAN) such as the Internet. However, other methods of communication may be used including, but not limited to, a local area network (LAN), a universal serial bus (USB) interface, and/or some other method by which two electronic devices could communicate with each other.

In various embodiments, a wager controller 604 may use a P/RNG provided by an external system. The external system may be connected to the wager controller 604 by a suitable communication network such as a local area network (LAN) or a wide area network (WAN). In some embodiments, the external P/RNG is a central deterministic system that provides random or pseudo random results to one or more connected wager controllers.

During operation of the wager controller, the external system communicates wager execution instructions 629 to the wager controller 604. The wager controller 604 receives the wager execution instructions and uses the wager execution instructions to trigger execution of a wager in accordance with a wagering proposition. The wager controller 604 executes the wager and determines a wager outcome for the wager. The wager controller communicates wager outcome data 631 of the wager outcome to the external system.

In some embodiments, the wager controller uses the wager execution instructions to select a paytable 628 to use and/or an amount of Cr, AC, elements, or objects to wager.

In some embodiments, the wager outcome data may include, but is not limited to, an amount of Cr, AC, elements, or objects won in the wager.

In various embodiments, the wager outcome data may include, but is not limited to, an amount of Cr, AC, elements, or objects in the one or more meters 626.

In some embodiments, the wager outcome data includes state data for the wagering proposition of the executed wager. The state data may correspond to one or more game states of a gambling game that is associated with the wagering proposition. Examples of state data include, but are not limited to, reel strips in an operation state or a final state for a reel-based gambling game, one or more dice positions for a dice-based gambling game, positions of a roulette wheel and roulette ball, position of a wheel of fortune, or the like.

In various embodiments, the wagering control module 622 determines an amount of a wager and a paytable to use from the one or more paytables 623. In such embodiments, in response to the wager execution instructions triggering execution of the wager, the wager control module 622 executes the wager by requesting a P/RNG result from the P/RNG 620; retrieving a paytable from the one or more paytables 623; adjusting the one or more credit meters 626 for an amount of the wager; applying the P/RNG result to the retrieved paytable; multiplying the resultant factor from the paytable by an amount wagered to determine a wager outcome; updating the one or more meters 626 based on the wager outcome; and communicating the wager outcome to the external device.

In various embodiments, an external system communicates a request for a P/RNG result from the wager controller 604. In response, the wager controller 604 returns a P/RNG result as a function of an internal P/RNG or a P/RNG external to the external system to which the wager controller 604 is operatively connected.

In some embodiments, a communication exchange between the wager controller 604 and an external system relate to the external system support for coupling a P/RNG result to a particular paytable contained in the wager controller 604. In such an exchange, the external system communicates to the wager controller 604 as to which of the one or more paytables 623 to use, and requests a result whereby the P/RNG result would be associated with the requested paytable 623. The result of the coupling is returned to the external system. In such an exchange, no actual Cr, AC, element, or object wager is conducted, but might be useful in coupling certain non-value wagering interactive application behaviors and propositions to the same final resultant wagering return which is understood for the application credit earning interleaved wagering system to conduct wagering.

In some embodiments, the wager controller 604 may also include storage for statuses, wagers, wager outcomes, meters and other historical events in a storage device 616.

In some embodiments, an authorization access module provides a process to permit access and command exchange with the wager controller 604 and access to the one or more credit meters 626 for the amount of Cr, AC, elements, or objects being wagered by the user in the application credit earning interleaved wagering system.

In numerous embodiments, communication occurs between various types of a wager controller and an external system 630, such as application controller. In some of these embodiments, the purpose of the wager controller is to allocate wagers to pools, detect occurrences of one or more events upon which the wagers were made, and determine the wager outcomes for each individual wager based on the number of winning wagers and the amount paid into the pool.

In some embodiments, the wager controller manages accounts for individual users wherein the users make deposits into the accounts, amounts are deducted from the accounts, and amounts are credited to the users' accounts based on the wager outcomes.

In some embodiments a wager controller is a pari-mutuel wagering system such as used for wagering on an events such as horse races, greyhound races, sporting events and the like. In a pari-mutuel wagering system, user's wagers on the outcome of an event are allocated to a pool. When the event occurs, wager outcomes are calculated by sharing the pool among all winning wagers.

In various embodiments, a wager controller is a central determination system, such as but not limited to a central determination system for a Class II wagering system or a wagering system in support of a "scratch off" style lottery. In such a wagering system, a player plays against other players and competes for a common prize. In a given set of wager outcomes, there are a certain number of wins and losses. Once a certain wager outcome has been determined, the same wager outcome cannot occur again until a new set of wager outcomes is generated.

In numerous embodiments, communication occurs between various components of a wager controller 604 and an external system, such as an application controller. In some of these embodiments, the purpose of the wager controller 604 is to manage wagering on wagering events and to provide random (or pseudo random) results from a P/RNG.

Referring now to FIG. 5B, wager controller 604 includes a bus 732 that provides an interface for one or more processors 734, random access memory (RAM) 736, read only memory (ROM) 738, machine-readable storage medium 740, one or more user output devices 742, one or more user input devices 744, and one or more communication interface and/or network interface devices 746.

The one or more processors 734 may take many forms, such as, but not limited to, a central processing unit (CPU), a multi-processor unit (MPU), an ARM processor, a controller, a programmable logic device, or the like.

In the example embodiment, the one or more processors 734 and the random access memory (RAM) 736 form a wager controller processing unit 799. In some embodiments, the wager controller processing unit includes one or more processors operatively connected to one or more of a RAM, ROM, and machine-readable storage medium; the one or more processors of the wager controller processing unit receive instructions stored by the one or more of a RAM, ROM, and machine-readable storage medium via a bus; and the one or more processors execute the received instructions. In some embodiments, the wager controller processing unit is an ASIC (Application-Specific Integrated Circuit). In some embodiments, the wager controller processing unit is a SoC (System-on-Chip).

Examples of output devices 742 include, but are not limited to, display screens, light panels, and/or lighted displays. In accordance with particular embodiments, the one or more processors 734 are operatively connected to audio output devices such as, but not limited to speakers, and/or sound amplifiers. In accordance with many of these embodiments, the one or more processors 734 are operatively connected to tactile output devices like vibrators, and/or manipulators.

Examples of user input devices 734 include, but are not limited to, tactile devices including but not limited to, keyboards, keypads, touch screens, and/or trackballs; non-contact devices such as audio input devices; motion sensors and motion capture devices that the wager controller can use to receive inputs from a user when the user interacts with the wager controller 604.

The one or more communication interface and/or network interface devices 746 provide one or more wired or wireless interfaces for exchanging data and commands between the wager controller 604 and other devices that may be included in an application credit earning interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface; a cellular or satellite telephone network interface; and the like.

The machine-readable storage medium 740 stores machine-executable instructions for various components of a wager controller, such as but not limited to: an operating system 748; one or more application programs 750; one or more device drivers 752; and application credit earning interleaved wagering system wager controller instructions and data 754 for use by the one or more processors 734 to provide the features of an application credit earning interleaved wagering system wager controller as described herein.

In various embodiments, the machine-readable storage medium 740 is one of a (or a combination of two or more of) a hard drive, a flash drive, a DVD, a CD, a flash storage, a solid state drive, a ROM, an EEPROM, and the like.

In operation, the machine-executable instructions are loaded into memory 736 from the machine-readable storage medium 740, the ROM 738 or any other storage location. The respective machine-executable instructions are accessed by the one or more processors 734 via the bus 732, and then executed by the one or more processors 734. Data used by the one or more processors 734 are also stored in memory 736, and the one or more processors 734 access such data during execution of the machine-executable instructions. Execution of the machine-executable instructions causes the one or more processors 734 to control the wager controller 604 to provide the features of an application credit earning interleaved wagering system wager controller as described herein Although the wager controller 604 is described herein as being constructed from or configured using one or more processors and machine-executable instructions stored and executed by hardware components, the wager controller can be composed of only hardware components in accordance with other embodiments. In addition, although the storage medium 740 is described as being operatively connected to the one or more processors through a bus, those skilled in the art of processing devices will understand that the storage medium can include removable media such as, but not limited to, a USB memory device, an optical CD ROM, magnetic media such as tape and disks. In some embodiments, the storage medium 740 can be accessed by the one or more processors 734 through one of the interfaces or using a communication link. Furthermore, any of the user input devices or user output devices can be operatively connected to the one or more processors 734 via one of the interfaces or using a communication link.

In various embodiments, the wager controller 604 may be used to construct other components of an application credit earning interleaved wagering system as described herein.

In some embodiments, components of a wager controller and an application controller of a multifaceted application resource wagering interleaved system may be constructed from or configured using a single device using processes that communicate using an interprocess communication protocol. In other such embodiments, the components of a wager controller and an application controller of a multifaceted application resource wagering interleaved system may communicate by passing messages, parameters or the like.

It should be understood that there may be many embodiments of a wager controller 604 which could be possible, including forms where many modules and components of the wager controller are located in various servers and locations, so the foregoing is not meant to be exhaustive or all inclusive, but rather provide data on various embodiments of a wager controller 604.

Figure 6A:
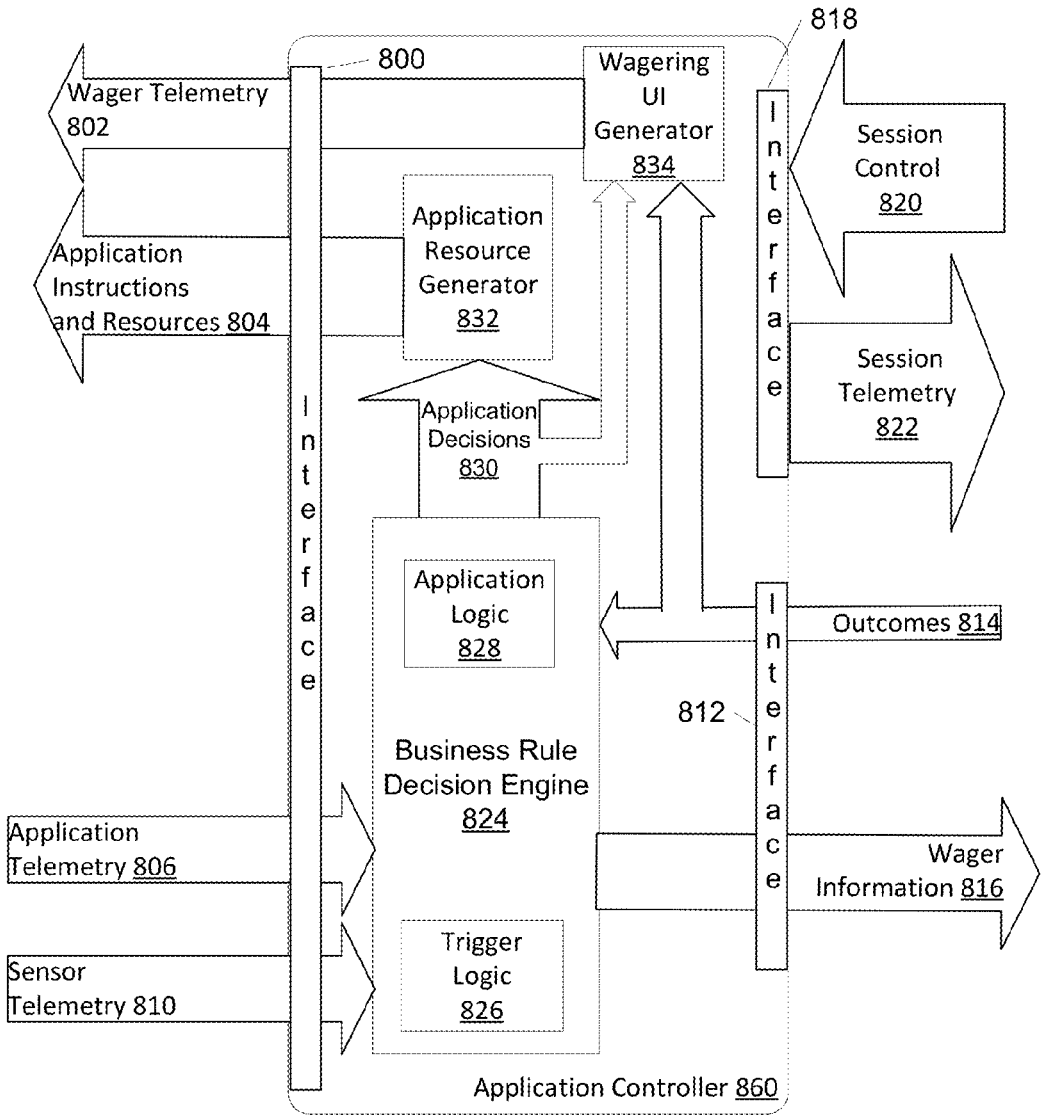
FIGS. 6A and 6B are diagrams of a structure of an application controller of an application credit earning interleaved wagering system in accordance with various embodiments of the invention.
Figure 6B:
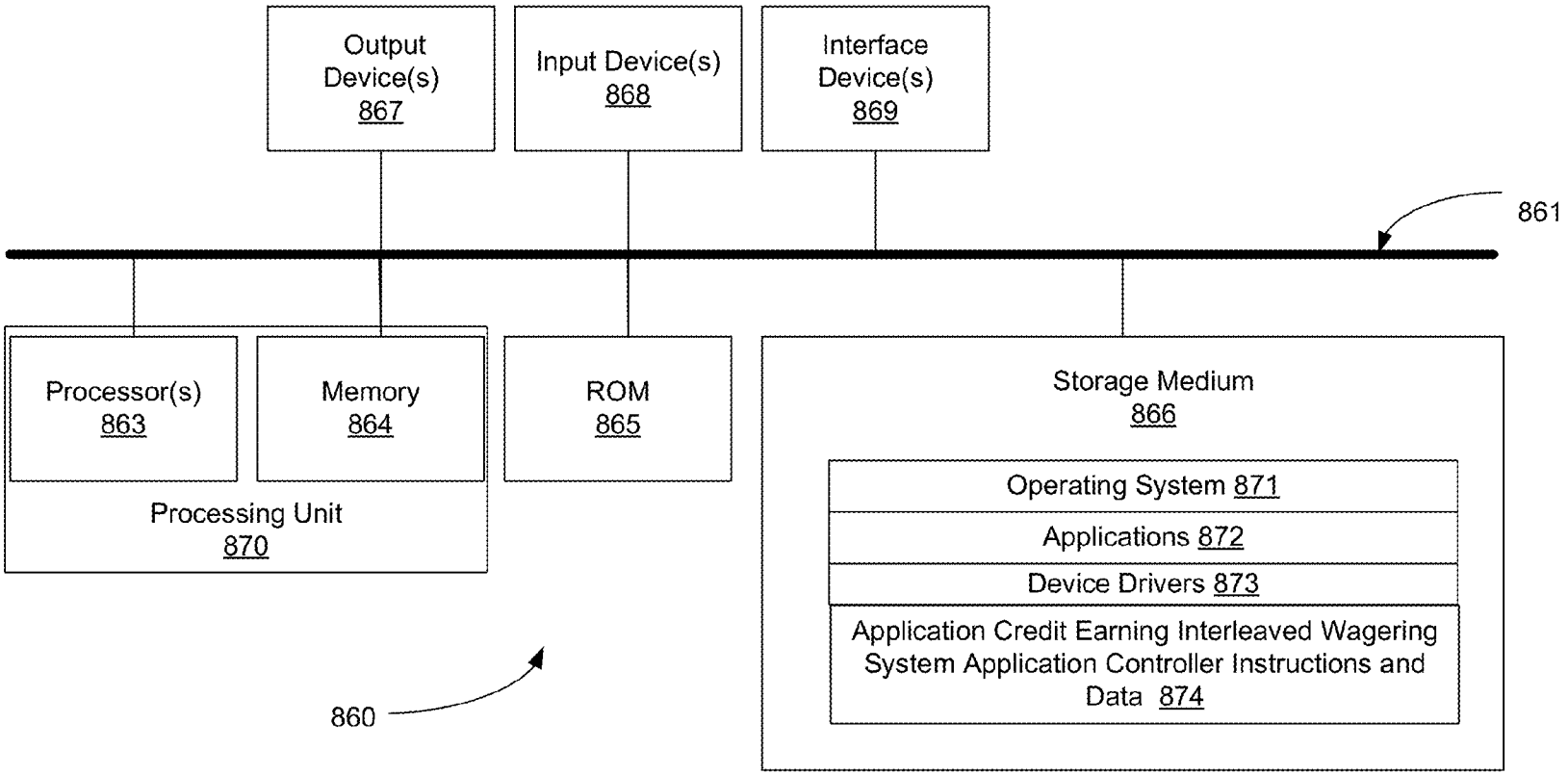

FIGS. 6A and 6B are diagrams of a structure of an application controller of an application credit earning interleaved wagering system in accordance with various embodiments of the invention. An application controller may be constructed from or configured using one or more processing devices configured to perform the operations of the application controller. In many embodiments, an application controller can be constructed from or configured using various types of processing devices including, but not limited to, a mobile device such as a smartphone, a personal digital assistant, a wireless device such as a tablet computer or the like, an electronic gaming machine, a personal computer, a gaming console, a set-top box, a computing device, a controller, or the like.

Referring now to FIG. 6A, in many embodiments, an application controller 860, suitable for use as application controller 112 of FIG. 1A, manages operation of an application credit earning interleaved wagering system, with a wager controller and an interactive controller being support units to the application controller 860. The application controller 860 provides an interface between the interactive application, provided by an interactive controller, and a wagering proposition, provided by a wager controller.

In some embodiments, the application controller 860 includes an interactive controller interface 800 to an interactive controller. The interactive controller interface 800 provides for communication of data between an interactive controller and the application controller 860, including but not limited to wager telemetry data 802, application instructions and resources 804, application telemetry data 806, and sensor telemetry data 810.

In various embodiments, the application controller 860 includes a wager controller interface 812 to a wager controller. The wager controller interface 812 provides for communication of data between the application controller 860 and a wager controller, including but not limited to wager outcomes 814 and wager execution instructions 816.

In some embodiments, the application controller 860 includes a user management and session controller interface 818 to a user management and session controller. The user management and session controller interface 818 provides for communication of data between the application controller 860 and a user management and session controller, including but not limited to user session control data 820 and user session telemetry data 822.

The application controller 860 includes a rule-based decision engine 824 that receives telemetry data, such as application telemetry data and sensor telemetry data, from an interactive controller. The rule-based decision engine 824 uses the telemetry data, along with trigger logic 826 to generate wager execution instructions used to trigger a wager in a wager controller.

In some embodiments, the application telemetry data includes, but is not limited to, application environment variables that indicate the state of an interactive application being used by a user, interactive controller data indicating a state of an interactive controller, and user actions and interactions between a user and an interactive application provided by an interactive controller. The wagering and/or wager execution instructions may include, but is not limited to, an amount and type of the wager, a trigger of the wager, and a selection of a paytable to be used when executing the wager.

In some embodiments, the rule-based decision engine 824 also receives wager outcome data from a wager controller. The decision engine 824 uses the wager outcome data, in conjunction with telemetry data and application logic 828 to generate application decisions 830 communicated to an application resource generator 832. The application resource generator 832 receives the application decisions and uses the application decisions to generate application instructions and application resources to be communicated to an interactive application.

In many embodiments, the application controller 860 includes a pseudo random or random result generator used to generate random results that are communicated to the application resource generator 832. The application resource generator uses the random results to generate application instructions and application resources to be communicated to an interactive controller for use by an interactive application.

In various embodiments, the rule-based decision engine 824 also determines an amount of AC to award to a user based at least in part on the user's use of an interactive application of the application credit earning interleaved wagering system as determined from application telemetry data. In some embodiments, wager outcome data may also be used to determine the amount of AC that should be awarded to the user.

In numerous embodiments, an interactive application is a skill-based interactive game and the AC is awarded to the user for the user's skillful play of the skill-based interactive game.

In some embodiments, the application decisions and wager outcome data are communicated to a wagering user interface generator 834. The wagering user interface generator 834 receives the application decisions and wager outcome data and generates wager telemetry data describing the state of wagering and credit accumulation and loss for the application credit earning interleaved wagering system. In some embodiments, the wager telemetry data 146 may include, but is not limited to, amounts of AC and elements earned, lost or accumulated by the user through use of the interactive application as determined from the application decisions, and Cr amounts won, lost or accumulated as determined from the wager outcome data and the one or more credit meters.

In some embodiments, the wager outcome data 814 also includes data about one or more game states of a gambling game executed in accordance with a wagering proposition by a wager controller. In various such embodiments, the wagering user interface generator 834 generates a gambling game process display and/or gambling game state display using the one or more game states of the gambling game. The gambling game process display and/or gambling game state display is included in wager telemetry data that is communicated to an interactive controller. The gambling game process display and/or a gambling game state display is displayed by a wagering user interface of the interactive controller to a user. In other such embodiments, the one or more game states of the gambling game are communicated to an interactive controller and a wagering user interface of the interactive controller generates a gambling game process display and/or gambling game state display using the one or more game states of the gambling game for display to a user.

The application controller 860 can further operatively connect to a wager controller to determine an amount of credit or elements available and other wagering metrics of a wagering proposition. Thus, the application controller 860 may potentially affect an amount of Cr in play for participation in the wagering events of a gambling game provided by the wager controller. The application controller 860 may additionally include various audit logs and activity meters. In some embodiments, the application controller 860 can also couple to a centralized server for exchanging various data related to the user and the activities of the user during game play of an application credit earning interleaved wagering system.

In some embodiments, the operation of the application controller 860 does not affect the provision of a wagering proposition by a wager controller except for user choice parameters that are allowable in accordance with the wagering proposition. Examples of user choice parameters include, but are not limited to: wager terms such as but not limited to a wager amount; speed of game play (for example, by pressing a button or pulling a handle of a slot machine); and/or agreement to wager into a bonus round.

In a number of embodiments, communication of wager execution instructions between a wager controller and the application controller 860 can further be used to communicate various wagering control factors that the wager controller uses as input. Examples of wagering control factors include, but are not limited to, an amount of Cr, AC, elements, or objects consumed per wagering event, and/or the user's election to enter a jackpot round.

In some embodiments, the application controller 860 utilizes a wagering user interface to communicate certain interactive application data to the user, including but not limited to, club points, user status, control of the selection of user choices, and messages which a user can find useful in order to adjust the interactive application experience or understand the wagering status of the user in accordance with the wagering proposition in the wager controller.

In some embodiments, the application controller 860 utilizes a wagering user interface to communicate aspects of a wagering proposition to the user including, but not limited to, odds of certain wager outcomes, amount of Cr, AC, elements, or objects in play, and amounts of Cr, AC, elements, or objects available.

In a number of embodiments, a wager controller can accept wager proposition factors including, but not limited to, modifications in the amount of Cr, AC, elements, or objects wagered on each individual wagering event, a number of wagering events per minute the wager controller can resolve, entrance into a bonus round, and other factors. In several embodiments, the application controller 860 can communicate a number of factors back and forth to the wager controller, such that an increase/decrease in a wagered amount can be related to the change in user profile of the user in the interactive application. In this manner, a user can control a wager amount per wagering event in accordance with the wagering proposition with the change mapping to a parameter or component that is applicable to the interactive application experience.

Referring now to FIG. 6B, application controller 860 includes a bus 861 providing an interface for one or more processors 863, random access memory (RAM) 864, read only memory (ROM) 865, machine-readable storage medium 866, one or more user output devices 867, one or more user input devices 868, and one or more communication interface and/or network interface devices 869.

The one or more processors 863 may take many forms, such as, but not limited to: a central processing unit (CPU); a multi-processor unit (MPU); an ARM processor; a programmable logic device; or the like.

Examples of output devices 867 include, include, but are not limited to: display screens; light panels; and/or lighted displays. In accordance with particular embodiments, the one or more processors 863 are operatively connected to audio output devices such as, but not limited to: speakers; and/or sound amplifiers. In accordance with many of these embodiments, the one or more processors 863 are operatively connected to tactile output devices like vibrators, and/or manipulators.

In the example embodiment, the one or more processors 863 and the random access memory (RAM) 864 form an application controller processing unit 870. In some embodiments, the application controller processing unit includes one or more processors operatively connected to one or more of a RAM, ROM, and machine-readable storage medium; the one or more processors of the application controller processing unit receive instructions stored by the one or more of a RAM, ROM, and machine-readable storage medium via a bus; and the one or more processors execute the received instructions. In some embodiments, the application controller processing unit is an ASIC (Application-Specific Integrated Circuit). In some embodiments, the application controller processing unit is a SoC (System-on-Chip).

Examples of user input devices 868 include, but are not limited to: tactile devices including but not limited to, keyboards, keypads, foot pads, touch screens, and/or trackballs; non-contact devices such as audio input devices; motion sensors and motion capture devices that the application controller can use to receive inputs from a user when the user interacts with the application controller 860.

The one or more communication interface and/or network interface devices 869 provide one or more wired or wireless interfaces for exchanging data and commands between the application controller 860 and other devices that may be included in an application credit earning interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS), cellular, or satellite telephone network interface; and the like.

The machine-readable storage medium 866 stores machine-executable instructions for various components of the application controller 860 such as, but not limited to: an operating system 871; one or more applications 872; one or more device drivers 873; and application credit earning interleaved wagering system application controller instructions and data 874 for use by the one or more processors 863 to provide the features of an application controller as described herein.

In various embodiments, the machine-readable storage medium 870 is one of a (or a combination of two or more of) a hard drive, a flash drive, a DVD, a CD, a flash storage, a solid state drive, a ROM, an EEPROM, and the like.

In operation, the machine-executable instructions are loaded into memory 864 from the machine-readable storage medium 866, the ROM 865 or any other storage location. The respective machine-executable instructions are accessed by the one or more processors 863 via the bus 861, and then executed by the one or more processors 863. Data used by the one or more processors 863 are also stored in memory 864, and the one or more processors 863 access such data during execution of the machine-executable instructions. Execution of the machine-executable instructions causes the one or more processors 863 to control the application controller 860 to provide the features of an application credit earning interleaved wagering system application controller as described herein.

Although the application controller 860 is described herein as being constructed from or configured using one or more processors and instructions stored and executed by hardware components, the application controller can be composed of only hardware components in accordance with other embodiments. In addition, although the storage medium 866 is described as being operatively connected to the one or more processors through a bus, those skilled in the art of application controllers will understand that the storage medium can include removable media such as, but not limited to, a USB memory device, an optical CD ROM, magnetic media such as tape and disks. Also, in some embodiments, the storage medium 866 may be accessed by processor 863 through one of the interfaces or using a communication link. Furthermore, any of the user input devices or user output devices may be operatively connected to the one or more processors 863 via one of the interfaces or using a communication link.

In various embodiments, the application controller 860 may be used to construct other components of an application credit earning interleaved wagering system as described herein.

In some embodiments, components of an interactive controller and an application controller of a multifaceted application resource wagering interleaved system may be constructed from or configured using a single device using processes that communicate using an interprocess communication protocol. In other such embodiments, the components of an interactive controller and an application controller of a multifaceted application resource wagering interleaved system may communicate by passing messages, parameters or the like.

Figure 7A:
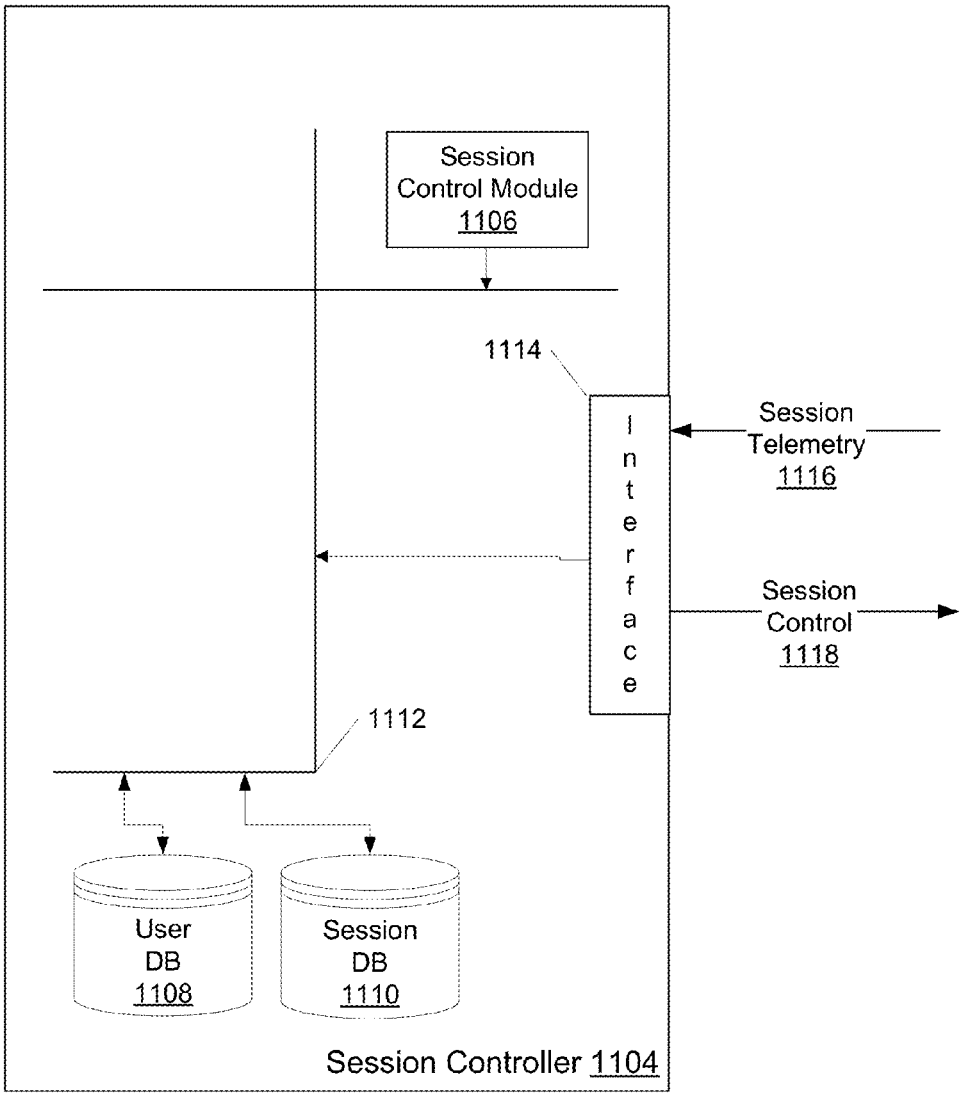
FIGS. 7A and 7B are diagrams of a structure of a user management and session controller of an application credit earning interleaved wagering system in accordance with various embodiments of the invention.
Figure 7B:
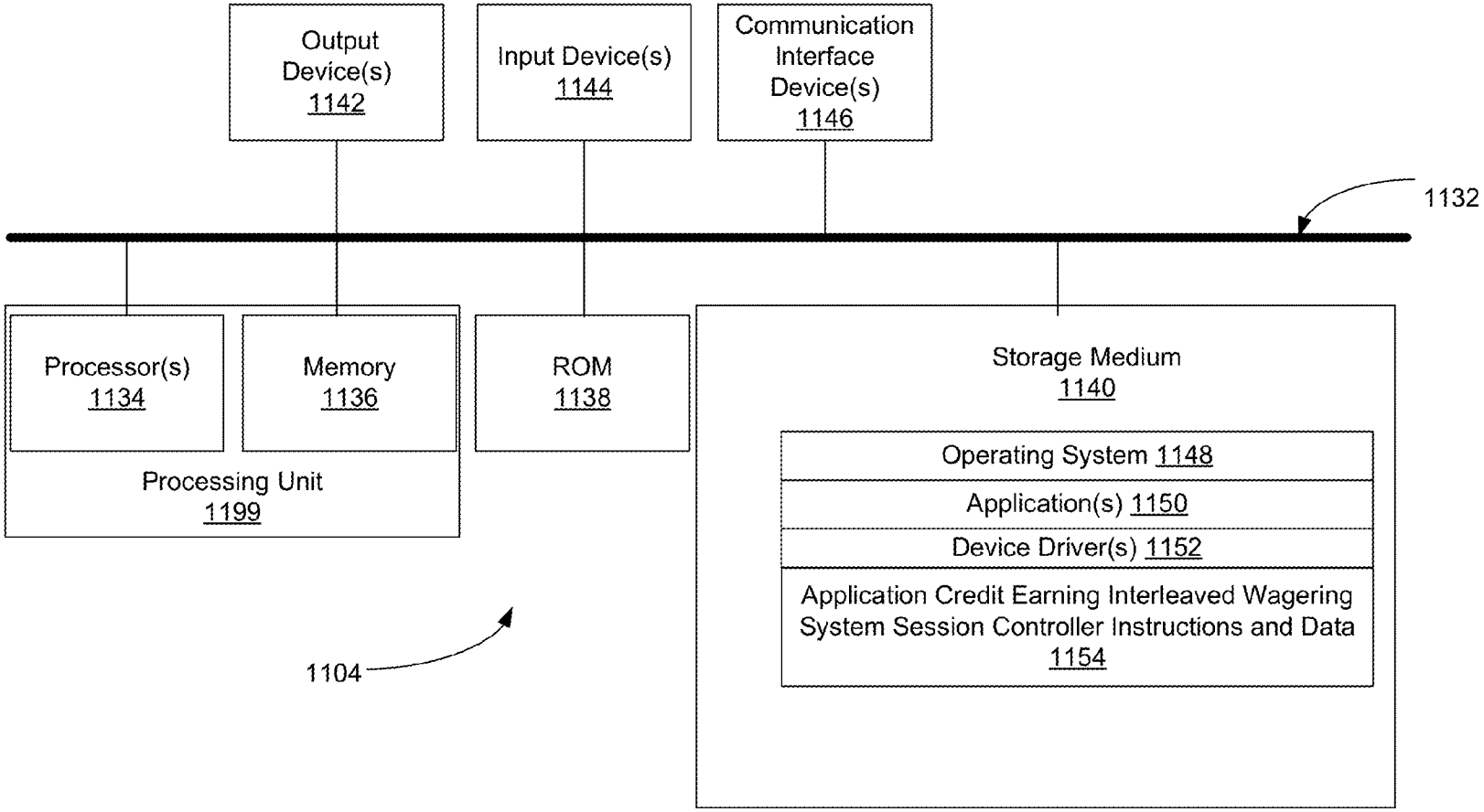

FIGS. 7A and 7B are diagrams of a structure of a user management and session controller of an application credit earning interleaved wagering system in accordance with various embodiments of the invention. A user management and session controller may be constructed from or configured using one or more processing devices configured to perform the operations of the user management and session controller. In many embodiments, a wager user session can be constructed from or configured using various types of processing devices including, but not limited to, a mobile device such as a smartphone or the like, a personal digital assistant, a wireless device such as a tablet computer or the like, an electronic gaming machine, a personal computer, a gaming console, a set-top box, a computing device, a controller, a server, or the like.

Referring now to FIG. 7A, in various embodiments, a user management and session controller 1104, suitable for use as user management and session controller 150 of FIG. 1A, includes a user management and session control module 1106 whose processes may include, but are not limited to, registering users of a multifaceted application resource wagering interleaved system, validating users of a multifaceted application resource wagering interleaved system using user registration data, managing various types of user sessions for users of the multifaceted application resource wagering interleaved system, and the like.

The user management and session controller 1104 may further include a datastore 1108 storing user data used to manage user registration and validation. The user management and session controller 1104 may further include a datastore 1110 storing user session data used to manage one or more user sessions.

The various user management and session controller components can interface with each other via an internal bus 1112 and/or other appropriate communication mechanism.

An interface 1114 allows the user management and session controller 1104 to operatively connect to one or more external devices, such as one or more application controllers, wager controllers and/or interactive controllers as described herein. The interface provides for receiving session telemetry data 1116 from the one more external devices. The user session telemetry data includes, but is not limited to, amounts of AC earned by one or more users, requests for entering into a multifaceted application resource user session as described herein, and telemetry data regarding the progress of one or more users during a multifaceted application resource user session. The interface 1114 may also provide for communicating secession control data 1118 used to manage a user session.

In numerous embodiments, the interface between the user management and session controller and other systems/devices may be a wide area network (WAN) such as the Internet. However, other methods of communication may be used including, but not limited to, a local area network (LAN), a universal serial bus (USB) interface, and/or some other method by which two electronic devices could communicate with each other.

During operation of the user management and session controller, the external system communicates user session telemetry data to the user management and session controller. The user management and session controller receives the user session telemetry data and uses the user session telemetry data to generate user session control data as described herein. The user management and session controller communicates the user session control data to the external system.

Referring now to FIG. 7B, user management and session controller 1104 includes a bus 1132 that provides an interface for one or more processors 1134, random access memory (RAM) 1136, read only memory (ROM) 1138, machine-readable storage medium 1140, one or more user output devices 1142, one or more user input devices 1144, and one or more communication interface and/or network interface devices 1146.

The one or more processors 1134 may take many forms, such as, but not limited to, a central processing unit (CPU), a multi-processor unit (MPU), an ARM processor, a controller, a programmable logic device, or the like.

In the example embodiment, the one or more processors 1134 and the random access memory (RAM) 1136 form a user management and session controller processing unit 1199. In some embodiments, the user management and session controller processing unit includes one or more processors operatively connected to one or more of a RAM, ROM, and machine-readable storage medium; the one or more processors of the user management and session controller processing unit receive instructions stored by the one or more of a RAM, ROM, and machine-readable storage medium via a bus; and the one or more processors execute the received instructions. In some embodiments, the user management and session controller processing unit is an ASIC (Application-Specific Integrated Circuit). In some embodiments, the user management and session controller processing unit is a SoC (System-on-Chip).

Examples of output devices 1142 include, but are not limited to, display screens, light panels, and/or lighted displays. In accordance with particular embodiments, the one or more processors 1134 are operatively connected to audio output devices such as, but not limited to speakers, and/or sound amplifiers. In accordance with many of these embodiments, the one or more processors 1134 are operatively connected to tactile output devices like vibrators, and/or manipulators.

Examples of user input devices 1144 include, but are not limited to, tactile devices including but not limited to, keyboards, keypads, touch screens, and/or trackballs; non-contact devices such as audio input devices; motion sensors and motion capture devices that the user management and session controller can use to receive inputs from a user when the user interacts with the user management and session controller 1104.

The one or more communication interface and/or network interface devices 1146 provide one or more wired or wireless interfaces for exchanging data and commands between the user management and session controller 1104 and other devices that may be included in an application credit earning interleaved wagering system. Such wired and wireless interfaces include, but are not limited to: a Universal Serial Bus (USB) interface; a Bluetooth interface; a Wi-Fi interface; an Ethernet interface; a Near Field Communication (NFC)

interface; a plain old telephone system (POTS) interface; a cellular or satellite telephone network interface; and the like.

The machine-readable storage medium 1140 stores machine-executable instructions for various components of a user management and session controller, such as but not limited to: an operating system 1148; one or more application programs 1150; one or more device drivers 1152; and application credit earning interleaved wagering system user management and session controller instructions and data 1154 for use by the one or more processors 1134 to provide the features of an application credit earning interleaved wagering system user management and session controller as described herein.

In various embodiments, the machine-readable storage medium 1140 is one of a (or a combination of two or more of) a hard drive, a flash drive, a DVD, a CD, a flash storage, a solid state drive, a ROM, an EEPROM, and the like.

In operation, the machine-executable instructions are loaded into memory 736 from the machine-readable storage medium 1140, the ROM 1138 or any other storage location. The respective machine-executable instructions are accessed by the one or more processors 1134 via the bus 1132, and then executed by the one or more processors 1134. Data used by the one or more processors 1134 are also stored in memory 1136, and the one or more processors 1134 access such data during execution of the machine-executable instructions. Execution of the machine-executable instructions causes the one or more processors 1134 to control the user management and session controller 1104 to provide the features of an application credit earning interleaved wagering system user management and session controller as described herein Although the user management and session controller 1104 is described herein as being constructed from or configured using one or more processors and machine-executable instructions stored and executed by hardware components, the user management and session controller can be composed of only hardware components in accordance with other embodiments. In addition, although the storage medium 1140 is described as being operatively connected to the one or more processors through a bus, those skilled in the art of processing devices will understand that the storage medium can include removable media such as, but not limited to, a USB memory device, an optical CD ROM, magnetic media such as tape and disks. In some embodiments, the storage medium 1140 can be accessed by the one or more processors 1134 through one of the interfaces or using a communication link. Furthermore, any of the user input devices or user output devices can be operatively connected to the one or more processors 1134 via one of the interfaces or using a communication link.

In various embodiments, the user management and session controller 1104 may be used to construct other components of an application credit earning interleaved wagering system as described herein.

In some embodiments, components of a user management and session controller and an application controller of a multifaceted application resource wagering interleaved system may be constructed from or configured using a single device using processes that communicate using an interprocess communication protocol. In other such embodiments, the components of a user management and session controller and an application controller of a multifaceted application resource wagering interleaved system may communicate by passing messages, parameters or the like.

In some embodiments, components of a user management and session controller and a wager controller of a multifaceted application resource wagering interleaved system may be constructed from or configured using a single device using processes that communicate using an interprocess communication protocol. In other such embodiments, the components of a user management and session controller and an application controller of a multifaceted application resource wagering interleaved system may communicate by passing messages, parameters or the like.

It should be understood that there may be many embodiments of a user management and session controller 1104 which could be possible, including forms where many modules and components of the user management and session controller are located in various servers and locations, so the foregoing is not meant to be exhaustive or all inclusive, but rather provide data on various embodiments of a user management and session controller 1104.

In numerous embodiments, any of a wager controller, an application controller, an interactive controller, or a user management and session controller as described herein can be constructed from or configured using multiple processing devices, whether dedicated, shared, or distributed in any combination thereof, or can be constructed from or configured using a single processing device. In addition, while certain aspects and features of application credit earning interleaved wagering system processes described herein have been attributed to a wager controller, an application controller, an interactive controller, or a user management and session controller, these aspects and features can be provided in a distributed form where any of the features or aspects can be provided by any of a user management and session controller, a wager controller, an application controller, and/or an interactive controller within an application credit earning interleaved wagering system without deviating from the spirit of the invention.

Although various components of application credit earning interleaved wagering systems are discussed herein, application credit earning interleaved wagering systems can be configured with any component as appropriate to the specification of a specific application in accordance with embodiments of the invention. In certain embodiments, components of an application credit earning interleaved wagering system, such as a user management and session controller, an application controller, a wager controller, and/or an interactive controller, can be configured in different ways for a specific application credit earning interleaved wagering system.

In some embodiments, components of a user management and session controller, an interactive controller, an application controller, and/or a wager controller of a multifaceted application resource wagering interleaved system may be constructed from or configured using a single device using processes that communicate using an interprocess communication protocol. In many embodiments, the components of a user management and session controller, an interactive controller, an application controller and a wager controller of a multifaceted application resource wagering interleaved system may communicate by passing messages, parameters or the like.

In addition, while certain aspects and features of application credit earning interleaved wagering system processes described herein have been attributed to a user management and session controller, a wager controller, an application controller, or an interactive controller, these aspects and features can be provided in a distributed form where any of the features or aspects can be provided by any of a user management and session controller, a wager controller, an application controller, and/or an interactive controller within an application credit earning interleaved wagering system.

Operation of Multifaceted Application Resource Wagering Interleaved Systems

Figure 8:
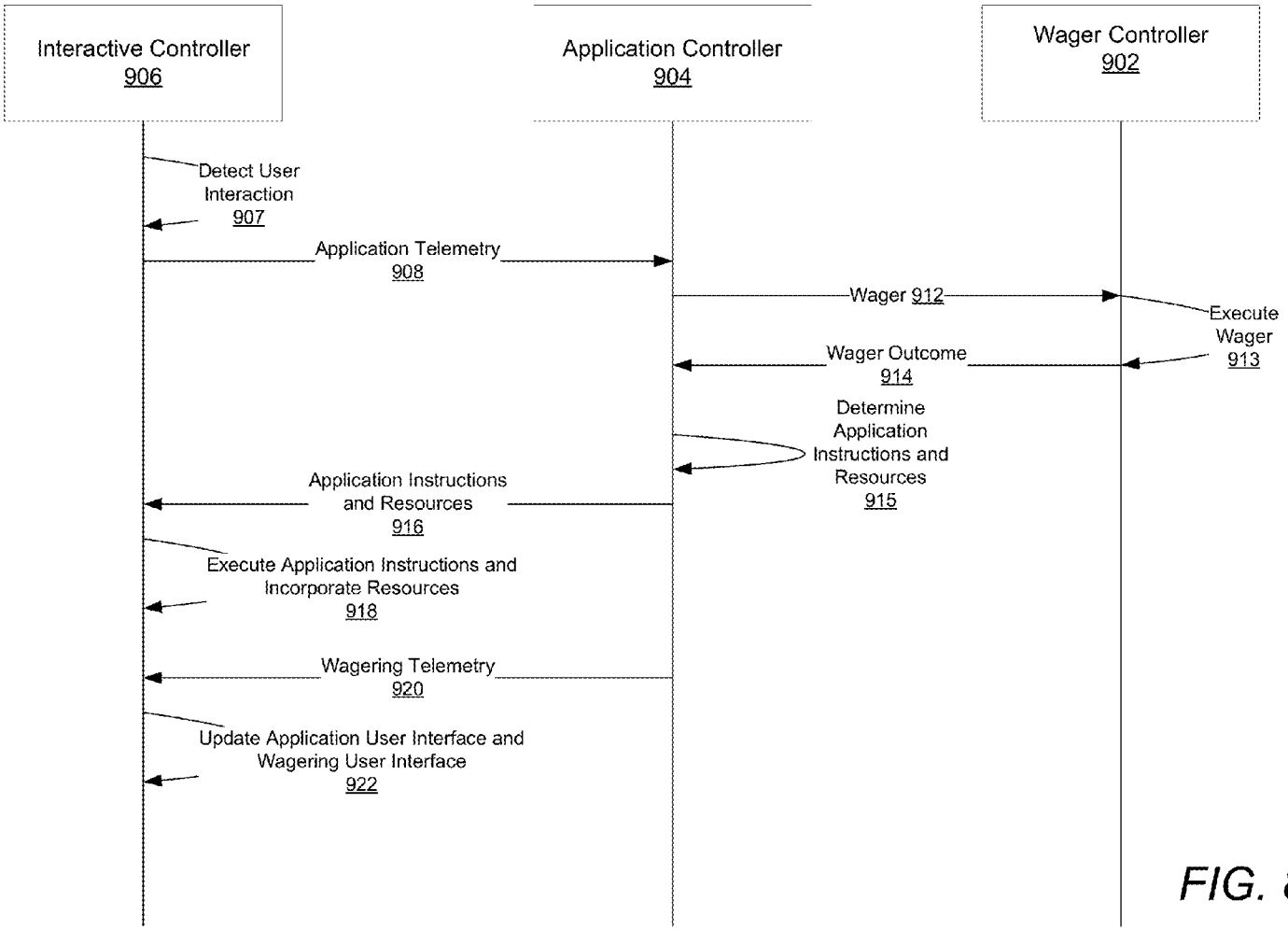
FIG. 8 is a sequence diagram of interactions between components of an application credit earning interleaved wagering system in accordance with various embodiments of the invention.

FIG. 8 is a sequence diagram of interactions between components of an application credit earning interleaved wagering system in accordance with various embodiments of the invention. The components of the application credit earning interleaved wagering system include a wager controller 902, such as wager controller 102 of FIG. 1A, an application controller 904, such as application controller 112 of FIG. 1A, and an interactive controller 906, such as interactive controller 120 of FIG. 1A. The process begins with the interactive controller 906 detecting a user performing a user interaction in a user interface of an interactive application provided by the interactive controller 906. The interactive controller 906 communicates application telemetry data 908 to the application controller 904. The application telemetry data includes, but is not limited to, the user interaction detected by the interactive controller 906.

The application controller 904 receives the application telemetry data 908. Upon determination by the application controller 904 that the user interaction indicates a wagering event, the application controller 904 generates wager execution instructions including a wager request 912 that the application controller 904 uses to instruct the wager controller 902 to execute a wager. The request for a wager event may include wager terms associated with a wagering proposition. The application controller 904 communicates the wager execution instructions to the wager controller 902.

The wager controller 902 receives the wager execution instructions 912 and uses the wager execution instructions to execute (913) a wager in accordance with a wagering proposition. The wager controller 902 communicates a wager outcome 914 of the executed wager to the application controller 904.

The application controller 904 receives the wager outcome and generates (915) interactive application instructions and resources 916 for the interactive application. The application controller 904 uses the interactive application instructions and resources 916 to instruct the interactive controller. The application controller communicates the interactive application instructions and resources 916 to the interactive controller 906. The application controller also communicates wagering telemetry data 920 including the wager outcome to the interactive controller 906.

The interactive controller 906 receives the interactive application instructions and resources 916 and wagering telemetry data 918. The interactive controller 906 incorporates the received interactive application resources and executes the received interactive application instructions (918). The interactive controller updates (922) an application user interface of the interactive application provided by the interactive controller using the interactive application instructions and the resources, and updates (922) a wagering user interface using the wagering telemetry data.

In several embodiments, a user can interact with an application credit earning interleaved wagering system by using Cr for wagering in accordance with a wagering proposition along with AC and elements in interactions with an interactive application. Wagering can be executed by a wager controller while an interactive application can be executed by an interactive controller and managed with an application controller.

Figure 9:
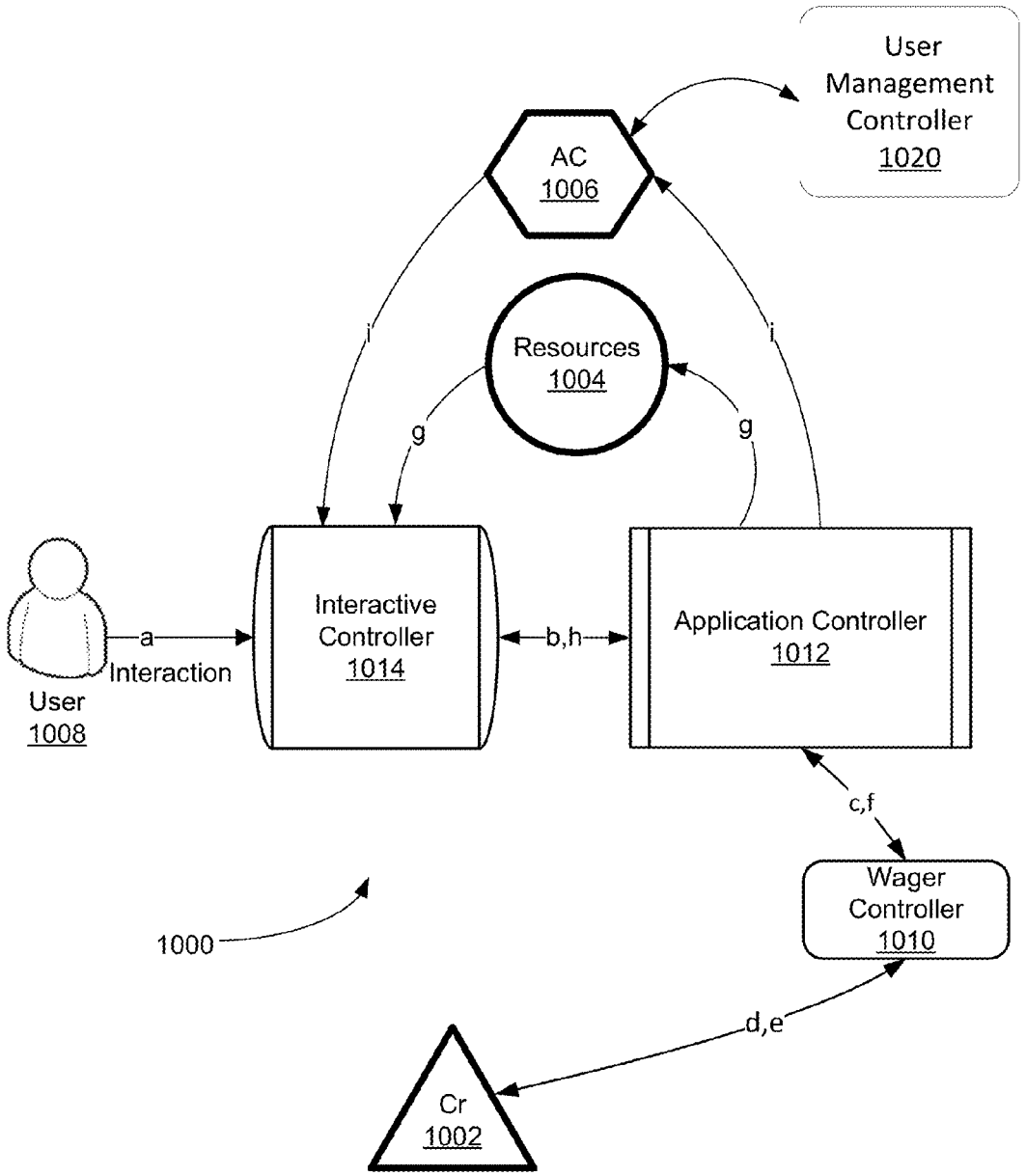
FIG. 9 is a collaboration diagram for components of an application credit earning interleaved wagering system in accordance with various embodiments of the invention.

FIG. 9 is a collaboration diagram that illustrates how resources such as AC, Cr, elements, and objects are utilized in an application credit earning interleaved wagering system in accordance with various embodiments of the invention. The collaboration diagram 1000 illustrates that Cr 1002, interactive application resources including elements and objects 1004 and AC 1006 can be utilized by a user 1008 in interactions with a wager controller 1010, such as wager controller 102 of FIG. 1A, an application controller 1012, such as wager controller 112 of FIG. 1, and an interactive controller 1014, such as interactive controller 120 of FIG. 1A, of an application credit earning interleaved wagering system. The contribution of elements and objects such as included in resources 1004, can be linked to a user's access to credits, such as Cr 1002 and/or AC 1006. Electronic receipt of these credits can come via a smart card, voucher or other portable media, or as received using a communication link from a server. In some embodiments, these credits can be drawn on demand from a user profile located in a database locally on an application credit earning interleaved wagering system or in a remote server.

A user's actions and/or decisions can affect an interactive application of interactive controller 1014 that consume and/or accumulate AC 1004 and/or resources 1004 in an interactive application executed by an interactive controller 1014, a wager controller 101 and an application controller 1012. The application controller 1012 can monitor the activities taking place within an interactive application executed by an interactive controller 1014 for wagering event occurrences. The application controller 1012 can also communicate the wagering event occurrences to the wager controller 1010 that triggers a wager of Cr 1002 in accordance with a wagering proposition executed by the wager controller 1010.

In several embodiments, the user commences interaction with the application credit earning interleaved wagering system by contributing credit to an application credit earning interleaved wagering system such as, but not limited to, Cr 1002 that may be credit in a real currency or may be credit in a virtual currency that is not fungible with a real currency, AC 1006 that may be application environment credits, and specified types of interactive application elements and/or objects 1004. One or more of these contributions may be provided directly as currency and/or transferred in electronically. Electronic transfer may come via a smart card, voucher or other portable media, or as transferred in using a communication link from a user data server or application credit earning interleaved wagering system user management and session controller. In many embodiments, contributions may be drawn on demand from user accounts located in servers residing on the network or in the cloud on a real time basis as the credits, elements and/or object are committed or consumed by the application credit earning interleaved wagering system. Generally, Cr is utilized and accounted for by the wager controller 1010; and the resources 1004 and AC 1006 are utilized and accounted for by the application controller 1012 and/or the interactive controller 1014.

The user interacts (a) with an interactive application provided by the interactive controller 1014 with the interaction representing an action by the user within the context of the interactive application. The interactive controller 1014 receives the user interaction and communicates (b) the interaction to the application controller 1012. The application controller 1012 receives the interaction and determines from the interaction whether or not a wager should be triggered. If a wager should be triggered, the application controller 1012 instructs (c) the wager controller 1010 to execute a wager in accordance with a wagering proposition associated with the interaction and thereby triggers a wager.

The wager controller receives the wager execution instructions and executes the wager in accordance with the wagering proposition, and consumes (d) an appropriate amount of Cr 1002 for the wager. The wager controller 1010 adjusts (e) the Cr 1002 based upon a wager outcome of the wager and communicates (f) the wager outcome to the application controller 1012 as to the outcome of the wager triggered by the application controller 1012. The application controller 1012 receives the wager outcome. The application controller determines what resources 1004 should be provided to the interactive controller, generates the resources 1004 and application instructions and instructs (g) the interactive controller 1014 using the resources 1004 and application instructions. The interactive controller receives the resources 1004 and application instructions from the application controller 1012 and integrates them into the execution of the interactive application provided by the interactive controller 1014.

In some embodiments, the application controller 1012 communicates (h) data about the wager outcome to the interactive controller. The interactive controller receives the wager outcome and displays the wager outcome to the user 1008.

In some embodiments, the application controller 1012 determines what resources and instructions to provide to the interactive controller 1014 for use by the interactive application provided by the interactive controller 1014 partially on the basis of the wager outcome. In some such embodiments, resources are provided in a case that the wager was a winning wager for the user. In other such embodiments, fewer or no resources are provided in a case of a losing wager.

In some embodiments, the application controller 1012 determines what resources to provide based on internal logic of the application controller 1012. In some such embodiments, the application controller 1012 employs a random result generator, such as a P/RNG, to generate a random result and the random result is used to determine what resources are provided to the interactive controller 1014.

In several embodiments, the application controller 1012 determines an increment or a decrement of an amount of AC 1006 using the interactions received from the interactive controller. The increment or decremented amount is communicated (i) to the interactive controller for display to the user.

In some embodiments, the application controller 1012 executes a wager of Cr as a virtual currency, AC, elements or objects. In some such embodiments, the application controller 1012 employs a random result generator, such as a P/RNG, to generate a random result and the random result is used to determine a wager outcome in Cr as a virtual currency, AC, elements or objects.

The following is description of an embodiment of the described collaboration where an interactive application provided by an interactive controller of an application credit earning interleaved wagering system is a first person shooter game. The process begins by a user selecting a machine gun to use in the game and then fires a burst of bullets at an opponent. The interactive controller can communicate to the application controller of the user's choice of weapon, that a burst of bullets was fired, and/or the outcome of the burst. The application controller communicates to the wager controller that 3 credits (Cr) are to be wagered on the outcome of a wagering event to match the three bullets consumed. The wager controller then performs the wagering event and determines the result of the wager and may determine the winnings from a paytable. The wager controller consumes 3 credits of Cr for the wager and executes the specified wager. By way of example, the wager controller may determine that the user hit a jackpot of 6 credits and returns the 6 credits to the Cr and communicates to the application controller that 3 net credits were won by the user.

The application controller communicates to the interactive controller to add 3 bullets to an ammunition clip. The interactive controller adds 3 bullets back to the ammo clip. The ammunition may be added by directly adding the ammunition to the clip or by allowing the user to find extra ammunition during use. The application controller logs the new user score (AC) in the game (as a function of the successful hit on the opponent) based on the interactive controller communication, and adds 2 extra points to the user score since a jackpot has been won. The application controller then adds 10 points to the user score (AC) given the success of the hit which in this example is worth 8 points, plus the 2 extra point. Note that this example is only intended to provide an illustration of how credits flow in an application credit earning interleaved wagering system, but is not intended to be exhaustive and only lists only one of numerous possibilities of how an application credit earning interleaved wagering system may be configured to manage its fundamental credits.

In many embodiments, user management and session controller 1020, such as user account controller 150 of FIG. 1A, of an application credit earning interleaved wagering system is used to store AC for use of the user. In such an embodiment, AC is generated by the application controller based on the user's use of the application credit earning interleaved wagering system and an amount of the AC is communicated to the user management and session controller 1020. The user management and session controller stores the amount of AC between user sessions. In some embodiments, the user management and session controller communicates an amount of AC to the application controller at the start of a user session for use by the user during a user session.

Application Credits

In some embodiments, an application credit earning interleaved wagering system allows users to accumulate application credits (AC) as a function of the user's demonstrated skill at an interactive application. In some embodiments, the process that allocates AC to users is insulated from the wagering mechanic by the interactive controller and the application controller, which do not directly relate to the allocation of AC to users. AC can be used to acquire items that have economic value outside of the application credit earning interleaved wagering system. Such items include economic value items whose economic values are volatile, such as, financial derivatives, stocks, bonds, contracts, securities, virtual currencies, tournament entry tickets, and ownership interests in results of virtual currency mining operations.

Figure 11:
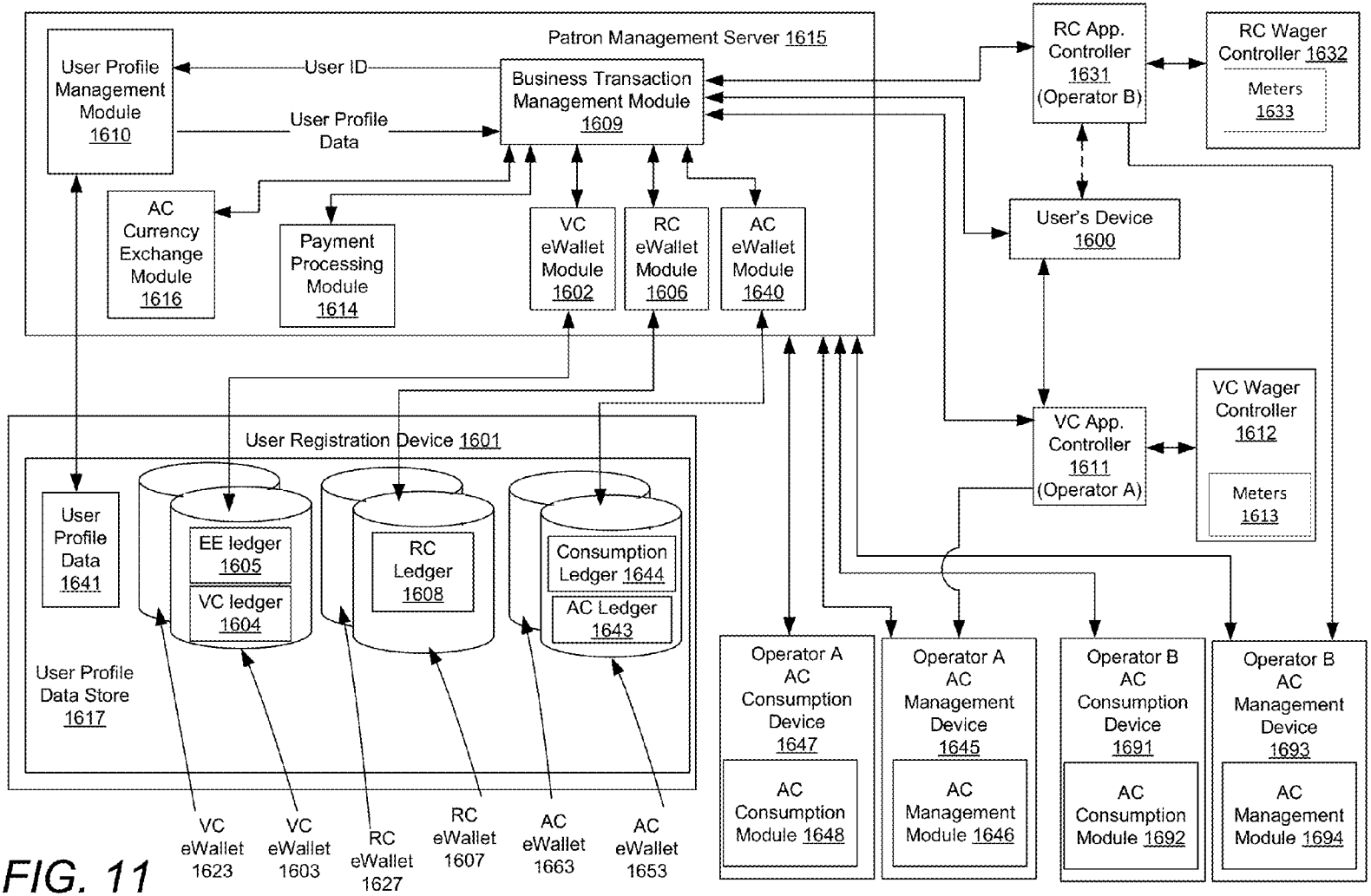
FIG. 11 is a diagram of components of an application credit earning interleaved wagering system in accordance with various embodiments of the invention.

A user's actions and/or decisions can affect functions of an application credit management device (e.g., 1645 and 1693 of FIG. 11) that allocates AC based on application telemetry generated by the interactive application executed by an interactive controller (e.g., an interactive controller of user's device 1600 of FIG. 11), a wager controller (e.g., one of wager controller 1612 and 1632 of FIG. 11) and an application controller (e.g., one of application controller 1611 and 1631 of FIG. 11).

In some embodiments, users can use VC to purchase EE. In embodiments, users can use RC to purchase EE.

In embodiments, a user's AC is recorded in an AC eWallet for the user. A user's AC eWallet is generated in connection with a user registration process.

User Registration, User Profiles and eWallets

Figure 10:
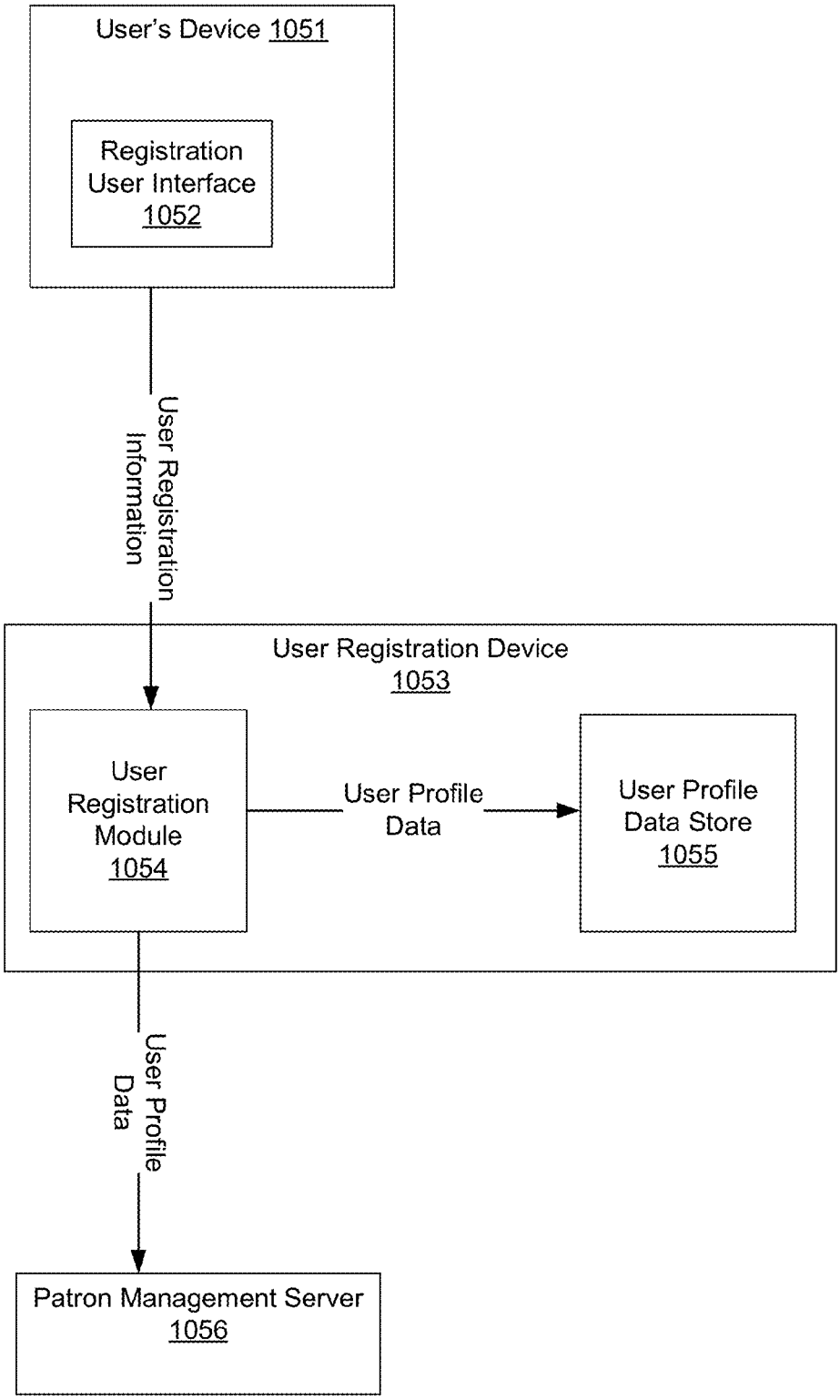
FIG. 10 is a diagram of components of an application credit earning interleaved wagering system in accordance with various embodiments of the invention.

In an example embodiment, user registration is performed by using a user registration user interface (e.g., 1052 of FIG. 10) in connection with a user registration module (e.g., 1054 of FIG. 10). In the example embodiment, a processor of a user's device (e.g., 1051 of FIG. 10) executes processor-executable instructions that when executed, control the user's device to provide the user registration user interface. User registration information is received by the user's device via the user registration user interface.

The user's device provides the received user registration information to the user registration module (e.g., 1054 of FIG. 10), which generates user profile data based on the received user registration information. In an example embodiment, the user profile data includes authorization credentials for the application credit earning interleaved wagering system. In some embodiments, the user profile data includes user contact information, such as, an e-mail address, a phone number, a mailing address, and social network account information. During operation of the application credit earning interleaved wagering system, the user profile data is updated to include application score data, data concerning controlled entities (such as characters used by a user in application credit earning interleaved wagering system interactive application gameplay), tournament reservation data, and data identifying elements, virtual credits (VC), and AC associated with the user.

At least one eWallet is associated with each user of the application credit earning interleaved wagering system. In the example embodiment, user profile data of a user is associated with at least one eWallet for the user.

In some embodiments, the enabling elements (EE) (including elements acquired from in-app purchases), virtual credits (VC), and AC are managed by at least one user eWallet, and the user profile data includes information for accessing each user eWallet. In some embodiments, the enabling elements (EE) (including elements acquired from in-app purchases), virtual credits (VC), and AC are managed by a user eWallet, and the user profile data includes each user eWallet.

In some embodiments, the user registration information includes payment information for in-app purchases (e.g., of elements and VC), and the user registration module includes the payment information in the user profile data.

In the example embodiment, in a case where real money wagering is enabled, the user registration module (e.g., 1054 of FIG. 10) generates real money wagering identification information, for identifying the user in accordance with real money wagering regulations of one or more real money wagering jurisdictions. In some embodiments, the user registration information includes real money wagering payment information for purchase of RC, and the user registration module includes the real money wagering payment information in the user profile data. During operation of a real money wagering mechanic, the user profile data is updated to include information related to RC. In some embodiments, the RC, along with enabling elements (EE) (including elements acquired form in-app purchases), virtual credits (VC), and AC are managed by at least one user wallet, and the user profile data includes information for accessing each user wallet. In some embodiments, the RC, along with the enabling elements (EE) (including elements acquired form in-app purchases), virtual credits (VC), and AC are managed by at least one user wallet, and the user profile data includes each user wallet.

In the example embodiment, registration for real money wagering is performed in a case where the user's device (e.g., 1051 of FIG. 10) is communicatively coupled with a real money wagering application controller. For example, in a case where the user's device enters a real money wagering jurisdiction and a real money wagering application controller is selected, the user's device provides a real money wagering user registration user interface (e.g., 1052 of FIG. 10) to perform user registration for real money wagering by using the selected application controller. In some embodiments, registration for real money wagering is performed in a case where the user's device (e.g., 1051 of FIG. 10) is not communicatively coupled with a real money wagering application controller. In an example embodiment, a user can be pre-registered for real money wagering prior to the user's device entering a real money wagering jurisdiction, such that real money wagering can be seamlessly enabled upon entering the real money wagering jurisdiction. In some embodiments, the pre-registration is an application controller-specific pre-registration in which the user is registered for real money wagering with a specific application controller (e.g., an application controller in a specific jurisdiction or an application controller operated by a specific real money wagering operator). In some embodiments, the pre-registration is a universal pre-registration in which the user is registered for real money wagering with any real money wagering application controller.

In the example embodiment, a user registration device (e.g., 1053 of FIG. 10) external to the user's device includes the user registration module. In more detail, the user registration device stores processor-executable instructions that when executed by the processor of the user registration device, control the user registration device to provide the functionality of the user registration module, which generates user profile data based on received user registration information. The user registration device is controlled by one of a publisher of the interactive application, a publisher of the application credit earning interleaved wagering system, a publisher of the wagering mechanic, an operator of the interactive application, an operator of the application credit earning interleaved wagering system, and an operator of the real money wagering mechanic.

In the example embodiment, the user registration module stores the generated user profile data in a user profile data store (e.g., 1055 of FIG. 10). The user profile data store is controlled by one of a publisher of the interactive application, a publisher of the application credit earning interleaved wagering system, a publisher of the real money game, an operator of the interactive application, an operator of the application credit earning interleaved wagering system, and an operator of the real money wagering mechanic. In some embodiments, a patron management server (e.g., 1056 of FIG. 10) stores the generated user profile data in a user profile data store.

In the example embodiment, after the user registration module generates the user profile data, the user registration module registers the user profile data with a patron management server (e.g., 1056 of FIG. 10).

User registration, as discussed above, is illustrated in FIG. 10. As illustrated in FIG. 10, the user's device 1051 provides a registration user interface 1052 for receiving user registration information (e.g., interactive application user registration information, real money wagering user registration information, or any combination of interactive application user registration information and real money wagering user registration information). The user's device 1051 provides user registration information received via the registration user interface 1052 to a user registration device 1053. A user registration module 1054 of the user registration device 1053 generates user profile data based on the user registration information received from the user's device 1051. The user registration module 1054 stores the generated user profile data in a user profile data store 1055. The user registration module 1054 also registers the generated user profile data with a patron management server 1056.

The user registration device 1053 is controlled by one of a publisher of the interactive application, a publisher of the application credit earning interleaved wagering system, a publisher of the real money wagering mechanic, an operator of the interactive application, an operator of the application credit earning interleaved wagering system, and an operator of the real money wagering mechanic. In some embodiments, the patron management server 1056 is controlled by an operator of the application credit earning interleaved wagering system.

In some embodiments, the user registration device 1053 includes one or more of an application controller and a wager controller. In some embodiments, a patron management server (e.g., 1056 of FIG. 10) stores the generated user profile data in a user profile data store.

—eWallets: Overview—

As described herein, at least one eWallet is associated with each user of the application credit earning interleaved wagering system. In the example embodiment, user profile data of a user is associated with at least one eWallet for the user.

The example embodiment involves use of three wallets for each user: a virtual credit (VC) eWallet, a real credit (RC) eWallet, and an AC eWallet. In the example embodiment, the patron management server manages each eWallet.

In the example embodiment, the use of both a virtual credit eWallet for VC and a real credit eWallet for RC allows both VC and RC to be used in a session of the application credit earning interleaved wagering system. That is, a single session of the application credit earning interleaved wagering system can include interaction in virtual credit mode, and in real credit mode.

FIG. 11 illustrates management of user eWallets by the patron management server 1615, according to the example embodiment. As shown in FIG. 11, the patron management server 1615 includes a business transaction management module 1609, a virtual credit (VC) eWallet module 1602, a real credit (RC) eWallet module 1606, an application credit (AC) eWallet module 1640, a user profile management module 1610, a payment processing module 1614, and an AC currency exchange module (ACE) 1616.

As illustrated in FIG. 11, the patron management server 1615 is communicatively coupled to the user's device 1600, a VC application controller 1611 (of Operator A), an RC application controller 1631 (of Operator B), the user profile data store 1617 (of the user registration device 1601 of FIG. 10), an AC management device 1645 (of Operator A), an AC consumption device 1647 (of Operator A), an AC management device 1693 (of Operator B), and an AC consumption device 1691 (of Operator B).

The VC application controller 1611 (of Operator A) is communicatively coupled to a VC wager controller 1612 having one or more credit meters 1613, and the AC management device 1645 (of Operator A). The VC application controller 1611 (of Operator A) provides application telemetry to the AC management device 1645 (of Operator A). As shown in FIG. 11, the user's device 1600 is operating the application credit earning interleaved wagering system in an Operator A domain, and thus the user's device 1600 is communicatively coupled to the VC application controller 1611 of Operator A.

The RC application controller 1631 (of Operator B) is communicatively coupled to an RC wager controller 1632 having one or more credit meters 1633, and the AC management device 1693 (of Operator B). The RC application controller 1631 (of Operator B) provides application telemetry to the AC management device 1693 (of Operator B). As shown in FIG. 11, since the user's device 1600 is operating the application credit earning interleaved wagering system in the Operator A Domain, the user's device 1600 is not communicatively coupled to the RC application controller 1631 (of Operator B), as represented by the dashed line. In operation, in a case where the user's device 1600 is located in a jurisdiction that allows real money wagering, the user's device 1600 can communicatively couple with the RC application controller 1631 to provide real money wagering.

In the example embodiment of FIG. 11, when a user is registered by the user registration device 1601 (of FIG. 10), a VC eWallet, an RC eWallet, and an AC eWallet are added to the user profile data store 1617 in association with the user profile data for the user. In some embodiments, an RC eWallet for a user is not added to the user profile data store until the user registers for real money wagering.

In the example embodiment of FIG. 11, a user's VC Wallet, RC eWallet, and AC eWallet are associated with the user by using a user ID.

As illustrated in FIG. 11, the user profile data store 1617 includes two VC eWallets, two RC eWallets, and two AC eWallets. VC eWallet 1603, RC eWallet 1607, and AC eWallet 1653 are for a first user having a first user ID, and VC eWallet 1623, RC eWallet 1627, and AC eWallet 1663 are for a second user having a second user ID. During operation, as additional users are registered by the user registration device 1601 (of FIG. 10), additional VC eWallets, RC eWallets, and AC eWallets are added to the user profile data store 1617.

—Virtual Credit eWallet—

The virtual credit (VC) eWallet module 1602 manages each virtual credit eWallet (e.g., 1603 and 1623 of FIG. 11). The virtual credit eWallet for each user is stored in a processor-readable format, and each virtual credit eWallet includes a virtual credit ledger (e.g., VC ledger 1604 of FIG. 11). The virtual credit ledger (e.g., 1604) records at least virtual credit (VC) debit transactions, VC credit transactions, and a VC balance for a respective user. The VC eWallet module 1602 includes processor-executable instructions that when executed, control the patron management server 1615 to record VC debit transactions for a user in the VC ledger of the user, record VC credit transactions for the user in the VC ledger of the user, update the VC balance of the VC ledger for the user, and provide the VC balance of the VC ledger for the user.

The VC eWallet module 1602 records VC credit transactions for a user based on real value received from the user via the payment processing module 1614, VC received (e.g., cashed-out) from a credit meter 1613 of a virtual credit wager controller 1612 used in a session of the user, and VC received from the user's sale or redemption of EE.

The VC eWallet module 1602 records VC debit transactions for a user based on VC added (e.g., cashed-in) to the credit meter 1613 of the wager controller 1612 used in a session of the user, and VC used for a user's purchase of EE.

In the example embodiment, VC cannot be exchanged for real value (e.g., redeemed for real currency), and the VC eWallet module 1602 is prohibited from performing operations to exchange VC for real value.

In the example embodiment, the VC eWallet module 1602 includes processor-executable instructions that when executed, control the patron management server 1615 to prohibit recordation of VC debit transactions based on real value received by the user. In more detail, responsive to a request to record a VC debit transaction, the VC eWallet module 1602 determines whether the VC debit transaction relates to VC added (e.g., cashed-in) to the credit meter 1613 of the wager controller 1612 used in a session of the user or VC used for a user's purchase of EE. In the example embodiment, if the request to record the VC debit transaction does not specify that the VC debit transaction relates to VC added (e.g., cashed-in) to the credit meter 1613 of the wager controller 1612 used in a session of the user or VC used for a user's purchase of EE, then the VC eWallet module 1602 does not record the VC debit transaction. In the example embodiment, in the case where the VC eWallet module 1602 does not record the VC debit transaction, the VC eWallet module 1602 sends an error message to the requestor of the VC debit transaction recordation request.

In the example embodiment, each virtual credit eWallet (e.g., 1603, 1623) includes an entertainment element (EE) ledger (e.g., 1605). The EE ledger records at least one of EE purchase transactions, EE sale transactions, EE exchange transactions, EE consumption transactions, and an inventory of EE (e.g., items owned, amount of a particular EE owned) for a respective user. The VC eWallet module 1602 includes processor-executable instructions that when executed, control the patron management server 1615 to record EE purchase transactions for a user, record EE sale transactions for the user, record EE exchange transactions for the user, record EE consumption transactions for the user, update an inventory of the user's EE (e.g., items owned, amount of a particular EE owned), and provide the inventory of the user's EE.

The VC eWallet module 1602 records EE purchase transactions for a user based on real value received by the seller from the user via the payment processing module 1614 or VC received by the seller from the user.

The VC eWallet module 1602 records EE sale transactions in which EE is sold for VC. In the example embodiment, EE cannot be exchanged for real value (e.g., redeemed for real currency), and the VC eWallet module 1602 is prohibited from performing operations to exchange EE for real value.

—Real Credit eWallet—

The real credit eWallet module 1606 manages each real credit (RC) eWallet (e.g., 1607 and 1627 of FIG. 11). The real credit eWallet for each user is stored in a processor-readable format, and each real credit eWallet includes a real credit ledger (e.g., 1608 of FIG. 11). The real credit ledger records at least real credit (RC) debit transactions, RC credit transactions, and a RC balance for a respective user. The RC eWallet module 1606 includes processor-executable instructions that when executed, control the patron management server 1615 to record RC debit transactions for a user in the RC ledger of the user, record RC credit transactions for the user in the RC ledger of the user, update the RC balance of the RC ledger for the user, and provide the RC balance of the RC ledger for the user.

The RC eWallet module 1606 records RC credit transactions for a user based on real value received from the user via the payment processing module 1614, and RC received (e.g., cashed-out) from a credit meter 1633 of a real credit wager controller 1632 used in a session of the user.

In the example embodiment, VC cannot be exchanged for real value (e.g., redeemed for real currency), and the RC eWallet module 1606 is prohibited from recording RC credit transactions based on VC debited from the user.

In the example embodiment, the RC eWallet module 1606 includes processor-executable instructions that when executed, control the patron management server 1615 to prohibit recordation of RC credit transactions based on VC debited from the user. In more detail, responsive to a request to record an RC credit transaction, the RC eWallet module 1606 determines whether the RC credit transaction relates to real value received from the user via the payment processing module 1614 or RC received (e.g., cashed-out) from a credit meter of a real credit wager controller. In the example embodiment, if the request to record the RC credit transaction does not specify that the RC credit transaction relates to real value received from the user via the payment processing module 1614 or RC received (e.g., cashed-out) from a credit meter of a real credit wager controller, then the RC eWallet module 1606 does not record the RC credit transaction. In the example embodiment, in the case where the RC eWallet module 1606 does not record the RC credit transaction, the RC eWallet module 1606 sends an error message to the requestor of the RC credit transaction recordation request.

In the example embodiment, the patron management server 1615 includes processor-executable instructions that when executed control the patron management server 1615 to prohibit reception of real value via the payment processing module 1614 in connection with an exchange of VC for real value, and to refund real value received via the payment processing module 1614 that is determined to have been received in connection with an exchange of VC for real value. In the example embodiment, the patron management server 1615 determines whether real value received for a user via the payment processing module 1614 relates to an exchange of VC for real value based on information recorded in the VC ledger (e.g, the VC ledger 1604) and the RC ledger (e.g., the RC ledger 1608) of the user.

The RC eWallet module records RC debit transactions for a user based on RC added (e.g., cashed-in) to the credit meter 1633 of the wager controller 1632 used in a session of the user, RC used for a user's purchase of EE or VC, and RC exchanged for real value (e.g., redeemed for real currency). In the example embodiment, the RC is exchanged for real value by using the payment processing module 1614.

In some embodiments, the payment processing module 1614 used in connection with real value transactions related to EE, VC and RC is one of an iTunes payment processing module, an Android payment processing module, a Pay-Pal payment processing module, a payment processing module provided by an operator of the application credit earning interleaved wagering system, or any other comparable payment processing module. In some embodiments, the payment processing module 1614 receives payment from a user via at least one of a credit card, a bank account, a debit card, a real money wagering voucher, a mobile device virtual wallet (e.g., an iOS virtual wallet, an Android virtual wallet, and the like), and a real money wagering smart card.

—AC eWallet—

The application credit (AC) eWallet module 1640 manages each application credit (AC) eWallet (e.g., 1653 and 1663 of FIG. 11). The AC eWallet for each user is stored in a processor-readable format, and each AC eWallet includes an AC ledger (e.g., AC ledger 1643 of FIG. 11). The AC ledger (e.g., 1643) records at least AC debit transactions, AC credit transactions, and an AC balance for a respective user. The AC eWallet module 1640 includes processor-executable instructions that when executed, control the patron management server 1615 to record AC debit transactions for a user in the AC ledger of the user, record AC credit transactions for the user in the AC ledger of the user, update the AC balance of the AC ledger for the user, and provide the AC balance of the AC ledger for the user.

The AC eWallet module 1640 records AC credit transactions for a user based on skillful interaction with the interactive application, as determined by the user's application telemetry. In the example embodiment, an AC management device (e.g., one of the AC management devices 1645 and 1693) generates an AC entry that specifies an amount of AC earned by the user based on skillful game play as determined by application telemetry received by the AC management device (e.g., one of the AC management devices 1645 and 1693) from the VC application controller 1611 (or the RC application controller 1631 in the case of a real money wagering jurisdiction). The AC management device (e.g., one of the AC management devices 1645 and 1693) provides the generated AC entry to the patron management server 1615 which uses the AC eWallet module to record a corresponding AC credit transaction in the user's AC eWallet (e.g., one of AC eWallet 1653 and 1663).

In the example embodiment, VC cannot be used to purchase AC, and the AC eWallet module 1640 is prohibited from performing operations to exchange VC for AC. In the example embodiment, AC cannot be allocated to the user based on a result of the wagering mechanic, and the AC eWallet module 1640 is prohibited from performing operations to award AC based on results of the wagering mechanic.

In the example embodiment, the user's device 1600, an application controller (e.g., one of the application controller 1611 and the application controller 1631), and a wager controller (e.g., one of the wager controller 1612 and the wager controller 1632) are prohibited from awarding AC to a user.

In the example embodiment, the AC eWallet module 1640 includes processor-executable instructions that when executed, control the patron management server 1615 to prohibit recordation of AC credit transactions in connection with consumption of VC, prohibit recordation of AC credit transactions in connection with results of the wagering mechanic (e.g., the wagering mechanic provided by an wager controller, e.g., the wager controller 1632 or the wager controller 1612), and prohibit any one of the user's device 1600, an application controller (e.g., one of the application controller 1611 and the application controller 1631), and an wager controller (e.g., one of the wager controller 1612 and the wager controller 1632) from awarding AC to a user.

In more detail, responsive to a request to record a AC credit transaction, the AC eWallet module 1640 determines whether the AC credit transaction represents an award of AC to a user based on skillful interaction with the interactive application as determined by the user's application telemetry, and determines whether the AC credit transaction relates to an award of AC by a AC management module (e.g., one of the user management modules 1646 and 1694) that is separate from the user's device 1600, an application controller (e.g., one of the application controller 1611 and the application controller 1631), and an wager controller (e.g., one of the wager controller 1612 and the wager controller 1632).

In the example embodiment, if the request to record the AC credit transaction specifies application telemetry used to award the AC to the user, then the AC eWallet module 1640 determines that the AC credit transaction represents an award of AC to a user based on skillful interaction with the interactive application.

In the example embodiment, the AC eWallet module 1640 determines whether the AC credit transaction relates to an award of AC by an AC management module that is separate from the user's device 1600, an application controller, and a wager controller based on information provided in connection with the request to record the AC credit transaction. In the example embodiment, the requester of the request to record the AC credit transaction provides a digital signature that identifies the source of the allocation of AC to the user. Based on this digital signature, the AC eWallet module 1640 determines whether the AC credit transaction relates to an award of AC by an AC management module that is separate from the user's device 1600, an application controller, and a wager controller. For example, in a case where the AC management device 1645 allocates the AC to the user, the AC management device 1645 provides a digital signature that identifies the AC management module 1646 as the allocator of the AC. During establishment of communication between the patron management server 1615 and the AC management device 1645, the patron management server 1615 confirms that the AC management module 1646 of the AC management device 1645 is separate from the user's device 1600, an application controller, and an wager controller, and stores connection information that identifies the AC management module 1646 as being separate from the user's device 1600, an application controller, and an wager controller. The AC eWallet module 1640 compares the digital signature provided by the AC management device 1645 with the stored connection information to determine that the AC credit transaction relates to an award of AC by an AC management module that is separate from the user's device 1600, an application controller, and a wager controller.

In a case where the AC eWallet module 1640 determines that the AC credit transaction does not represent an award of AC to a user based on skillful interaction with the interactive application, or does not relate to an award of AC by an AC management module that is separate from the user's device 1600, an application controller, and an wager controller, then the AC eWallet module 1640 does not record the AC credit transaction. In the example embodiment, in the case where the AC eWallet module 1640 does not record the AC credit transaction, the AC eWallet module 1640 sends an error message to the requestor of AC recordation request.

In a case where the AC eWallet module 1640 determines that the AC credit transaction represents an award of AC to a user based on skillful interaction with the interactive application, and relates to an award of AC by a AC management module that is separate from the user's device 1600, an application controller, and an wager controller, then the AC eWallet module 1640 records the AC credit transaction.

The AC eWallet module 1602 records AC debit transactions for a user based on AC consumption transactions performed by the patron management server 1606 in conjunction with a AC consumption device (e.g., one of the AC consumption devices 1647 and 1691).

In the example embodiment, each AC eWallet (e.g., 1653, 1663) includes an AC consumption ledger (e.g., 1644). The AC consumption ledger records at least AC consumption transactions, and an inventory of economic value items acquired in connection with AC consumption transactions (e.g., economic value items owned, amount of a particular economic value item owned) for a respective user. The AC eWallet module 1640 includes processor-executable instructions that when executed, control the patron management server 1615 to record AC consumption transactions for a user, and update an inventory of the user's economic value items (e.g., economic value items owned, amount of a particular economic value item owned), and provide the inventory of the user's economic value items.

The AC eWallet module 1640 records AC consumption transactions for a user based on one or more economic value items transferred to the user and an amount of AC consumed to transfer the one or more economic value items to the user.

—Business Transaction Management Module—

In the example embodiment, the business transaction management module 1609 manages business transactions. In some embodiments, a business transaction is a transaction involving one or more of VC, RC, AC and EE that is performed in response to a user instruction provided by the user's device (e.g., 1600) or a wager decision provided by an application controller (e.g., 1611, 1631). Business transactions may include VC or RC cash-in to a wagering mechanic provided by an wager controller (e.g., 1612, 1632), VC or RC cash-out from a wagering mechanic provided by an wager controller (e.g., 1612, 1632), purchase of EE using VC or RC, sale of EE for VC, purchase of VC using RC, exchange of RC for real value, and consumption of AC. Business transactions can include sub-transactions that involve one or more of the VC eWallet, the RC eWallet and the AC eWallet of the user. In an example embodiment, a business transaction for a user can include a first sub-transaction that involves the VC eWallet (e.g., 1603, 1623) of the user and a second sub-transaction that involves the RC eWallet (e.g., 1607, 1627) of the user. Some business transactions for a user involve only one of the VC eWallet and the RC eWallet of the user.

The business transaction management module 1609 uses one or more of the RC eWallet module 1606, the VC eWallet module 1602 and the AC eWallet module 1640 to perform a business transaction for a user.

—AC Management Devices—

The AC management devices 1645 and 1693 each allocate AC to a user based on skillful interaction with the interactive application, in accordance with rules defined for an application domain of the application credit earning interleaved wagering system. The application domain provides standardization across operators of the application credit earning interleaved wagering system, such that each operator awards AC to users in a same manner. The AC management devices 1645 and 1693 determine skillful game play based on application telemetry of the interactive application. The AC management device 1645 is operated by a first operator of the application credit earning interleaved wagering system, Operator A. The AC management device 1693 is operated by a second operator of the application credit earning interleaved wagering system, Operator B.

In some embodiments, there can be any number of operators of the application credit earning interleaved wagering system, and each operator can allocate AC to a user based on skillful interaction with the interactive application. In some embodiments, each operator can provide one or more AC management devices to allocate AC to a user.

In the example embodiment, the AC management device 1645 includes an AC management module 1646, and the AC management device 1693 includes an AC management module 1694. Each of the AC management module 1646 and the AC management module 1694 includes processor-executable instructions that when executed, control the respective AC management device to receive a user's application telemetry (for the interactive application) from an application controller that is being used by the user and that is communicatively coupled with the user's device 1600 (e.g, one of the VC application controller 1611 and the RC application controller 1631) and allocate AC to the user based on skillful interaction with the interactive application, as determined by the received application telemetry and in accordance with the rules defined for the game domain. Each of the AC management module 1646 and the AC management module 1694 generates an AC entry that specifies the amount of AC allocated to the user (e.g., earned by the user) and provides the generated AC entry to the patron management server 1615. In the example embodiment, the AC entry specifies the operator that allocates the AC to the user, the application telemetry used to allocate the AC, and a digital signature that identifies the AC management module (e.g., one of the AC management module 1646 and the AC management module 1694) as the allocator of the AC. In some embodiments, the AC entry does not specify the operator that allocates the AC to the user. In some embodiments, the AC entry does not specify the digital signature. The patron management server 1615 uses AC eWallet module 1640 to record the AC entry for the user in an AC ledger of the user's AC eWallet (e.g., the AC ledger 1643).

In the example embodiment, each AC management module (e.g., the AC management modules 1646 and 1694) is separate from the user's device 1600, the application controllers (e.g., the application controllers 1611 and 1631) and the wager controllers (e.g., the wager controllers 1612 and 1632) of the application credit earning interleaved wagering system, and the user's device 1600, the application controllers (e.g., the application controllers 1611 and 1631) and the wager controllers (e.g., the wager controllers 1612 and 1632) do not directly allocate AC to a user.

In some embodiments of the example embodiment, AC management modules of different operators can be included in a same device. For example, the AC management module 1646 and the AC management module 1694 can be included in a single AC management device.

In some embodiments, AC management modules can be included in one or more application controllers. In some embodiments, an application controller and an AC management module can be included on a same device, such as, for example, an application controller server.

In some embodiments, AC management modules can be included in the patron management server 1615.

—AC Consumption Devices—

The AC consumption device 1647 is operated by Operator A, and the AC consumption device 1691 is operated by Operator B. The AC consumption devices 1647 and 1691 each provide an AC consumption user interface that identifies items that a user can acquire from the respective operator in exchange for consuming AC, and each AC consumption device processes AC consumption requests in connection with user acquisition of items selected by using the AC consumption user interface.

In some embodiments, the patron management server 1615 controls one or more of the AC consumption devices 1647 and 1691 to automatically award economic value items to users and automatically consume an amount of AC that corresponds to the awarded economic value items, in accordance with AC economy objectives. For example, the patron management server 1615 can control one or more of the AC consumption devices 1647 and 1691 to affect AC consumption to address AC inflation in the game domain.

In some embodiments, there can be any number of operators of the application credit earning interleaved wagering system, and each operator can independently process AC consumption requests. In some embodiments, each operator can provide one or more AC consumption devices to allow a user to acquire economic value items in exchange for consuming AC.

In the example embodiment, the AC consumption device 1647 includes an AC consumption module 1648, and the AC consumption device 1691 includes an AC consumption module 1692. Each of the AC consumption module 1648 and the AC consumption module 1692 includes processor-executable instructions that when executed, control the respective AC consumption device to provide an AC consumption user interface to the user's device 1600 via the patron management server 1615. The AC consumption user interface identifies items that a user of the device 1600 can acquire from the respective operator in exchange for consuming AC, and receives a user selection of one or more economic value items that the user of the device 1600 requests to acquire.

In the example embodiment, economic value items include at least one of a financial derivative, a security, a virtual currency, a tournament entry ticket, and an ownership interest in a result of a virtual currency mining operation, and the like. In the example embodiment, economic value items include items whose economic value is volatile. In the example embodiment, the economic value of an economic value item is represented in units of Universal Application Currency (UAC).

In the example embodiment, the AC consumption module (e.g., one of AC consumption module 1648 and the AC consumption module 1692) sends a request to the patron management sever 1615 to use the AC eWallet module 1640 to determine an economic value of the total amount of the user's AC in terms of UAC. Responsive to reception of the value of the user's AC in terms of UAC, the AC consumption module controls display of the AC consumption user interface such that the AC consumption user interface displays economic value items that the user can acquire based on the value of the user's AC in terms of UAC.

For example, a user with AC worth 1000 UAC can acquire a single economic value item worth 1000 UAC, or 10 economic value items worth 100 UAC. In such a case, the AC consumption module controls display of the AC consumption user interface to indicate that the single economic value item worth 1000 UAC and the economic value items worth 100 UAC are available to the user of the user's device 1600. Since an economic value item worth 2000 UAC is not available to the user, the AC consumption module can either control display of the AC consumption user interface to not display this item, or to display this item with a user-perceivable indication that it cannot be acquired.

Each of the AC consumption module 1648 and the AC consumption module 1692 includes processor-executable instructions that when executed, control the respective AC consumption device to receive an AC consumption request from the user's device 1600 (via the patron management server 1615 and the AC consumption user interface) and process the AC consumption request. Each of the AC consumption module 1648 and the AC consumption module 1692 processes AC consumption requests by using the patron management server 1615 to determine whether the user has sufficient AC in the user's AC eWallet (e.g., the eWallet 1653) to acquire the requested economic value item (or items). In a case where the user's AC eWallet has sufficient AC for the acquisition, then the AC consumption module (e.g., one of AC consumption module 1648 and the AC consumption module 1692) effects transfer of all requested economic value items to the user, and requests the patron management sever 1615 to use the AC eWallet module 1640 to update the AC ledger (e.g., 1643) of the user and the AC consumption ledger (e.g., 1644) of the user to reflect the AC consumption transaction. In more detail, the AC consumption module (e.g., one of AC consumption module 1648 and the AC consumption module 1692) generates a AC consumption entry that identifies the economic value item acquired, the operator processing the AC consumption transaction, AC consumed, and an operator (if any) receiving an economic benefit from the transaction. The AC consumption module provides the generated AC consumption entry to the patron management server 1615, and the patron management sever 1615 uses the information included in the generated AC consumption entry to update the AC ledger (e.g., 1643) of the user and the AC consumption ledger (e.g., 1644) of the user to reflect the AC consumption transaction.

In the example embodiment, each AC consumption module (e.g., the AC consumption modules 1648 and 1692) is separate from the user's device 1600, the application controllers (e.g., the application controllers 1611 and 1631) and the wager controllers (e.g., the wager controllers 1612 and 1632) of the application credit earning interleaved wagering system, and the user's device 1600, the application controllers (e.g., the application controllers 1611 and 1631) and the wager controllers (e.g., the wager controllers 1612 and 1632) do not process AC consumption transactions.

In some embodiments of the example embodiment, AC consumption modules of different operators can be included in a same device. For example, the AC consumption module 1648 and the AC management module 1692 can be included in a single AC consumption device.

In some embodiments, AC consumption modules can be included in one or more application controllers. In some embodiments, an application controller and an AC consumption module can be included on a same device, such as, for example, an application controller server.

In some embodiments, AC consumption modules can be included in the patron management server 1615.

In some embodiments, an AC management module and an AC consumption module can be included on a same device, such as, for example, an application controller server or the patron management server 1615.

—Economic Value of AC—

As described herein, in some embodiments, an economic value of AC may be defined in terms of UAC. Economic value of AC may be based on an amount of real value that an operator awarding the AC allocates to its AC pool. In the example embodiment, the AC currency exchange module 1616 determines an economic value (in terms of UAC) for AC awarded by an operator by using the following equations:

UAC=[AC awarded by an Operator]*[Economic Value Coefficient for the Operator] Equation 1:

Economic Value Coefficient for Operator=([Total AC Pool]/[Total AC earned in application domain by all users])*([Operator Domain AC Pool]/[Total AC Pool])=[Operator Domain AC Pool]/[Total AC earned in application domain by all users] Equation 2:

The [Operator Domain AC Pool] is an amount of real value that the operator allocates to its AC pool. The operator domain is the domain in which an operator operates. In the example of an application credit earning interleaved wagering system operated by more than one operator, there are many operator domains included with an application domain of the application credit earning interleaved wagering system. In the example embodiment, the real value that an operator allocates is the benefit received by the operator for operating the application credit earning interleaved wagering system. In the example embodiment, an operator's benefit includes at least one of real value received by the operator in connection with a purchase of virtual credit (VC), real value received by the operator in connection with an in-app purchase, and real value received by the operator for providing access to the application credit earning interleaved wagering system.

The [Total AC Pool] is the sum of the real value included in the AC pools of all operator domains included in the game domain.

In the example embodiment, the patron management server 1615 provides the AC currency exchange module 1616 with the operator domain AC pool and the total AC earned in the application domain by all users. The patron management server 1615 determines the total AC earned by all users in the application domain by using the AC eWallet module 1640 to access the AC eWallets of all users in the application domain, and the patron management server 1615 determines an amount that operator of the operator domain contributes to the AC pool by sending a request to the AC consumption module of the operator (e.g., one of the AC consumption module 1648 and the AC consumption module 1692).

—Allocating Funds in the AC Pool—

An operator uses the funds in the AC pool to acquire economic value items. In an example embodiment, at the end of the month, the operator may purchase economic value items using funds in the AC pool, and allow users to acquire these economic value items by consuming AC. In the example embodiment, the economic value of an economic value item is represented in units of Universal Application Currency (UAC).

The value and number of economic value items available from the operator is determined based on the funding of the operator's AC pool. The more funds the operator allocates to its AC pool, the greater the selection and value of the economic value items provided by the operator. Therefore, an operator that allocates more funds to the AC pool is more likely to attract users. Each operator can allocate funds in the AC pool as needed to achieve desired objectives. In the example embodiment, an operator can determine what to acquire with the AC pool funds, and how much UAC to assign to each economic value item. In an example embodiment, an operator with a $100,000 AC pool can use all of the AC pool funds to buy a single economic value item, and the operator can arbitrarily determine the value of this economic value item in terms of UAC. An operator's allocation of AC pool funds and assignment of UAC values determine how often users complete AC consumption transactions, and in what amounts. In an example embodiment, if an operator assigns high UAC values to economic value items, then it will take longer for users to acquire enough AC to acquire these high value items. On the other hand, if an operator assigns lower UAC values to economic value items, users will be able to acquire these items more quickly and more often. If an operator allocates AC pool funds among a small number of high value economic value items, there may be a risk that the operator runs out of economic value items. Conversely, if an operator allocates AC pool funds among many small value economic value items, users might not be as loyal to the operator, and instead prefer to play with an operator that offers higher value items.

Because operators can determine what to acquire with the AC pool funds, and an amount of UAC to assign to each economic value item, it is possible for different operators to assign different UAC values to a same economic value item. Accordingly, the AC consumption service provides a free market system in which operators can compete with each other to attract users, and in which users are provided with many choices for consuming AC.

—Earning AC and Transferring AC Between Operator Domains—

Because operators can allocate different amounts to their respective AC pools, AC can have different economic values depending on the operator domain. In an example embodiment, if Operator A allocates 5% of its application benefit to its AC pool and Operator B allocates 10% of its application benefit to its AC pool, then the economic value of the AC awarded by Operator A can be less than the economic value of the AC awarded by Operator B.

In the example embodiment, to address differences in AC valuation across operator domains, when a user transfers to a new operator, the AC currency exchange module 1616 converts the user's AC earned in the previous operator domain into an amount of AC in an operator domain of the new operator, such that the converted AC amount in the new operator domain has an economic value that corresponds to the economic value of the AC earned in the previous operator domain.

In more detail, in the example embodiment, responsive to an AC entry for a user from an AC management module (e.g., the AC management modules 1646 and 1694) in connection with an award of AC to a user, the patron management server 1615 uses the AC currency exchange module 1616 to determine an amount of universal application currency (UAC) that corresponds to the amount of AC specified in the AC entry. The patron management server 1615 uses the AC eWallet module 1640 to record the determined amount of UAC in association with the AC entry for the user in an AC ledger (e.g., the AC ledger 1643) of the user's AC eWallet.

In the example embodiment, the determined amount of UAC represents the economic value of the AC awarded by the operator, as determined by the AC currency exchange module 1616.

Responsive to the user transferring to a new operator domain, the patron management server 1615 uses the AC currency exchange module 1616 to determine a corresponding amount of AC in the new operator domain.

In the example embodiment, the patron management server 1615 preserves the amount of UAC that corresponds to a user's AC in an operator domain when the user transfers to a new operator domain. In some embodiments, the patron management server 1615 does not preserve the amount of UAC that corresponds to a user's AC in an operator domain when the user transfers to a new operator domain.

In the example embodiment, when the user transfers to the new operator domain, the AC currency exchange module 1616 uses the following equations to determine an amount of AC in the new operator domain.

[AC in new operator domain]=[UAC determined for AC in previous operator domain]/[Economic Value Coefficient for New Operator] Equation 3:

Economic Value Coefficient for New Operator=([Total AC Pool]/[Total AC earned in application domain by all users])*([New Operator Domain AC Pool]/[Total AC Pool])=[New Operator Domain AC Pool]/[Total AC earned in application domain by all users] Equation 4:

In the example embodiment, the patron management server 1615 determines the total AC earned by all users in the application domain by using the AC eWallet module 1640, and the patron management server 1615 determines the new operator domain AC pool by sending a request to the AC consumption module of the new operator (e.g., one of the AC consumption module 1648 and the AC consumption module 1692).

The following tables illustrate AC conversion in the example embodiment. In the following example, there are three operators operating within the same application domain. Operator A operates the Operator A Domain, Operator B operates the Operator B Domain, and Operator C operates the Operator C Domain. Operator A contributes $100,000 to the AC pool, Operator B contributes $200,000 to the AC pool, and Operator C contributes $50,000 to the AC pool. In the example scenario, there are 6 users: User 1 and User 2 are in the Operator A Domain, User 3 and User 4 are in the Operator B Domain, and User 5 and User 6 are in the Operator C Domain.

Table 1 represents an exemplary state of the application credit earning interleaved wagering system after the AC management module 1146 awards User 1 100 AC in the Operator A Domain.

TABLE 1

| User | Operator | AC in current Operator Domain | UAC |
|---|---|---|---|
| User 1 | Operator A | 100 | 100,000 |
| User 2 | Operator A | 0 | 0 |
| User 3 | Operator B | 0 | 0 |
| User 4 | Operator B | 0 | 0 |
| User 5 | Operator C | 0 | 0 |
| User 6 | Operator C | 0 | 0 |

As shown in Table 1, there is a total of 100 of AC allocated to all of the users in the application domain. All of this 100 AC is awarded in the Operator A Domain. The AC currency exchange module 1141 determines the UAC value for User 1 by using the Equations 1 and 2 that are described above. More specifically, the AC currency exchange module 1141 calculates the UAC value for the 100 AC earned by User 1 as shown below:

User 1 UAC=[100 User1 AC in Operator A Domain]*[$100,000 Operator A AC Pool Contribution]/[100 of total AC after User 1 earns the 100 AC]=100,000 UAC Table 2 represents an exemplary state of the application credit earning interleaved wagering system after the AC management module 1194 awards User 3 100 AC in the Operator B Domain.

TABLE 2

| User | Operator | AC in current Operator Domain | UAC |
|---|---|---|---|
| User 1 | Operator A | 100 | 100,000 |
| User 2 | Operator A | 0 | 0 |
| User 3 | Operator B | 100 | 100,000 |
| User 4 | Operator B | 0 | 0 |
| User 5 | Operator C | 0 | 0 |
| User 6 | Operator C | 0 | 0 |

The AC currency exchange module 1141 calculates the UAC value for the 100 AC earned by User 3 as shown below:

User 3 UAC=[100 User3 AC in Operator B Domain]*[$200,000 Operator B AC Pool Contribution]/[200 of total AC after User 3 earns the 100 AC]=100,000 UAC Table 3 represents an exemplary state of the application credit earning interleaved wagering system after the AC management module 1646 awards User 2 100 AC in the Operator A Domain.

TABLE 3

| User | Operator | AC in current Operator Domain | UAC |
|---|---|---|---|
| User 1 | Operator A | 100 | 100,000 |
| User 2 | Operator A | 100 | 33,333 |
| User 3 | Operator B | 100 | 100,000 |
| User 4 | Operator B | 0 | 0 |
| User 5 | Operator C | 0 | 0 |
| User 6 | Operator C | 0 | 0 |

The AC currency exchange module 1616 calculates the UAC value for the 100 AC earned by User 2 as shown below:

User 2 UAC=[100 User2 AC in Operator A Domain]*[$100,000 Operator A AC Pool Contribution]/[300 of total AC after User 2 earns the 100 AC]=33,333 UAC Table 4 represents an exemplary state of the application credit earning interleaved wagering system after User 5 earns 100 AC in the Operator C Domain.

TABLE 4

| User | Operator | AC in current Operator Domain | UAC |
|---|---|---|---|
| User 1 | Operator A | 100 | 100,000 |
| User 2 | Operator A | 100 | 33,333 |
| User 3 | Operator B | 100 | 100,000 |
| User 4 | Operator B | 0 | 0 |
| User 5 | Operator C | 100 | 12,500 |
| User 6 | Operator C | 0 | 0 |

The AC currency exchange module 1616 calculates the UAC value for the 100 AC earned by User 5 as shown below:

User 5 UAC=[100 User5 AC in Operator C Domain]*[$50,000 Operator C AC Pool Contribution]/[400 of total AC after User 5 earns the 100 AC]=12,500 UAC Table 5 represents an exemplary state of the application credit earning interleaved wagering system after User 6 earns 100 AC in the Operator C Domain.

TABLE 5

| User | Operator | AC in current Operator Domain | UAC |
|---|---|---|---|
| User 1 | Operator A | 100 | 100,000 |
| User 2 | Operator A | 100 | 33,333 |
| User 3 | Operator B | 100 | 100,000 |
| User 4 | Operator B | 0 | 0 |
| User 5 | Operator C | 100 | 12,500 |
| User 6 | Operator C | 100 | 10,000 |

The AC currency exchange module 1616 calculates the UAC value for the 100 AC earned by User 6 as shown below:

User 6 UAC=[100 User6 AC in Operator C Domain]*[$50,000 Operator C AC Pool Contribution]/[500 of total AC after User 6 earns the 100 AC]=10,000 UAC Table 6 represents an exemplary state of the application credit earning interleaved wagering system after the AC management module 1694 awards User 4 100 AC in the Operator B Domain.

TABLE 6

| User | Operator | AC in current Operator Domain | UAC |
|---|---|---|---|
| User 1 | Operator A | 100 | 100,000 |
| User 2 | Operator A | 100 | 33,333 |
| User 3 | Operator B | 100 | 100,000 |
| User 4 | Operator B | 100 | 33,333 |
| User 5 | Operator C | 100 | 12,500 |
| User 6 | Operator C | 100 | 10,000 |

The AC currency exchange module 1616 calculates the UAC value for the 100 AC earned by User 4 as shown below:

User 4 UAC=[100 User4 AC in Operator B Domain]*[$200,000 Operator B AC Pool Contribution]/[600 of total AC after User 4 earns the 100 AC]=10,000 UAC Table 7 represents an exemplary state of the application credit earning interleaved wagering system after User 1 transfers to the Operator B Domain.

TABLE 7

| User | Operator | AC in current Operator Domain | UAC |
|---|---|---|---|
| User 1 | Operator B | 300 | 100,000 |
| User 2 | Operator A | 100 | 33,333 |
| User 3 | Operator B | 100 | 100,000 |
| User 4 | Operator B | 100 | 33,333 |
| User 5 | Operator C | 100 | 12,500 |
| User 6 | Operator C | 100 | 10,000 |

As shown in Table 7, the AC currency exchange module 1616 converts user 1's 100 AC in the Operator A Domain to 300 AC in the Operator B Domain after User 1 transfers to the Operator B Domain. Accordingly, there is a total of 800 of AC allocated to all of the users in the application domain after the conversion.

The AC in the Operator B Domain that corresponds to User 1's AC in the Operator A Domain is determined by using the Equations 3 and 4 that are described above. More specifically, the AC currency exchange module 1616 calculates AC in the Operator B Domain that corresponds to User 1's AC in the Operator A Domain as shown below:

User 1 AC in the Operator B Domain=[100,000 User1 UAC]/([$200,000 Operator B AC Pool Contribution]/[600 total AC prior to conversion])=300 AC in the Operator B Domain Table 8 represents an exemplary state of the application credit earning interleaved wagering system after User 2 transfers to the Operator B Domain.

TABLE 8

| User | Operator | AC in current Operator Domain | UAC |
|---|---|---|---|
| User 1 | Operator B | 300 | 100,000 |
| User 2 | Operator B | 133.33 | 33,333 |
| User 3 | Operator B | 100 | 100,000 |
| User 4 | Operator B | 100 | 33,333 |
| User 5 | Operator C | 100 | 12,500 |
| User 6 | Operator C | 100 | 10,000 |

As shown in Table 8, User 2's 100 AC in the Operator A Domain is converted to 133.33 AC in the Operator B Domain after User 2 transfers to the Operator B Domain. Accordingly, there is a total of 833.33 of AC allocated to all of the users in the application domain after the conversion.

The AC currency exchange module 1616 calculates AC in the Operator B Domain that corresponds to User 2's AC in the Operator A Domain as shown below:

User 2 AC in the Operator B Domain=[33,333 User2 UAC]/([$200,000 Operator B AC Pool Contribution]/[800 total AC prior to conversion])=133.33 AC in the Operator B Domain Table 9 represents an exemplary state of the application credit earning interleaved wagering system after User 5 transfers to the Operator B Domain.

TABLE 9

| User | Operator | AC in current Operator Domain | UAC |
|---|---|---|---|
| User 1 | Operator B | 300 | 100,000 |
| User 2 | Operator B | 133.33 | 33,333 |
| User 3 | Operator B | 100 | 100,000 |
| User 4 | Operator B | 100 | 33,333 |
| User 5 | Operator B | 52.08 | 12,500 |
| User 6 | Operator C | 100 | 10,000 |

As shown in Table 9, User 5's 100 AC in the Operator C Domain is converted to 52.08 AC in the Operator B Domain after User 5 transfers to the Operator B Domain. Accordingly, there is a total of 785.41 of AC allocated to all of the users in the application domain after the conversion.

The AC currency exchange module 1616 calculates AC in the Operator B Domain that corresponds to User 5's AC in the Operator C Domain as shown below:

User 5 AC in the Operator B Domain=[12500 User5 UAC]/([$200,000 Operator B AC Pool Contribution]/[833.33 total AC prior to conversion])=52.08 AC in the Operator B Domain Table 10 represents an exemplary state of the application credit earning interleaved wagering system after User 6 transfers to the Operator B Domain.

TABLE 10

| User | Operator | AC in current Operator Domain | UAC |
|---|---|---|---|
| User 1 | Operator B | 300 | 100,000 |
| User 2 | Operator B | 133.33 | 33,333 |
| User 3 | Operator B | 100 | 100,000 |
| User 4 | Operator B | 100 | 33,333 |
| User 5 | Operator B | 52.08 | 12,500 |
| User 6 | Operator B | 39.27 | 10,000 |

As shown in Table 10, User 6's 100 AC in the Operator C Domain is converted to 39.27 AC in the Operator B Domain after User 6 transfers to the Operator B Domain.

Accordingly, there is a total of 724.69 of AC allocated to all of the users in the application domain after the conversion.

The AC currency exchange module 1616 calculates AC in the Operator B Domain that corresponds to User 6's AC in the Operator C Domain as shown below:

User 6 AC in the Operator B Domain=[10000 User6 UAC]/([$200,000 Operator B AC Pool Contribution]/[785.41 total AC prior to conversion])=39.27 AC in the Operator B Domain Table 11 represents an exemplary state of the application credit earning interleaved wagering system after User 3 earns an additional 100 AC in the Operator B Domain.

TABLE 11

| User | Operator | AC in current Operator Domain | UAC |
|---|---|---|---|
| User 1 | Operator B | 300 | 100,000 |
| User 2 | Operator B | 133.33 | 33,333 |
| User 3 | Operator B | 100 | 100,000 |
| User 3 | Operator B | 100 | 24,252 |
| User 4 | Operator B | 100 | 33,333 |
| User 5 | Operator B | 52.08 | 12,500 |
| User 6 | Operator B | 39.27 | 10,000 |

As shown in Table 11, the AC management module 1694 awards User 3 an additional 100 AC in the Operator B Domain, and thus there is a total of 824.69 of AC allocated to all of the users in the application domain after User 3 earns the additional 100 AC.

The AC currency exchange module 1616 calculates the UAC value for this additional 100 AC earned by User 3 as shown below:

User 3 UAC=[100 User3 AC in Operator B Domain]*[$200,000 Operator B AC Pool Contribution]/[824.69 of AC after earning an additional 100 AC]=24,252 UAC Table 12 represents an exemplary state of the application credit earning interleaved wagering system the AC management module 1694 awards User 1 an additional 100 AC in the Operator B Domain.

TABLE 12

| User | Operator | AC in current Operator Domain | UAC |
|---|---|---|---|
| User 1 | Operator B | 300 | 100,000 |
| User 1 | Operator B | 100 | 21,629 |
| User 2 | Operator B | 133.33 | 33,333 |
| User 3 | Operator B | 100 | 100,000 |
| User 3 | Operator B | 100 | 24,252 |
| User 4 | Operator B | 100 | 33,333 |
| User 5 | Operator B | 52.08 | 12,500 |
| User 6 | Operator B | 39.27 | 10,000 |

As shown in Table 12, User 1 earns an additional 100 AC in the Operator B Domain, and thus there is a total of 924.69 of AC allocated to all of the users in the application domain after User 1 earns the additional 100 AC.

The AC currency exchange module 1616 calculates UAC value for this additional 100 AC earned by User 1 as shown below:

User 1 UAC=[100 User1 AC in Operator B Domain]*[$200,000 Operator B AC Pool Contribution]/[924.69 of AC after earning an additional 100 AC]=21,629 UAC Table 13 represents an exemplary state of the application credit earning interleaved wagering system after User 1 transfers to the Operator A Domain.

TABLE 13

| User | Operator | AC in current Operator Domain | UAC |
|---|---|---|---|
| User 1 | Operator A | 924.69 | 100,000 |
| User 1 | Operator A | 200 | 21,629 |
| User 2 | Operator B | 133.33 | 33,333 |
| User 3 | Operator B | 100 | 100,000 |
| User 3 | Operator B | 100 | 24,252 |
| User 4 | Operator B | 100 | 33,333 |
| User 5 | Operator B | 52.08 | 12,500 |
| User 6 | Operator B | 39.27 | 10,000 |

As shown in Table 13, the AC currency exchange module 1616 converts User 1's first AC entry of 300 AC in the Operator B Domain to 924.69 AC in the Operator A Domain, and converts User 1's second AC entry of 100 AC in the Operator B Domain to 200 AC in the Operator A Domain, after User 1 transfers to the Operator A Domain. Accordingly, there is a total of 1649.38 of AC allocated to all of the users in the application domain after the conversion.

The AC currency exchange module 1616 calculates the AC in the Operator A Domain that corresponds to User 1's AC in the Operator B Domain as shown below:

User 1 AC in the Operator A Domain (first entry)=[100,000 User1 UAC]/([$100,000 Operator A AC Pool Contribution]/[924.69 total AC prior to conversion])=924.69 AC in the Operator A Domain User 1 AC in the Operator A Domain (second entry)=[21,629 User1 UAC]/([$100,000 Operator A AC Pool Contribution]/[924.69 total AC prior to conversion])=200 AC in the Operator A Domain As shown in Tables 1 to 13, in the example embodiment, an amount of UAC corresponding to AC earned at a particular point in time does not change. Moreover, the same amount of UAC is not always determined for a given amount of AC earned in an operator domain. In an example embodiment, in Table 6, 100,000 UAC is determined for the 100 AC earned by User 3 in the Operator B Domain, whereas 33,333 UAC is determined for the 100 AC earned by User 4 in the Operator B Domain. The amount of UAC determined for User 4's 100 AC is less than the UAC determined for User 3's 100 AC because a greater amount of AC is outstanding at the time the UAC is determined for User 4's AC. That is, the economic value of AC in the Operator B Domain decreases due to inflation as more AC is earned within the application domain.

Therefore, in the example embodiment, the timing at which a user earns AC, and the operator domain in which the user earns the AC determine the economic value of the AC. Accordingly, a more skillful user that is in an operating domain with a lesser AC pool contribution can generate AC having a higher economic value than AC earned by a less skill user that plays in an operating domain with a greater AC pool contribution.

In some embodiments, the economic value of a user's AC is preserved when the user transfers from a first operator domain to a second operator domain.

In some embodiments, the economic value of a user's AC is not preserved when the user transfers from a first operator domain to a second operator domain.

—Consuming AC—

Table 14 is an exemplary AC ledger 1643 of User 1 prior to the AC consumption module 1648 processing a AC consumption request initiated by User 1's device 1600 to consume AC to acquire an economic value item worth 1000 UAC.

TABLE 14

AC Ledger 1143
User ID: 1
Total UAC Balance: 121,629

| Transaction ID | Source of AC | Telemetry | UAC | Debit AC | Credit AC | Balance |
|---|---|---|---|---|---|---|
| First Award: Operator A; 100 AC; 100,000 UAC | | | | | | |
| 1 | Operator A | Hit target (first award) | 100,000 | — | 100 | 100 |
| 2 | — | <Transfer first award to Operator B> | 100,000 | 100 | — | 0 |
| 3 | Operator B | <Transfer first award to Operator B> | 100,000 | — | 300 | 300 |
| 4 | | <Transfer first award to Operator A> | 100,000 | 300 | — | 0 |
| 5 | Operator A | <Transfer first award to Operator A> | 100,000 | — | 924.69 | 924.69 |
| Second Award: Operator B; 100 AC; 21,629 UAC | | | | | | |
| 1 | Operator B | Hit target (second award) | 21,629 | — | 100 | 100 |
| 2 | | <Transfer second award to Operator A> | 21,629 | 100 | — | 0 |
| 3 | Operator A | <Transfer second award to Operator A> | 21,629 | — | 200 | 200 |

As shown in Table 14, User 1 has a first award of 924.69 AC (awarded by Operator A) worth 100,000 UAC and a second award of 200 AC (awarded by Operator B) worth 21,629 UAC.

Table 15 is an exemplary AC ledger 1143 of User 1 after the AC consumption module 1148 processes an AC consumption request initiated by User 1's device 1600 to consume AC to acquire an economic value item worth 1000 AC.

TABLE 15

AC Ledger 1143
User ID: 1
Total UAC Balance: 120,629

| Transaction ID | Source of AC | Telemetry | UAC | Debit AC | Credit AC | Balance |
|---|---|---|---|---|---|---|
| First Award: Operator A; 100 AC; 100,000 UAC | | | | | | |
| 1 | Operator A | Hit target (first award) | 100,000 | — | 100 | 100 |
| 2 | — | <Transfer first award to Operator B> | 100,000 | 100 | — | 0 |
| 3 | Operator B | <Transfer first award to Operator B> | 100,000 | — | 300 | 300 |
| 4 | | <Transfer first award to Operator A> | 100,000 | 300 | — | 0 |
| 5 | Operator A | <Transfer first award to Operator A> | 100,000 | — | 924.69 | 924.69 |
| 6 | | <Consume 1000 UAC from first award to acquire economic value item 123 from Operator A> | 1,000 | 9.25 | — | 915.44 |
| Second Award: Operator B; 100 AC; 21,629 UAC | | | | | | |
| 1 | Operator B | Hit target (second award) | 21,629 | — | 100 | 100 |
| 2 | | <Transfer second award to Operator A> | 21,629 | 100 | — | 0 |
| 3 | Operator A | <Transfer second award to Operator A> | 21,629 | — | 200 | 200 |

As shown in Table 15, User 1 consumes 9.25 of the first award of 924.69 AC to acquire an economic value item worth 1000 UAC. The patron management server 1006 calculates the amount of AC consumed using the following equation:

[Amount of AC Consumed from a Given Award]=
([Economic Value in UAC of economic value item]/[Economic Value in UAC of the Award])*
[Balance of AC of the Award]

Accordingly, the patron management server 1006 calculates the amount of AC consumed from the first award as follows: (1,000/100,000)*(924.69)=9.25 AC of the first Award.

In the example embodiment, in a case where a user has received more than one AC award, the patron management server 1615 updates the AC ledger of the user to record a consumption of AC from earlier AC awards. In some embodiments, in a case where a user has received more than one AC award, the patron management server 1615 updates the AC ledger of the user to record a consumption of AC from later AC awards. In some embodiments, in a case where a user has received more than one AC award, the patron management server 1615 updates the AC ledger of the user to record a consumption of AC from a determined award to achieve a desired economic effect.

Table 16 represents an exemplary state of the application credit earning interleaved wagering system after User 1 consumes 9.25 of the first award of 924.69 AC to acquire an economic value item worth 1000 UAC.

TABLE 16

| User | Operator | AC in current Operator Domain | UAC |
|---|---|---|---|
| User 1 | Operator A | 915.44 | 99,000 |
| User 1 | Operator A | 200 | 21,629 |
| User 2 | Operator B | 133.33 | 33,333 |
| User 3 | Operator B | 100 | 100,000 |
| User 3 | Operator B | 100 | 24,252 |
| User 4 | Operator B | 100 | 33,333 |
| User 5 | Operator B | 52.08 | 12,500 |
| User 6 | Operator B | 39.27 | 10,000 |

Table 17 is an exemplary AC Consumption Ledger 1644 after User 1 acquires the economic value item 123 by consuming AC worth 1000 UAC from first AC award.

TABLE 17

AC Consumption Ledger 1144
User ID: 1

| Transaction ID | Economic Value Item Description | Economic Value Item ID | Operator Domain of Consumption Module | Value of AC Consumed | Operator Receiving Benefit |
|---|---|---|---|---|---|
| 1 | Financial Instrument A | 123 | Operator A | 1000 UAC | NA |

As shown in Table 17, User 1 acquires the economic value item 123 (Financial Instrument A) from Operator A by consuming AC worth 1,000 UAC. No other operator receives a benefit from the AC consumption.

In the example embodiment, in a case where another operator receives a benefit of the AC consumption, then the operator receiving the benefit reimburses the operator that contributed funds to the AC pool that are used to acquire the economic value item that the user acquires. For example, if User 1 acquires an entry ticket for an in-house tournament operated by Operator B, and Operator A contributes the funds that are used to purchase the entry ticket from Operator B, then Operator B reimburses Operator A in connection with User 's acquisition of the entry ticket. That is, since Operator A uses funds in connection with the AC consumption and Operator B receives those funds, Operator B reimburses Operator A to make Operator A whole.

—Patron Management Server—

Figure 12:
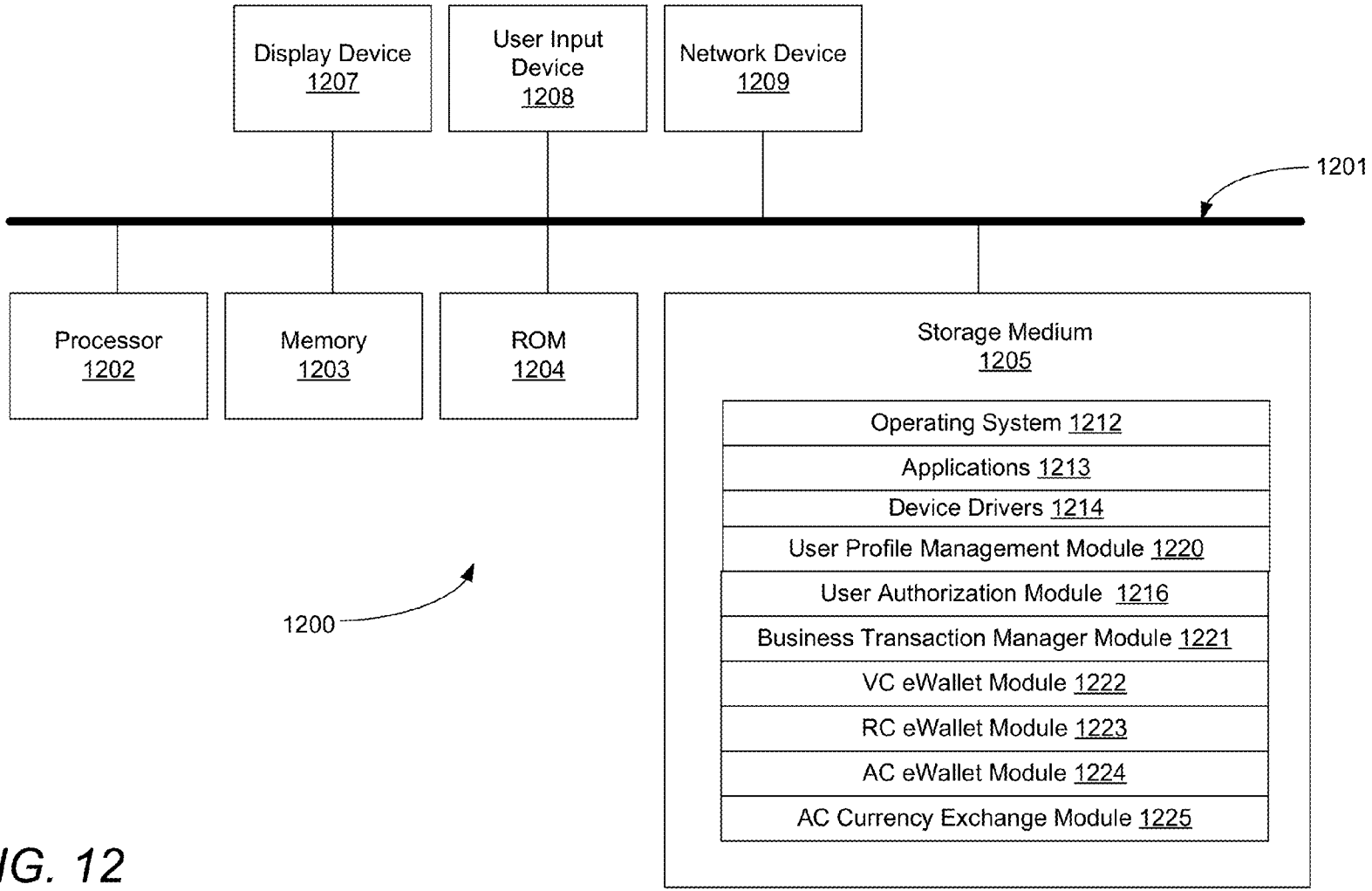
FIG. 12 is an architecture diagram of a patron management server of an application credit earning interleaved wagering system in accordance with various embodiments of the invention.

FIG. 12 is an architecture diagram of the patron management server 1200. In the example embodiment, the patron management server 1200 is a server device. In some embodiments, the patron management server 1200 is any suitable type of device, such as, for example, a rack-mount server device, a blade server device, a client device, a network device, a mobile device, and the like.

The bus 1201 interfaces with a processor 1202, a random access memory (RAM) 1203, a read only memory (ROM) 1204, a processor-readable storage medium 1205, a display device 1207, a user input device 1208, and a network device 1209.

The processor 1202 may take many forms, such as, for example, a central processing unit (processor), a multi-processor unit (MPU), an ARM processor, and the like.

The network device 1209 provides one or more wired or wireless interfaces for exchanging data and commands between the patron management server 1200 and other devices, such as, for example, AC management devices, AC consumption devices, user registration device, user's device, and application controller. Such wired and wireless interfaces include, for example, a Universal Serial Bus (USB) interface, Bluetooth interface, Wi-Fi interface, Ethernet interface, Near Field Communication (NFC) interface, and the like.

Machine-executable instructions in software programs (such as an operating system 1212, application programs 1213, and device drivers 1214) are loaded into the memory 1203 from the processor-readable storage medium 1205, the ROM 1204 or any other storage location. During execution of these software programs, the respective machine-executable instructions are accessed by the processor 1202 via the bus 1201, and then executed by the processor 1202. Data used by the software programs are also stored in the memory 1203, and such data is accessed by the processor 1202 during execution of the machine-executable instructions of the software programs.

The processor-readable storage medium 1205 is one of (or a combination of two or more of) a hard drive, a flash drive, a DVD, a CD, a flash storage, a solid state drive, a ROM, and EEPROM, and the like. The processor-readable storage medium 1205 includes the operating system 1212, the software programs 1213, the device drivers 1214, the business transaction manager module 1221, the VC eWallet module 1222, the RC eWallet module 1223, the AC eWallet Module 1224, the AC currency exchange module 1225, the user profile management module 1220, and a user authorization module 1216.

The AC eWallet module 1224 includes machine-executable instructions for controlling the processor 1202 to control the patron management server 1223 to manage AC eWallets, as described herein.

The AC currency exchange module 1225 includes machine-executable instructions for controlling the processor 1202 to control the patron management server 1223 to determine UAC and convert AC, as described above.

In the example embodiment of FIG. 12, the user profile management module 1220 includes machine-executable instructions for receiving a user ID from the business transaction management module 1221, controlling the processor 1202 to control the patron management server 1223 to receive user profile data corresponding to the user ID from a user registration device (e.g., user registration device 1003), and providing the received user profile data (corresponding to the user ID) to the business transaction management module 1221. In the example embodiment, the received user profile data corresponding to the user ID includes information for accessing the VC eWallet, the RC eWallet, and the AC eWallet corresponding to the user ID, by using the VC eWallet Module 1222, the RC eWallet module 1223, and the AC eWallet module 1224, respectively.

—User Registration Device—

Figure 13:
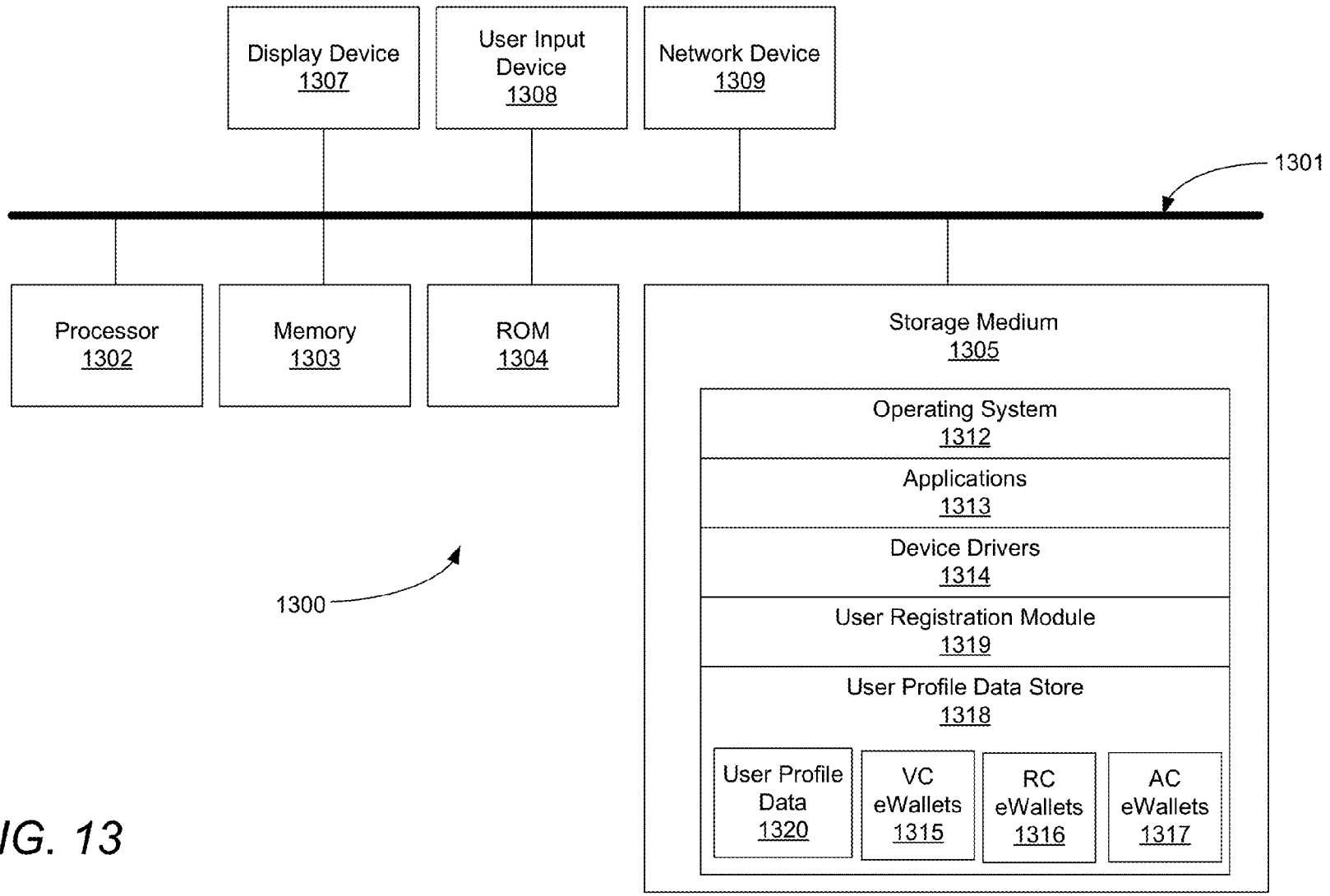
FIG. 13 is an architecture diagram of a user registration device of an application credit earning interleaved wagering system in accordance with various embodiments of the invention.

FIG. 13 is an architecture diagram of the user registration device 1300. In the example embodiment, the user registration device 1300 is a server device. In some embodiments, the user registration device 1300 is any suitable type of device, such as, for example, a rack-mount server device, a blade server device, a client device, a network device, a mobile device, and the like.

The bus 1301 interfaces with a processor 1302, a random access memory (RAM) 1303, a read only memory (ROM) 1304, a processor-readable storage medium 1305, a display device 1307, a user input device 1308, and a network device 1309.

The processor 1302 may take many forms, such as, for example, a central processing unit (processor), a multi-processor unit (MPU), an ARM processor, and the like.

The network device 1309 provides one or more wired or wireless interfaces for exchanging data and commands between the user registration device 1300 and other devices, such as, for example, a user's device and a patron management server. Such wired and wireless interfaces include, for example, a Universal Serial Bus (USB) interface, Bluetooth interface, Wi-Fi interface, Ethernet interface, Near Field Communication (NFC) interface, and the like.

Machine-executable instructions in software programs (such as an operating system 1312, application programs 1313, and device drivers 1314) are loaded into the memory 1303 from the processor-readable storage medium 1305, the ROM 1304 or any other storage location. During execution of these software programs, the respective machine-executable instructions are accessed by the processor 1302 via the bus 1301, and then executed by the processor 1302. Data used by the software programs are also stored in the memory 1303, and such data is accessed by the processor 1302 during execution of the machine-executable instructions of the software programs.

The processor-readable storage medium 1305 is one of a (or a combination of two or more of) a hard drive, a flash drive, a DVD, a CD, a flash storage, a solid state drive, a ROM, an EEPROM, and the like. The processor-readable storage medium 1305 includes the operating system 1312, the software programs 1313, the device drivers 1314, the user registration module 1319, and the user profile data store 1318. The user profile data store 1318 includes the user profile data 1320, VC eWallets 1315, RC eWallets 1316, and AC eWallets 1317. The user registration module 1319 includes machine-executable instructions for controlling the processor 1302 to control the user registration device 1300 to generate user profile data and register the user profile data with the patron management server 1006, as described above.

—AC Management Device—

Figure 14:
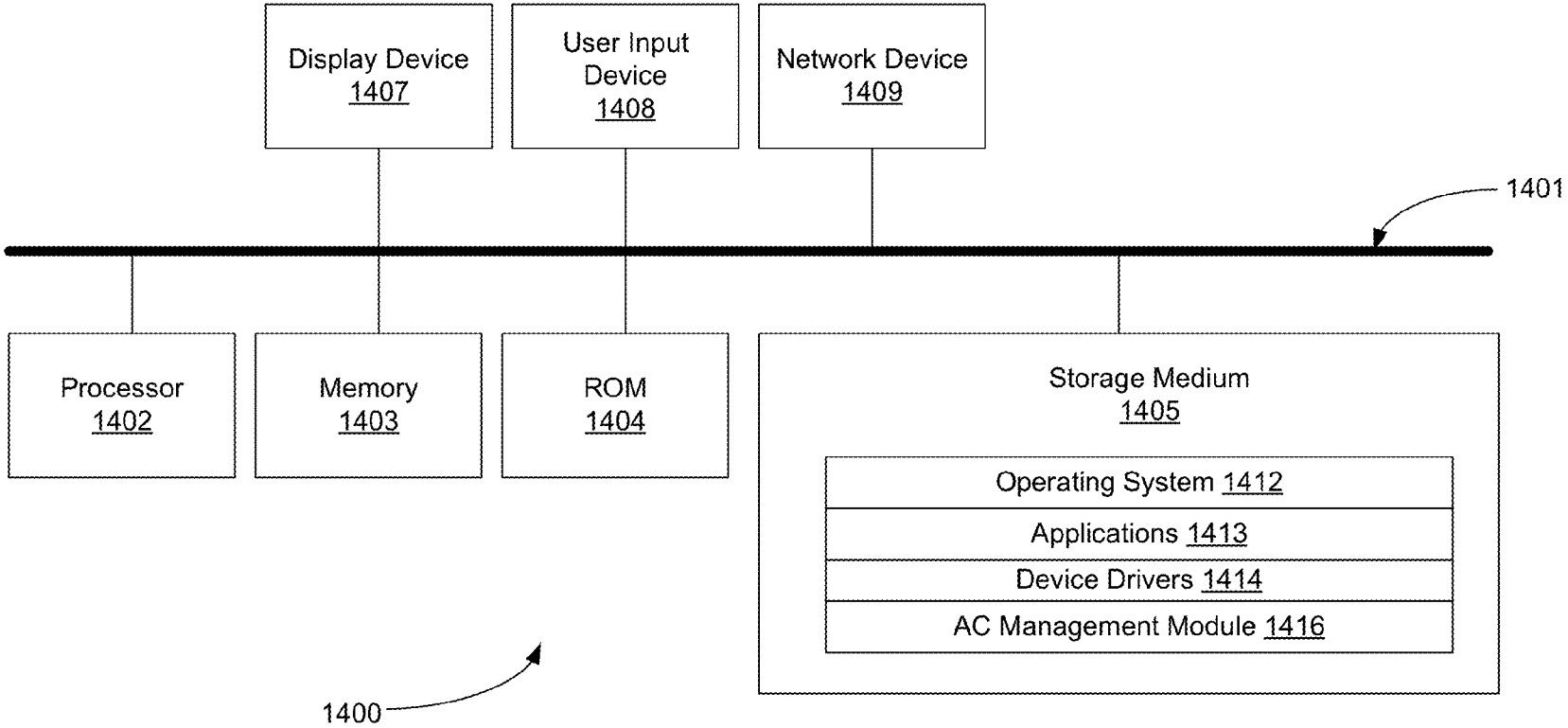
FIG. 14 is an architecture diagram of an AC management device of an application credit earning interleaved wagering system in accordance with various embodiments of the invention.

FIG. 14 is an architecture diagram of an AC management device 1400. In the example embodiment, the AC management device 1400 is a server device. In some embodiments, the AC management device 1693 of FIG. 11 has an architecture similar to the architecture of the AC management device 1400.

In some embodiments, the AC management device 1400 is any suitable type of device, such as, for example, a rack-mount server device, a blade server device, a client device, a network device, a mobile device, and the like.

The bus 1401 interfaces with a processor 1402, a random access memory (RAM) 1403, a read only memory (ROM) 1404, a processor-readable storage medium 1405, a display device 1407, a user input device 1408, and a network device 1409.

The processor 1402 may take many forms, such as, for example, a central processing unit (processor), a multi-processor unit (MPU), an ARM processor, and the like.

The network device 1409 provides one or more wired or wireless interfaces for exchanging data and commands between the AC management device 1400 and other devices, such as, for example, an application controller and a patron management server. Such wired and wireless interfaces include, for example, a Universal Serial Bus (USB) interface, Bluetooth interface, Wi-Fi interface, Ethernet interface, Near Field Communication (NFC) interface, and the like.

Machine-executable instructions in software programs (such as an operating system 1412, application programs 1413, and device drivers 1414) are loaded into the memory 1403 from the processor-readable storage medium 1405, the ROM 1404 or any other storage location. During execution of these software programs, the respective machine-executable instructions are accessed by the processor 1402 via the bus 1401, and then executed by the processor 1402. Data used by the software programs are also stored in the memory 1403, and such data is accessed by the processor 1402 during execution of the machine-executable instructions of the software programs.

The processor-readable storage medium 1405 is one of a (or a combination of two or more of) a hard drive, a flash drive, a DVD, a CD, a flash storage, a solid state drive, a ROM, an EEPROM, and the like. The processor-readable storage medium 1405 includes the operating system 1412, the software programs 1413, the device drivers 1414, and the AC management module 1416. The AC management module 1416 includes machine-executable instructions for controlling the processor 1402 to control the AC management device 1400 to allocate AC to users, as described above.

—AC Consumption Device—

Figure 15:
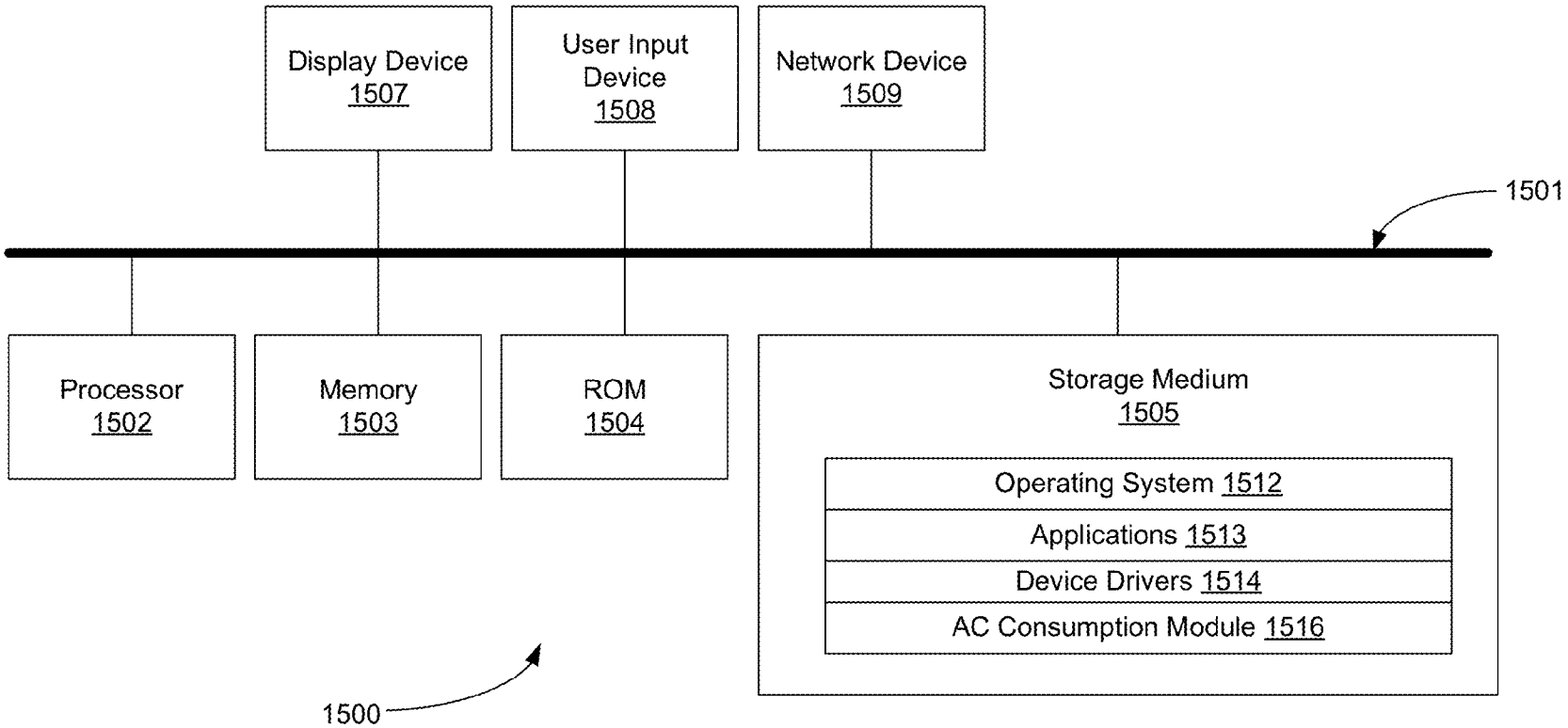
FIG. 15 is an architecture diagram of an AC consumption device of an application credit earning interleaved wagering system in accordance with various embodiments of the invention.

FIG. 15 is an architecture diagram of the AC consumption device 1500. In the example embodiment, the AC consumption device 1500 is a server device. In some embodiments, the AC consumption device 1691 of FIG. 11 has an architecture similar to the architecture of the AC consumption device 1500.

In some embodiments, AC consumption device 1500 is any suitable type of device, such as, for example, a rack-mount server device, a blade server device, a client device, a network device, a mobile device, and the like.

The bus 1501 interfaces with a processor 1502, a random access memory (RAM) 1503, a read only memory (ROM) 1504, a processor-readable storage medium 1505, a display device 1507, a user input device 1508, and a network device 1509.

The processor 1502 may take many forms, such as, for example, a central processing unit (processor), a multi-processor unit (MPU), an ARM processor, and the like.

The network device 1509 provides one or more wired or wireless interfaces for exchanging data and commands between the AC management device 1645 and other devices, such as, for example, the patron management server 1006. Such wired and wireless interfaces include, for example, a Universal Serial Bus (USB) interface, Bluetooth interface, Wi-Fi interface, Ethernet interface, Near Field Communication (NFC) interface, and the like.

Machine-executable instructions in software programs (such as an operating system 1512, application programs 1513, and device drivers 1514) are loaded into the memory 1503 from the processor-readable storage medium 1505, the ROM 1504 or any other storage location. During execution of these software programs, the respective machine-executable instructions are accessed by the processor 1502 via the bus 1501, and then executed by the processor 1502. Data used by the software programs are also stored in the memory 1503, and such data is accessed by the processor 1502 during execution of the machine-executable instructions of the software programs.

The processor-readable storage medium 1505 is one of a (or a combination of two or more of) a hard drive, a flash drive, a DVD, a CD, a flash storage, a solid state drive, a ROM, an EEPROM, and the like. The processor-readable storage medium 1505 includes the operating system 1512, the software programs 1513, the device drivers 1514, and the AC consumption module 1516. In the example embodiment, the AC consumption module 1516 includes machine-executable instructions for controlling the processor 1502 to control the AC consumption device 1500 to provide an AC consumption user interface, process AC consumption requests, and provide information about an operator's contribution to an AC pool, as described above.

Figure 16:
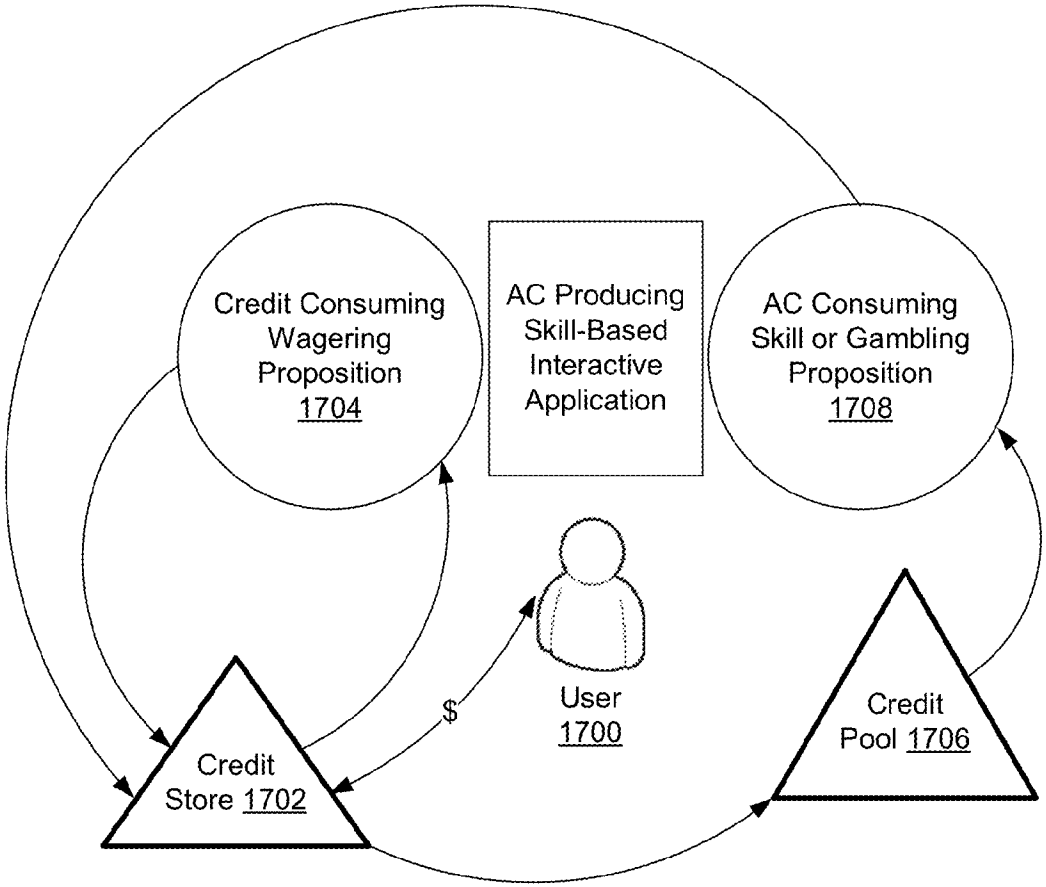
FIG. 16 is a process flow diagram for an embodiment of an application credit earning interleaved wagering system in accordance with embodiments of the invention.

FIG. 16 illustrates a process flow for an embodiment of an application credit earning interleaved wagering system in accordance with embodiments of the invention. As illustrated, the application credit earning interleaved wagering system includes three interacting components, a real credit (RC) or virtual credit (VC) first wagering proposition operatively connected to a skill-based interactive application that produces application credit (AC) as an award to a user for playing the application credit earning interleaved wagering system, and a AC consuming component that consumes AC in a skill-based proposition or a second wagering proposition.

As a user 1700 interacts with the application credit earning interleaved wagering system, the user exchanges value, such as real currency or credits in a real currency, for credits (Cr) that are stored in a credit store 1702. As the user 1700 interacts with an interactive application provided by an interactive controller of the application credit earning interleaved wagering system, the credits are wagered in the first wagering proposition (1704) as triggered by events in the interactive application of the application credit earning interleaved wagering system as described herein. Upon a successful wager, a payout of credits is added to credit store 1702. In addition, a portion of each wager made is contributed to a credit pool 1706. Credits in the credit pool 1706 are not available for wagering in the first wagering proposition 1704, but are instead made available to be earned or won by the user 1700 in the AC consuming skill proposition or second wagering proposition 1708. In some embodiments, the credit pool 1706 is a progressive credit pool for two or more users of application credit earning interleaved wagering systems. All or part of the progressive credit pool 1706 is to be earned or won by one or more users of application credit earning interleaved wagering systems.

As the user 1700 interacts with the application credit earning interleaved wagering system and makes wagers, the user also earns AC through skillful play of the interactive application as described herein. The AC is exchanged for an opportunity for the user to participate in the AC consuming skill proposition or second wagering proposition 1708 in order to earn or win part or all of the credits stored in the credit pool 1706.

In various embodiments, a second wagering proposition 1708 that consumes AC is for a game of chance that is a drawing or lottery wherein a number of entries in the drawing or lottery accorded to a user is determined by an amount of AC the user has accumulated in the interactive application of the application credit earning interleaved wagering system. In such an embodiment, all or a portion of the progressive credit pool 1706 is paid to a winning entry. Accordingly, the more entries accorded to a single user, the higher the probability that the single user will win the drawing or lottery. Therefore, a more skillful a user playing the interactive application of the application credit earning interleaved wagering system earns more AC, thus gaining more entries into the lottery or drawing, and thus earning a higher probability of winning the drawing or lottery. If a user wins the drawing or lottery, a portion or all of the progressive credit pool is credited to the user's credit store. In many of these embodiments, the credit pool is a progressive credit pool paid into by a plurality of users.

In various embodiments, an AC consuming second wagering proposition 1708 is for a game of chance where a random outcome and a paytable determines a payout of credits of all or a portion of the credit pool 1706. In such embodiments, an amount of user's AC is exchanged for one or more opportunities to play the game of chance without having to provide additional value for credits. Examples include, but are not limited to: if the game of chance is a slot machine style wagering mechanic, the user will receive "free" spins of the slot machine; receiving a free spin on a Wheel of Fortune style game of chance; playing a hand of a card game without having to provide an ante, raises or the like; receiving one or more free bets on a spin of a roulette wheel; etc. In such embodiments, a number of opportunities to play the game of chance may be determined by an amount of AC that is exchanged for the number of opportunities to play the game of chance.

In some embodiments, an AC consuming skill proposition 1708 is for a tournament that is played head-to-head between a plurality of users of application credit earning interleaved wagering systems. A user exchanges AC for an opportunity to participate in the tournament. One or more winners of the tournament share in a payout of credits of all or a portion of the credit pool 1706. In some embodiments, a proportion of credits of the credit pool paid out to a user participating in the tournament is determined from an amount of AC that the user exchanges for the opportunity to play in the tournament.

In some embodiments, an AC skill proposition that consumes AC is presented to a user within the context of the original interactive application of the application credit earning interleaved wagering system. In such embodiments, the user exchanges AC for application resources that the user utilizes within the interactive application in order to achieve an objective. All or a portion of the credit pool 1706 is paid out to one or more users who achieve the objective. In some embodiments, the objective may not be achieved unless the user has exchanged the AC for the application resources. In many embodiments, achievement of the objective is based on the skill of the user attempting to achieve the objective. That is, in any set of users having a range of skill in the interactive application of the application credit earning interleaved wagering system, there will be some members of the set of users whose skill at the interactive application will be insufficient for those members to achieve the objective. Conversely, within the set of users, there will be some members of the set of users whose skill at the interactive application is sufficient to achieve the objective. Examples of application resources and objectives include, but are not limited to: in a first person shooter interactive application, a user exchanges AC for an application resource that is a unique game world weapon wherein the unique game world weapon is required in order to achieve an objective that is a defeat of a unique non-user character; in a strategy-based game a user exchanges AC for application resources that are unique playing pieces that are required to achieve a unique objective; in a racing interactive application, a user exchanges AC for an application resource that is a unique vehicle wherein the unique vehicle is required to achieve an objective that is a winning of a race; in an interactive arcade style game, a user exchanges AC for an application resource that is a powerup wherein the powerup is required to achieve a particular objective; etc.

Figure 17:
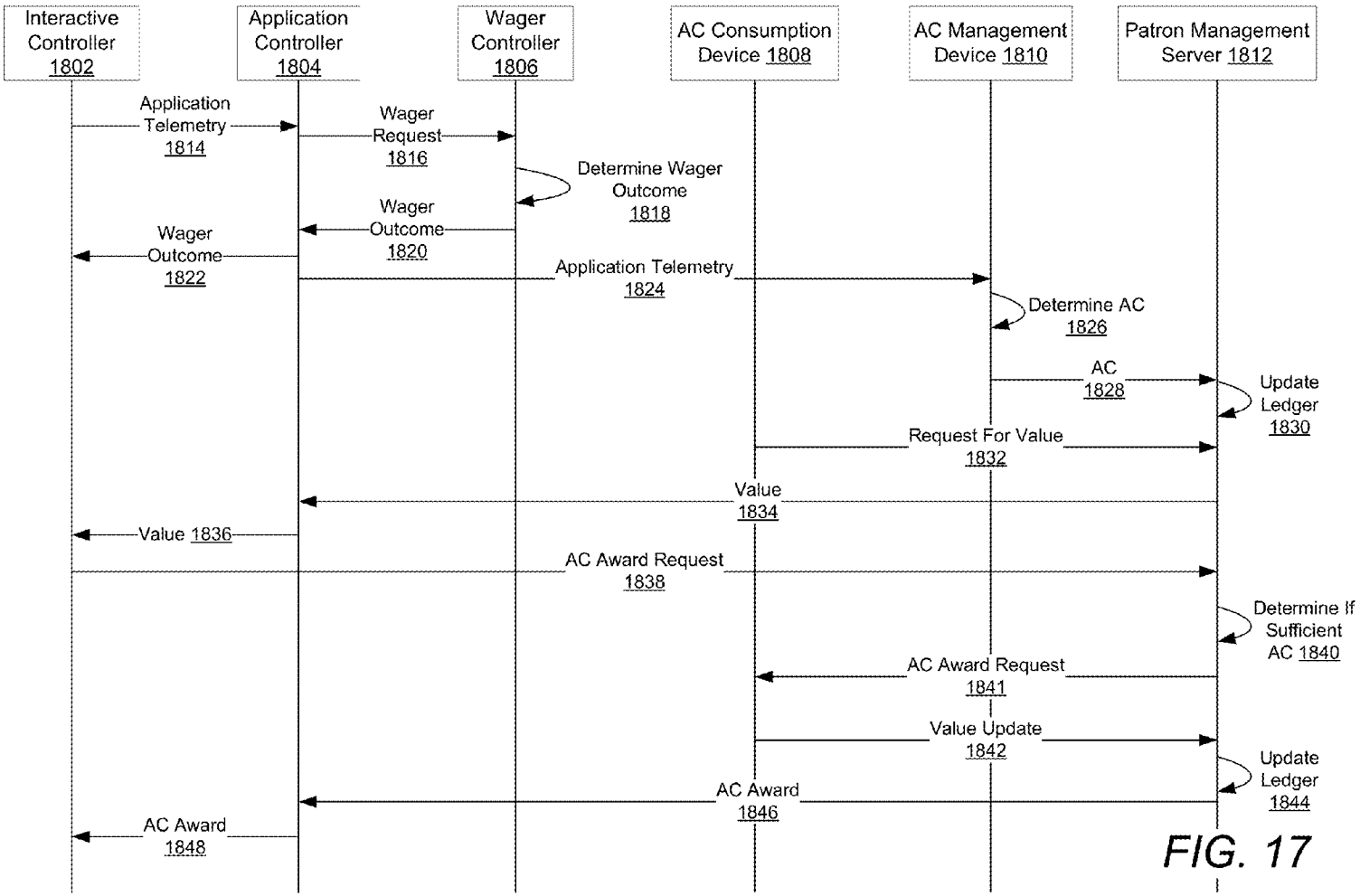
FIG. 17 is a sequence diagram of interactions between components of an application credit earning interleaved wagering system in accordance with various embodiments of the invention.

FIG. 17 is a sequence diagram of interactions between elements of an application credit earning interleaved wagering system, in accordance with embodiments of the invention. In some embodiments, the system includes an interactive controller 1802, an application controller 1804, a wager controller 1806, an AC consumption device 1808, an AC management device 1810, and a patron management server 1812, each as described herein. In some embodiments, the interactive controller 1802 provides an interactive application. In some embodiments, the interactive application is an interactive game. In some embodiments, the interactive game is a skill-based game. In some embodiments, the interactive game is a chance-based game.

The interactive controller 1802 communicates, to the application controller 1804, application telemetry (1814). In some embodiments, the application telemetry is associated with a user of the interactive application provided by the interactive controller 1802. In some embodiments, the application telemetry follows an application telemetry protocol. In some embodiments, the application telemetry protocol comprises an identification of the user. In some embodiments, the application telemetry protocol comprises an identification of the interactive application. In some embodiments, the application telemetry protocol comprises an event that has occurred in the interactive application. In some embodiments, the application telemetry protocol is an array of the elements making up the application telemetry. In some embodiments, the application telemetry protocol is a concatenation of the data of elements making up the application telemetry.

The application controller 1804 receives, from the interactive controller 1802, the application telemetry (1814). The application controller 1804 scans the application telemetry to determine whether to trigger a wager request. The application controller 1804 generates wager request instructions and instructs the wager controller 1806 by communicating the wager request instructions to the wager controller 1806 (1816). In some embodiments, the wager request instructions follows a wager request instructions protocol. In some embodiments, the wager request instructions protocol comprises an identification of the user. In some embodiments, the wager request instructions protocol comprises an identification of a paytable to be used. In some embodiments, the wager request instructions protocol comprises an amount to be wagered. In some embodiments, the wager request instructions protocol comprises a wagering mechanic to be used in the wager. In some embodiments, the wager request instructions protocol is an array of the elements making up the wager request instructions. In some embodiments, the wager request instructions protocol is a concatenation of the data of elements making up the wager request instructions.

The wager controller 1806 receives, from the application controller 1804, the wager request instructions (1816). The wager controller 1806 determines a wager outcome based on the wager request instructions (1818). The wager controller 1806 communicates, to the application controller 1804, wager outcome data including the wager outcome (1820). In some embodiments, the wager outcome data follows a wager outcome data protocol. In some embodiments, the wager outcome data protocol comprises an identification of the user. In some embodiments, the wager outcome data protocol comprises an identification of the interactive application. In some embodiments, the wager outcome data protocol comprises an amount won or lost. In some embodiments, the wager outcome data protocol comprises the wagering mechanic used in determining the wager outcome. In some embodiments, the wager outcome data protocol is an array of the elements making up the wager outcome data. In some embodiments, the wager outcome data protocol is a concatenation of the data of elements making up the wager outcome data.

The application controller 1804 receives, from the wager controller 1806, the wager outcome data (1820). The application controller 1804 scans the wager outcome data to determine the wager outcome. The application controller 1804 generates wager outcome display instructions based on the wager outcome. The application controller 1804 instructs the interactive controller 1802 by communicating the wager outcome display instructions to the interactive controller 1802 (1822). In some embodiments, the wager outcome display instructions follows a wager outcome display instructions protocol. In some embodiments, the wager outcome display instructions protocol comprises an identification of the user. In some embodiments, the wager outcome display instructions protocol comprises an identification of the interactive application. In some embodiments, the wager outcome display instructions protocol comprises an amount won or lost. In some embodiments, the wager outcome display instructions protocol comprises the wagering mechanic used in determining the wager outcome. In some embodiments, the wager outcome display instructions protocol is an array of the elements making up the wager outcome display instructions. In some embodiments, the wager outcome display instructions protocol is a concatenation of the data of elements making up the wager outcome display instructions.

The interactive controller 1802 receives, from the application controller 1804, the wager outcome display instructions (1822). The interactive controller 1802 displays the wager outcome based on the wager outcome display instructions.

The application controller 1804 communicates, to the AC management device 1810, the application telemetry received from the interactive controller 1802 (1824). The AC management device 1810 receives, from the application controller 1804, the application telemetry (1824).

The AC management device 1810 determines whether AC should be awarded based on the application telemetry, as described herein (1826). The AC management device 1810 communicates, to the patron management server 1812, the AC awarded based on the application telemetry (1828). In some embodiments, the AC award data follows an AC award data protocol. In some embodiments, the AC award data protocol comprises an identification of the user. In some embodiments, the AC award data protocol comprises an identification of the interactive application. In some embodiments, the AC award data protocol comprises the amount of AC awarded. In some embodiments, the AC award data protocol is an array of the elements making up the AC award data. In some embodiments, the AC award data protocol is a concatenation of the data of elements making up the AC award data.

The patron management server 1812 receives, from the AC management device 1810, the AC (1828). The patron management server 1810 updates a ledger associated with the user of the interactive application, based on the received AC (1830).

The AC consumption device 1808 communicates, to the patron management server 1812, a request for value of the AC ledger associated with the user (1832). In some embodiments, the AC ledger value request follows an AC ledger value request protocol. In some embodiments, the AC ledger value request protocol comprises an identification of the user. In some embodiments, the AC ledger value request protocol comprises an identification of an operator. In some embodiments, the AC ledger value request protocol is an array of the elements making up the AC ledger value request. In some embodiments, the AC ledger value request protocol is a concatenation of the data of elements making up the AC ledger value request.

The patron management server 1812 receives, from the AC consumption device 1808, the request for value of the AC ledger associated with the user (1832). The patron management server 1812 communicates, to the application controller 1804, the AC value associated with the user (1834). In some embodiments, the AC value data follows an AC value data protocol. In some embodiments, the AC value data protocol comprises an identification of the user. In some embodiments, the AC value data protocol comprises an identification of an operator. In some embodiments, the AC value data protocol is an array of the elements making up the AC value data. In some embodiments, the AC value data protocol is a concatenation of the data of elements making up the AC value data.

The application controller 1804 receives, from the patron management server 1812, the AC value associated with the user (1834). The application controller 1804 scans the AC value to determine a display of eligible awards that may be acquired in exchange for AC. The application controller 1804 generates AC value display instructions using the AC value. The application controller 1804 instructs the interactive controller 1802 by communicating the AC value display instructions to the interactive controller 1802 (1836). In some embodiments, the AC value display instructions follows an AC value display instructions protocol. In some embodiments, the AC value display instructions protocol comprises an identification of the user. In some embodiments, the AC value display instructions protocol comprises an identification of an operator. In some embodiments, the AC value display instructions protocol comprises an amount of AC associated with the user. In some embodiments, the AC value display instructions protocol is an array of the elements making up the AC value display instructions. In some embodiments, the AC value display instructions protocol is a concatenation of the data of elements making up the AC value display instructions.

The interactive controller 1802 receives, from the application controller 1804, the AC value display instructions (1836). The interactive controller 1802 displays the eligible awards based on the AC value display instructions.

The interactive controller 1802 may receive, from the user, an indication to use the AC in exchange for an AC award. The interactive controller 1802 communicates, to the patron management server 1812, an AC award request (1838). In some embodiments, the AC award request follows an AC award request protocol. In some embodiments, the AC award request protocol comprises an identification of the user. In some embodiments, the AC award request protocol comprises an identification of the interactive application. In some embodiments, the AC award request protocol comprises an identification of the AC award requested. In some embodiments, the AC award request protocol is an array of the elements making up the AC award request. In some embodiments, the AC award request protocol is a concatenation of the data of elements making up the AC award request.

The patron management server 1812 receives, from the interactive controller 1802, the AC award request (1838). The patron management server 1812 determines whether there is sufficient AC associated with the user in order to satisfy the AC award request. When there is sufficient AC in order to satisfy the AC award request, the patron management server 1812 communicates, to the AC consumption device 1808, the AC award request (1841).

The AC consumption device 1808 receives, from the patron management server 1812, the AC award request (1841). The AC consumption device 1808 generates the award based on the AC award request, and determines AC adjustment instructions. The AC consumption device 1808 communicates, to the patron management server 1812, an AC value update comprising the AC award and the AC adjustment (1842). The patron management server 1812 receives, from the AC consumption device 1808, the AC value update (1842).

The patron management server 1812 updates the AC ledger associated with the user based on the AC value update (1844). The patron management server 1812 communicates, to the application controller 1804, AC award data (1846). In some embodiments, the AC award data follows an AC award data protocol. In some embodiments, the AC award data protocol comprises an identification of the user. In some embodiments, the AC award data protocol comprises an identification of the interactive application. In some embodiments, the AC award data protocol comprises an identification of the AC award. In some embodiments, the AC award data protocol is an array of the elements making up the AC award data. In some embodiments, the AC award data protocol is a concatenation of the data of elements making up the AC award data.

The application controller 1804 receives, from the patron management server 1812, the AC award data (1846). The application controller 1804 scans the AC award data to determine the AC award. The application controller 1804 generates AC award instructions based on the AC award data. The application controller 1804 instructs the interactive controller 1802 by communicating the AC award instructions to the interactive controller 1802 (1848). The interactive controller 1802 receives, from the application controller 1804, the AC award instructions (1848). In some embodiments, the AC award instructions follows an AC award instructions protocol. In some embodiments, the AC award instructions protocol comprises an identification of the user. In some embodiments, the AC award instructions protocol comprises an identification of the interactive application. In some embodiments, the AC award instructions protocol comprises an identification of the AC award. In some embodiments, the AC award instructions protocol is an array of the elements making up the AC award instructions. In some embodiments, the AC award instructions protocol is a concatenation of the data of elements making up the AC award instructions.

In some embodiments, the AC award is an entry in a lottery. In some embodiments, the AC award is a predetermined number of executions of a wagering mechanic. In some embodiments, the AC award is an entry in a tournament. In some embodiments, the AC award is an application resource for use in the interactive application.

While the above description may include many specific embodiments of the invention, these should not be construed as limitations on the scope of the invention, but rather as examples of embodiments thereof. It is therefore to be understood that the present invention can be practiced otherwise than specifically described, without departing from the scope and spirit of the present invention. Thus, embodiments of the present invention described herein should be considered in all respects as illustrative and not restrictive.

What is claimed:

1. An electronic gaming machine constructed to provide an interleaved wagering system and to receive credits from a user, comprising:

an interactive controller including a user input device and a display output device, wherein the interactive controller is configured to:

provide a skill-based interactive application;

distribute, to an application controller, application telemetry associated with the user of the skill-based interactive application provided by the interactive controller;

receive, from the application controller, wager outcome display instructions;

display, via the display output device, a wager outcome based on the wager outcome display instructions;

receive, from the application controller, application credit (AC) value display instructions;

display, via the display output device, eligible awards based on the AC value display instructions;

distribute, to a patron management server, an AC award request comprising an AC award from the eligible awards; and receive, from the application controller, AC award instructions comprising the AC award;

a wager controller constructed to:

receive, from the application controller, wager request instructions;

determine the wager outcome based on the wager request instructions using a random number generator;

distribute, to the application controller, wager outcome data comprising the wager outcome; and the application controller operatively connecting the interactive controller and the wager controller, the application controller also operatively connected to a patron management server and an AC management device, and constructed to:

receive, from the interactive controller, the application telemetry;

scan the application telemetry to determine whether to trigger a wager request based on the user interacting with the skill-based interactive application;

generate the wager request instructions;

instruct the wager controller by communicating the wager request instructions to the wager controller;

receive, from the wager controller, the wager outcome data;

scan the wager outcome data to determine the wager outcome;

generate the wager outcome display instructions based on the wager outcome;

instruct the interactive controller by communicating the wager outcome display instructions to the interactive controller;

distribute, to the AC management device, the application telemetry, wherein the AC management device awards AC based on the application telemetry;

receive, from the patron management server, an AC value amount associated with the user;

scan the AC value amount to determine a display of eligible awards that may be acquired in exchange for AC;

generate the AC value display instructions using the AC value amount;

instruct the interactive controller by communicating the AC value display instructions to the interactive controller;

receive, from the patron management server, AC award data comprising the AC award;

scan the AC award data to determine the AC award;

generate the AC award instructions based on the AC award data; and instruct the interactive controller by communicating the AC award instructions to the interactive controller.

2. The electronic gaming machine of claim 1, wherein the interactive controller and the application controller are constructed from the same device, and wherein the application controller is operatively connected to the wager controller using a communication link.

3. The electronic gaming machine of claim 1, wherein the wager controller and the application controller are constructed from the same device, and wherein the application controller is operatively connected to the interactive controller using a communication link.

4. The electronic gaming machine of claim 1, wherein the interactive controller is further constructed to receive, from the user, an indication to use AC in exchange for an AC award.

5. The electronic gaming machine of claim 1, wherein the AC award is an entry in a lottery.

6. The electronic gaming machine of claim 1, wherein the AC award is a predetermined number of executions of a wagering mechanic.

7. The electronic gaming machine of claim 1, wherein the AC award is an entry in a tournament.

8. The electronic gaming machine of claim 1, wherein the AC award is an application resource for use in the skill-based interactive application.

9. An electronic gaming machine constructed to provide an interleaved wagering system and to receive credits from a user, comprising:

a wager controller constructed to:

receive, from an application controller, wager request instructions;

determine a wager outcome based on the wager request instructions using a random number generator;

distribute, to the application controller, wager outcome data comprising the wager outcome; and the application controller operatively connecting an interactive controller and the wager controller, the application controller also operatively connected to a patron management server and an AC management device, and constructed to:

receive, from the interactive controller, application telemetry associated with the user of a skill-based interactive application provided by the interactive controller;

scan the application telemetry to determine whether to trigger a wager request based on the user interacting with the skill-based interactive application;

generate the wager request instructions;

instruct the wager controller by communicating the wager request instructions to the wager controller;

receive, from the wager controller, the wager outcome data;

scan the wager outcome data to determine the wager outcome;

generate wager outcome display instructions based on the wager outcome;

instruct the interactive controller by communicating the wager outcome display instructions to the interactive controller for display on a display output device;

distribute, to the AC management device, the application telemetry, wherein the AC management device awards AC based on the application telemetry;

receive, from the patron management server, an AC value amount associated with the user;

scan the AC value amount to determine a display of eligible awards that may be acquired in exchange for AC;

generate AC value display instructions using the AC value amount;

instruct the interactive controller by communicating the AC value display instructions to the interactive controller for display on the display output device;

receive, from the patron management server, AC award data comprising the AC award;

scan the AC award data to determine the AC award;

generate AC award instructions based on the AC award data; and instruct the interactive controller by communicating the AC award instructions to the interactive controller.

10. The electronic gaming machine of claim 9, wherein the interactive controller receives, from the user, an indication to use AC in exchange for an AC award.

11. The electronic gaming machine of claim 9, wherein the AC award is an entry in a lottery.

12. The electronic gaming machine of claim 9, wherein the AC award is a predetermined number of executions of a wagering mechanic.

13. The electronic gaming machine of claim 9, wherein the AC award is an entry in a tournament.

14. The electronic gaming machine of claim 9, wherein the AC award is an application resource for use in the skill-based interactive application.

15. An electronic gaming machine constructed to provide an interleaved wagering system and to receive credits from a user, comprising:

an interactive controller including a user input device and a display output device, wherein the interactive controller is configured to:

provide a skill-based interactive application;

distribute, to an application controller, application telemetry associated with the user of the skill-based interactive application provided by the interactive controller;

receive, from the application controller, wager outcome display instructions;

display, via the display output device, a wager outcome based on the wager outcome display instructions;

receive, from the application controller, application credit (AC) value display instructions;

display, via the display output device, eligible awards based on the AC value display instructions;

distribute, to a patron management server, an AC award request comprising an AC award from the eligible awards; and receive, from the application controller, AC award instructions comprising the AC award; and the application controller operatively connecting the interactive controller to a wager controller, the application controller also operatively connected to a patron management server and an AC management device, and constructed to:

receive, from the interactive controller, the application telemetry;

scan the application telemetry to determine whether to trigger a wager request based on the user interacting with the skill-based interactive application;

generate wager request instructions;

instruct the wager controller by communicating the wager request instructions to the wager controller;

receive, from the wager controller, wager outcome data generated using a random number generator;

scan the wager outcome data to determine the wager outcome;

generate the wager outcome display instructions based on the wager outcome;

instruct the interactive controller by communicating the wager outcome display instructions to the interactive controller;

distribute, to the AC management device, the application telemetry, wherein the AC management device awards AC based on the application telemetry;

receive, from the patron management server, an AC value amount associated with the user;

scan the AC value amount to determine a display of eligible awards that may be acquired in exchange for AC;

generate the AC value display instructions using the AC value amount;

instruct the interactive controller by communicating the AC value display instructions to the interactive controller;

receive, from the patron management server, AC award data comprising the AC award;

scan the AC award data to determine the AC award;

generate the AC award instructions based on the AC award data; and instruct the interactive controller by communicating the AC award instructions to the interactive controller.

16. The electronic gaming machine of claim 15, wherein the interactive controller is further constructed to receive, from the user, an indication to use AC in exchange for an AC award.

17. The electronic gaming machine of claim 15, wherein the AC award is an entry in a lottery.

18. The electronic gaming machine of claim 15, wherein the AC award is a predetermined number of executions of a wagering mechanic.

19. The electronic gaming machine of claim 15, wherein the AC award is an entry in a tournament.

20. The electronic gaming machine of claim 15, wherein the AC award is an application resource for use in the skill-based interactive application.

* * * * *